US007892155B2

(12) United States Patent
Pearson et al.

(10) Patent No.: US 7,892,155 B2
(45) Date of Patent: Feb. 22, 2011

(54) EXERCISE DEVICE

(75) Inventors: Jeffrey Alan Pearson, Lacey, WA (US); Terrence Joehnk, Portland, OR (US); Eric D. Golesh, Arvada, CO (US); Edward L. Flick, Denver, CO (US); Matthew Rauwerdink, Westminster, CO (US); Brent Christopher, Denver, CO (US); Ryan R. Dibble, Denver, CO (US)

(73) Assignee: Nautilus, Inc., Vancouver, WA (US)

( * ) Notice: Subject to any disclaimer, the term of this patent is extended or adjusted under 35 U.S.C. 154(b) by 1088 days.

(21) Appl. No.: 11/331,544

(22) Filed: Jan. 13, 2006

(65) Prior Publication Data

US 2006/0189462 A1 Aug. 24, 2006

Related U.S. Application Data

(60) Provisional application No. 60/644,347, filed on Jan. 14, 2005.

(51) Int. Cl.
*A63B 21/00* (2006.01)

(52) U.S. Cl. ..... 482/121; 482/140; 482/130; 482/138

(58) Field of Classification Search ..... 482/121, 482/142, 140, 130, 129, 126, 138, 137, 101
See application file for complete search history.

(56) References Cited

U.S. PATENT DOCUMENTS 1,928,089 A 9/1933 Glickman (Continued)

FOREIGN PATENT DOCUMENTS

DE 198 01 672 A1 11/1998

(Continued)

OTHER PUBLICATIONS

Taiwan Official Letter (Preliminary Examination Report) and Search Report and English translation thereof for corresponding Taiwan Patent Application No. 095101572 dated May 6, 2008 (7 pages).

(Continued)

*Primary Examiner*—Jerome W Donnelly
(74) *Attorney, Agent, or Firm*—Dorsey & Whitney LLP

(57) ABSTRACT

The exercise devices disclosed herein are configurable to allow a user to perform various exercises. The exercise device can include an adjustable bench assembly connected with a frame supporting a cable-pulley assembly providing a user interface with a resistance system. A user can interface with an actuation component to pull resistance cables against resistance from the resistance system. Various exercise accessories can be provided that are easily connected with and removed from the exercise device to allow a user to perform different exercises. Some examples of exercise accessories are used to configure the exercise device for squat, abdominal, leg extension, leg curl, and arm curl exercises. The frame can also be configured to selectively place the exercise device in a stationary operating configuration supported by the frame on a support surface and a storage configuration wherein the exercise device is rollingly supported on the support surface by wheels.

46 Claims, 41 Drawing Sheets

U.S. PATENT DOCUMENTS

| | | | | |
|---|---|---|---|---|
| 2,632,645 | A | 3/1953 | Barkschat | |
| 3,394,934 | A | 7/1968 | Ella et al. | |
| 4,140,312 | A | 2/1979 | Buchmann | |
| 4,199,139 | A | 4/1980 | Mahnke et al. | |
| 4,286,782 | A | 9/1981 | Fuhrhop | |
| 4,316,609 | A | 2/1982 | Silberman | |
| 4,333,644 | A | 6/1982 | Lambert, Jr. et al. | |
| 4,369,966 | A | 1/1983 | Silberman et al. | |
| 4,468,025 | A | 8/1984 | Sferle | |
| 4,535,985 | A | 8/1985 | Mask | |
| 4,566,691 | A | 1/1986 | Mahnke | |
| 4,600,196 | A | 7/1986 | Jones | |
| 4,603,855 | A | 8/1986 | Sebelle | |
| 4,620,704 | A | 11/1986 | Shifferaw | |
| 4,624,457 | A | 11/1986 | Silberman et al. | |
| 4,632,390 | A | 12/1986 | Richey | |
| 4,634,127 | A | 1/1987 | Rockwell | |
| 4,725,057 | A | 2/1988 | Shifferaw | |
| 4,826,157 | A | 5/1989 | Fitzpatrick | |
| 4,898,381 | A | 2/1990 | Gordon | |
| 4,915,377 | A | 4/1990 | Malnke et al. | |
| 5,039,092 | A | 8/1991 | Olschansky et al. | |
| 5,069,447 | A | 12/1991 | Snyderman et al. | |
| 5,123,886 | A | 6/1992 | Cook | |
| 5,201,694 | A * | 4/1993 | Zappel | 482/133 |
| 5,217,422 | A | 6/1993 | Domzalski | |
| 5,348,524 | A | 9/1994 | Grant | |
| 5,470,299 | A | 11/1995 | Yeh | |
| 5,549,530 | A * | 8/1996 | Fulks | 482/100 |
| 5,588,938 | A | 12/1996 | Schneider et al. | |
| 5,637,059 | A | 6/1997 | Dalebout | |
| 5,700,232 | A | 12/1997 | Clausen et al. | |
| 5,716,308 | A | 2/1998 | Lee | |
| 5,810,698 | A | 9/1998 | Hullett et al. | |
| 5,827,154 | A | 10/1998 | Gill | |
| 5,830,113 | A | 11/1998 | Coody et al. | |
| 5,906,566 | A | 5/1999 | Whitcomb | |
| 5,921,897 | A | 7/1999 | Stevens | |
| 5,951,448 | A | 9/1999 | Bolland | |
| 5,957,818 | A | 9/1999 | Betournay | |
| 5,961,428 | A | 10/1999 | Webber | |
| 6,030,324 | A | 2/2000 | McBride | |
| 6,045,491 | A | 4/2000 | McNergney et al. | |
| 6,090,020 | A | 7/2000 | Webber | |
| 6,095,955 | A | 8/2000 | Lee | |
| 6,186,961 | B1 | 2/2001 | Hanoun | |
| 6,264,586 | B1 | 7/2001 | Webber | |
| 6,290,630 | B1 | 9/2001 | Boland | |
| 6,443,877 | B1 | 9/2002 | Hoecht et al. | |
| 6,491,610 | B1 | 12/2002 | Henn | |
| 6,551,226 | B1 | 4/2003 | Webber et al. | |
| 6,585,626 | B2 | 7/2003 | McBride | |
| 6,595,905 | B2 | 7/2003 | McBride | |
| 6,669,609 | B2 | 12/2003 | Gerschefske et al. | |
| 6,726,601 | B1 * | 4/2004 | Beutel | 482/52 |
| 6,752,745 | B1 * | 6/2004 | Davis | 482/72 |
| 6,926,647 | B1 * | 8/2005 | Huang et al. | 482/72 |
| 6,966,872 | B2 | 11/2005 | Eschenbach | |
| 7,115,080 | B2 | 10/2006 | Cockrill, Jr. et al. | |
| 7,189,190 | B2 | 3/2007 | Lamar et al. | |
| 7,229,391 | B2 | 6/2007 | Francis | |
| 7,250,022 | B2 * | 7/2007 | Dalebout et al. | 482/142 |
| 7,306,549 | B2 | 12/2007 | Francis | |
| 7,591,770 | B2 | 9/2009 | Stewart et al. | |
| 2002/0013199 | A1 * | 1/2002 | Giannelli et al. | 482/95 |
| 2002/0147086 | A1 | 10/2002 | Walsh | |
| 2003/0092540 | A1 | 5/2003 | Gillen | |
| 2003/0092541 | A1 | 5/2003 | Giannelli | |
| 2003/0114281 | A1 | 6/2003 | Mackert et al. | |
| 2003/0158018 | A1 | 8/2003 | Giannelli et al. | |
| 2003/0232707 | A1 | 12/2003 | Dalebout et al. | |
| 2004/0009856 | A1 | 1/2004 | Hammer | |
| 2004/0029688 | A1 | 2/2004 | Webber et al. | |
| 2005/0049121 | A1 | 3/2005 | Dalebout et al. | |
| 2005/0124470 | A1 | 6/2005 | Schopf | |
| 2006/0063650 | A1 | 3/2006 | Francis | |
| 2006/0100069 | A1 | 5/2006 | Dibble et al. | |

FOREIGN PATENT DOCUMENTS

| | | | |
|---|---|---|---|
| FR | 2 627 090 | A1 | 8/1989 |
| GB | 325435 | | 2/1930 |
| TW | 379572 | Y | 1/2000 |
| TW | 510233 | Y | 11/2002 |
| TW | 523417 | B | 3/2003 |

OTHER PUBLICATIONS

"8300s Series II Strength System," Schwinn Cycling & Fitness Inc., one page of product brochure showing 8300 Series II Strength System, 1 page (1999).

Bowflex advertisement flyer and order form "Special Offer! Order in 30 days and Receive an Extra 100lbs of Power Rods FREE!", 20 pages (1992). #.

"Bowflex Fitness", Bowflex, Inc., catalog, 8 pages (1998).

"Cross Bow by Weider," manual, ICON Health & Fitness, Inc., 22 pages (undated).

"Cross Bow by Weider How Does the Crossbow Stack up Against the Competition", ICON Health and Fitness located at http://www.iconfitness.com/crossbow/cb_vs_bf.html, 2 pages (retrieved Oct. 22, 2002).

Nautilus® Free Weight Equipment 2001 brochure, 14 pages (2001).

Schwinn Iron Classic Strength Training System by Bowflex® Owner's Manual, 55 pages (1993).

"Stamina LT-2000 Band Flex Gym", Stamina Products, Inc., located at Egghead.com, 3 pages (at least as early as Mar. 9, 2001).

U.S. Appl. No. 12/907,885, filed Oct. 19, 2010, Dibble et al.

* cited by examiner

EXERCISE DEVICE

CROSS-REFERENCE TO RELATED APPLICATION

This application claims the benefit of U.S. Provisional Application No. 60/644,347, filed on Jan. 14, 2005, which is hereby incorporated herein by reference.

BACKGROUND OF THE INVENTION

1. Field of the Invention

Aspects of the present invention relate to exercise devices, and some more particular aspects involve exercise devices having a resistance system and a cable-pulley system supported on a frame configurable between operating and storage configurations and utilizing various selectively removable exercise accessories and adjustable bench assembly for performing different exercises.

2. Background Art

The benefits of regular exercise, such as strength training, aerobic training, flexibility training, etc., are well known. Differently configured exercise devices can be used to perform various types exercises focusing on developing specific parts of a user's body. Some exercise machines include different types of accessories or stations, e.g., benches, handles, lat bars, leg exercise stations, etc., that allow a user to interface with a single resistance system while performing different exercises on a single exercise machine. One advantage of having multiple exercise stations on a single machine is that different exercises can be performed with a single resistance system. However, there can be some disadvantages associated with having multiple exercise stations on a single exercise machine. For example, some of these exercise machines can be relatively large, take up a large amount of floor space, and can be difficult to move from one location to another. In an attempt to alleviate these disadvantages, some exercise machines may be configured with removable exercise stations that allow a user to reconfigure an exercise device to perform different exercises. However, it can be cumbersome and time consuming to change exercise stations to reconfigure an exercise machine to perform different exercise. It is with this background in mind, as well as other issues, that some of the aspects of the embodiments described below were conceived and developed.

BRIEF SUMMARY OF THE INVENTION

Aspects of the present invention involve an exercise device with removable exercise accessories configurable to allow a user to perform various exercises. The exercise devices described and depicted herein include an adjustable bench assembly connected with a frame supporting a cable-pulley assembly providing a user interface with a resistance system. The cable-pulley assembly can include various resistance cables routed through various pulleys supported by the frame. The resistance cables can be connected with a handle or other actuation component and with the resistance system. As such, user can interface with the actuation component to pull the resistance cables against resistance imparted on the cables by the resistance system. As discussed in more detail below, the exercise device can also include various actuation components or devices in the form of exercise accessories or assemblies that are easily connected with and removed from the bench assembly and/or frame to allow a user to perform different exercises. Some examples of the exercise accessories allow a user to configure the exercise device to perform squat exercises, abdominal exercises, leg extension exercises, leg curl exercises, and arm curl exercises. The frame of the exercise device can also be configured to allow a user to selectively place the exercise device in a stationary operating configuration supported by the frame on a support surface, such as a floor or the ground, and a storage configuration wherein the exercise device is rollingly supported on the support surface by wheels.

In one aspect, an exercise device includes a frame; a resistance system operably coupled with the frame; a rail arranged in a substantially vertically orientation; an actuation assembly movably supported on the rail; and at least one cable operably coupled between the actuation assembly and the resistance system.

In another form, an exercise device includes a frame; a resistance system supported on the frame; a rail extending from the frame; a first member supporting the rail; and an actuation device removably coupled with the first member by way of at least one hook adapted to engage at least one protrusion.

In yet another form, an exercise device includes a frame including a first base frame pivotally coupled with a second base frame; a resistance system supported on the first base frame; a bench frame assembly supported on the second base frame and pivotally coupled wit the frame; and wherein the second base frame is pivotal to an upright storage position.

In still another form, an exercise device includes a frame including an upright portion and a base portion; a resistance system supported on the frame; a rail defining a first end portion and a second end portion, the first end portion connected with the frame; a means for supporting the second portion of the rail connected with the base portion of the frame; a means for actuating the resistance system; and a means for removably connecting the means for actuating with the means for supporting.

In still another form, an exercise device includes a frame; a resistance system supported on the frame; a rail extending from the frame; a seat movably supported on the rail; a means for actuating the resistance system; and a means for removably connecting the means for actuating with the seat.

In still another form, an exercise device includes a frame including a first base frame and a second base frame; a resistance means supported on the frame; a means for pivotally connecting the first base frame with the second base frame; a first means for rolling connected with the first base frame; and a second means for rolling connected with means for pivotally connecting the first base frame with the second base frame.

The features, utilities, and advantages of various embodiments of the invention will be apparent from the following more particular description of embodiments of the invention as illustrated in the accompanying drawings and defined in the appended claims.

DETAILED DESCRIPTION OF THE INVENTION

Figure 1:
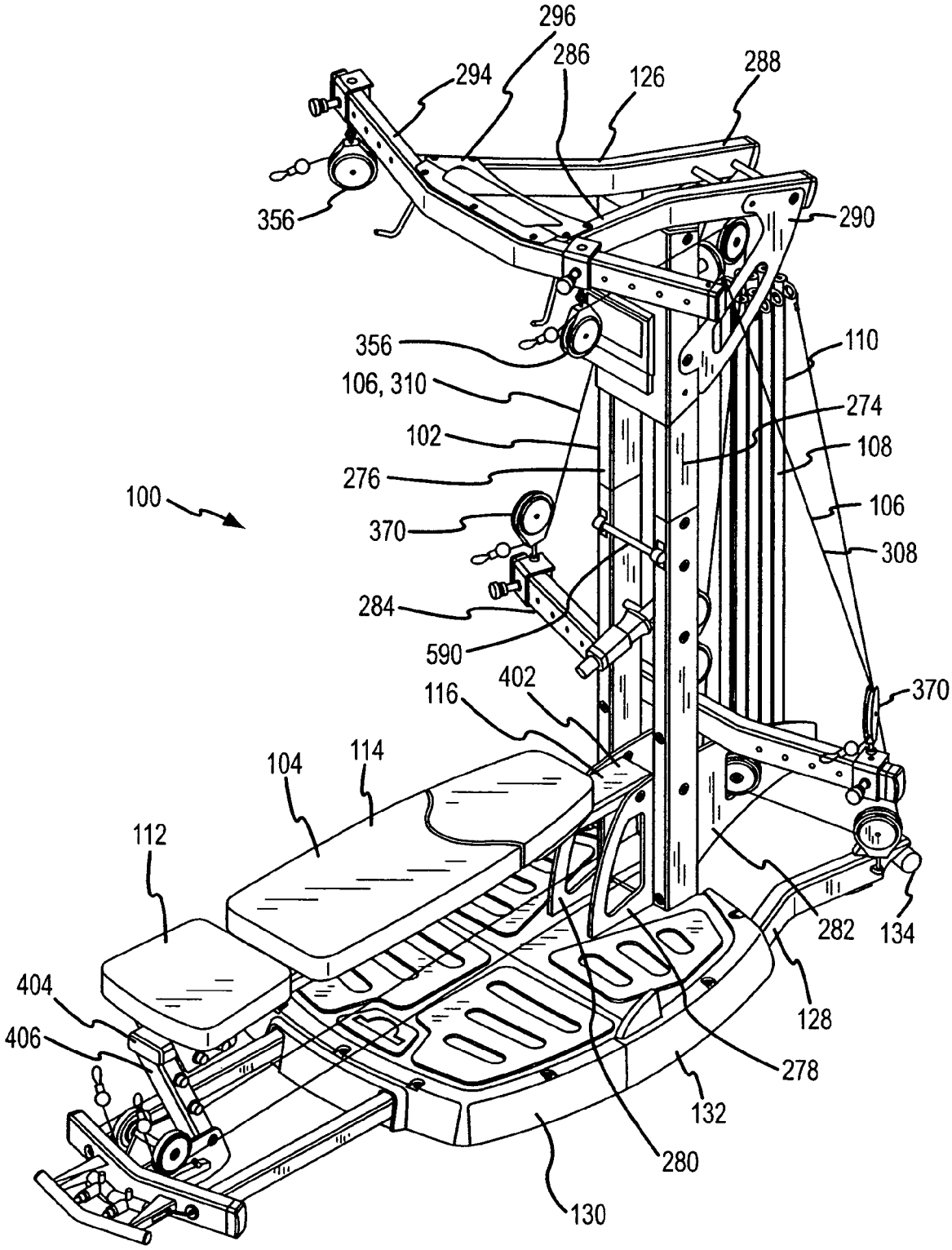
FIG. 1 is an isometric view of an exercise device according to aspects of the present invention.

Aspects of the present invention involve an exercise device configurable to allow a user to perform various exercises. The exercise devices described and depicted herein include an adjustable bench assembly connected with a frame supporting a cable-pulley assembly providing a user interface with a resistance system. The cable-pulley assembly can be configured in different ways and can include various resistance cables routed through various pulleys supported by the frame. As described below, one form of the exercise device includes four resistance cables. One end of a resistance cable can be connected with a handle or other actuation component or device, while another end of a resistance cable can be operably coupled with the resistance system through the cable-pulley system. In one form, the resistance system includes resiliently flexible rods as the source of resistance. As such, user can interface with the actuation component to pull the resistance cable, causing one or more resistance rods flex and bend, which imparts resistance against the cable motion and hence against the user. As discussed in more detail below, the frame is also configured to allow a user to selectively place the exercise device in an operating configuration and a storage configuration. When placed in the storage configuration, the exercise device is supported on wheels that allow a user to maneuver the device along a support surface from one location to another.

In some embodiments of the exercise device, the adjustable bench assembly includes a bench seat and a back support adjustably coupled with a seat rail. More particularly, the bench seat is movingly coupled with the seat rail such that the bench seat can move back and forth along the length of the seat rail. The bench seat can be configured to move along the seat rail in various ways, such as by rolling or sliding. In addition, the bench seat can be selectively locked into various positions along the length of the seat rail as well as being configured to move freely back and forth along the seat rail. The back support is not fixedly connected with the exercise device, and as such, is removable. When the bench seat is positioned on the seat rail in a rearward orientation relatively close to the frame and resistance system, the back support can be placed in an inclined position supported between the bench seat and the frame. As discussed in more detail below, one end portion of the seat rail is pivotally connected with the frame, which allows a user to place the exercise device in an upright position wherein an opposite end portion of the seat rail is oriented upward toward the frame. The exercise device can also include a rail locking mechanism to selectively lock the seat rail in the upright position. When the seat rail is placed in the upright position, the exercise device can be placed in the storage configuration without interfering with the seat rail. In addition, the exercise device can also be configured to perform a squat exercise when the seat rail is in the upright position by connecting a squat exercise accessory with the bench seat. When the seat rail is in a downward position, the end portion of the seat rail extends outward from an upright portion of the frame and is supported by a forward support member extending upwardly from a base portion of the frame.

As discussed in more detail below, the exercise device can also include various actuation devices or components in the form of exercise accessories or assemblies that are easily connected with and removed from the bench assembly and/or frame to allow a user to perform different exercises. For example, the exercise accessories can be used to configure the exercise device for abdominal exercises, leg extension exercises, leg curl exercises, arm curl exercises, and others. In addition, the exercise device can include a squat exercise accessory or assembly, which is releasably connectable with the bench seat and seat rail. As discussed in more detail below, the squat exercise accessory can be connected with the bench seat when the seat rail is placed in the upright position. It is to be appreciated that aspects of the exercise device that provide for ease of connection and removal of the exercise accessories disclosed herein can be applied to various other types and configurations of exercise accessories that allow the exercise device to be configured for various other exercises.

To use the exercise device, a user first places the bench assembly into position for a particular exercise and connects an actuation component or device with the resistance cables extending from the frame. The actuation component or device can be a handle, a strap, a bar, or some other device associated with one of the previously mentioned exercise accessories that can be releasably connected with the frame. The actuation device can also merely be a mechanical or molded piece to be configured to move along the seat rail and that can be connected with the resistance cables. The seat, handles, or other user interface components may be coupled with, either permanently or releasably, with the actuation device. Once the resistance cables are connected with the actuation device, the user selects the amount of resistance by connecting resistance cables with a desired number of resistance rods. As such, the resistance cables are operably coupled with the resistance system through the cable-pulley assembly. The user then places his body in position on or near the exercise device and begins exercising by exerting forces to the resistance cables through the actuation device. As the user pulls on the cables, the resistance system exerts resistance forces on the cables in an opposing direction. It is to be appreciated that the order in which the previously described operations can be performed may vary and should not be construed to be limited to the order described. Some of the various exercises that can be performed on the exercise device along with associated component orientations are illustrated in FIGS. 1-8, discussed below.

An exercise device 100 conforming to aspects of the present invention is shown in FIGS. 1-8. A frame 102 provides the structural support for the exercise device. More particularly, the frame 102 supports a bench assembly 104, a cable-pulley system 106, a resistance system 108, and other features. It is to be appreciated that the frame 102 can be configured differently depending on particular arrangements and combinations of the exercise device. The cable-pulley assembly 106 provides a user interface with the resistance system 108, which is supported by the frame and includes a plurality of selectable resistance rods 110. Although the resistance systems of the exercise devices described and illustrated herein utilize resiliently flexible rods as the source of resistance, it is to be appreciated that the resistance system can also include conventional weight stacks, torsional springs, linear springs, or other types of resiliently flexible elements as the source of resistance.

Embodiments of the exercise devices are described herein with the perspective of a user seated on the bench while facing the frame and resistance system. For example, components designated as "right" are on the right side of the exercise device from the perspective of a user in the previously described position. In many instances, however, users will operate an exercise device conforming to some aspect of the invention while seated facing away from the frame and resistance system or not seated at all. As such, aspects of the invention are not limited to the orientation of a user, but left and right references merely are used merely for the convenience of the reader.

Figure 2:
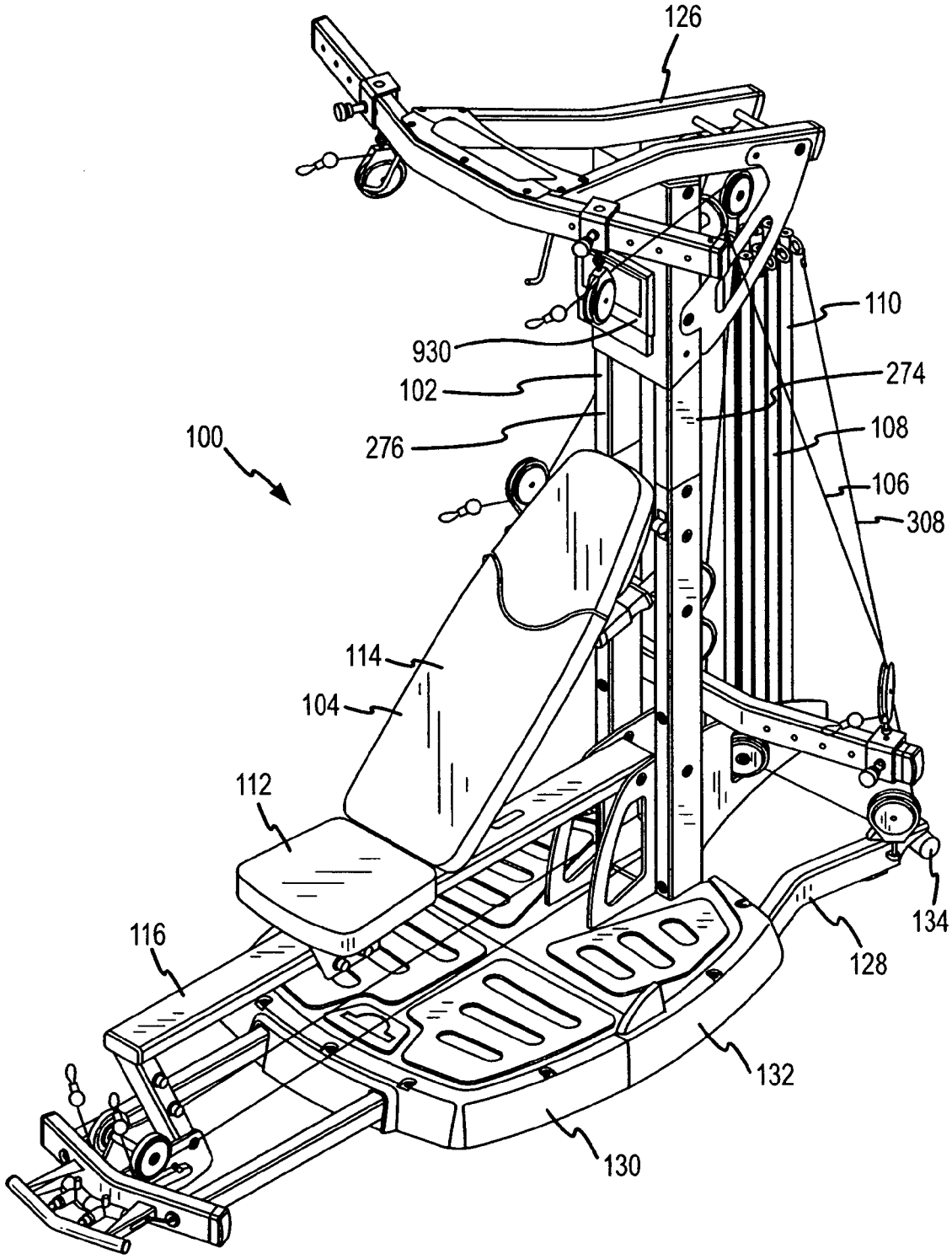
FIG. 2 is a view of the exercise device configured with a bench assembly configured in an inclined position.

As shown in FIGS. 1-2 and others, and as discussed in more detail below, the bench assembly 104 can include a bench seat 112 and a back support 114 that are individually and collectively adjustable supported by a seat rail 116. Generally, the bench seat 112 can move along the seat rail 116, and the back support 114 can pivot with respect to the bench seat. As discussed in more detail below, the bench seat 112 is rollingly coupled with the seat rail 116 such that the bench seat can roll back and forth along the length of the seat rail. Additionally, the bench seat 112 can be configured to be selectively locked in various locations along the length of the seat rail 116. The bench seat 112 can also be configured to roll freely back and forth along the seat rail. The back support 114 can also be tilted or pivoted with respect to the bench seat 112.

Figure 3:
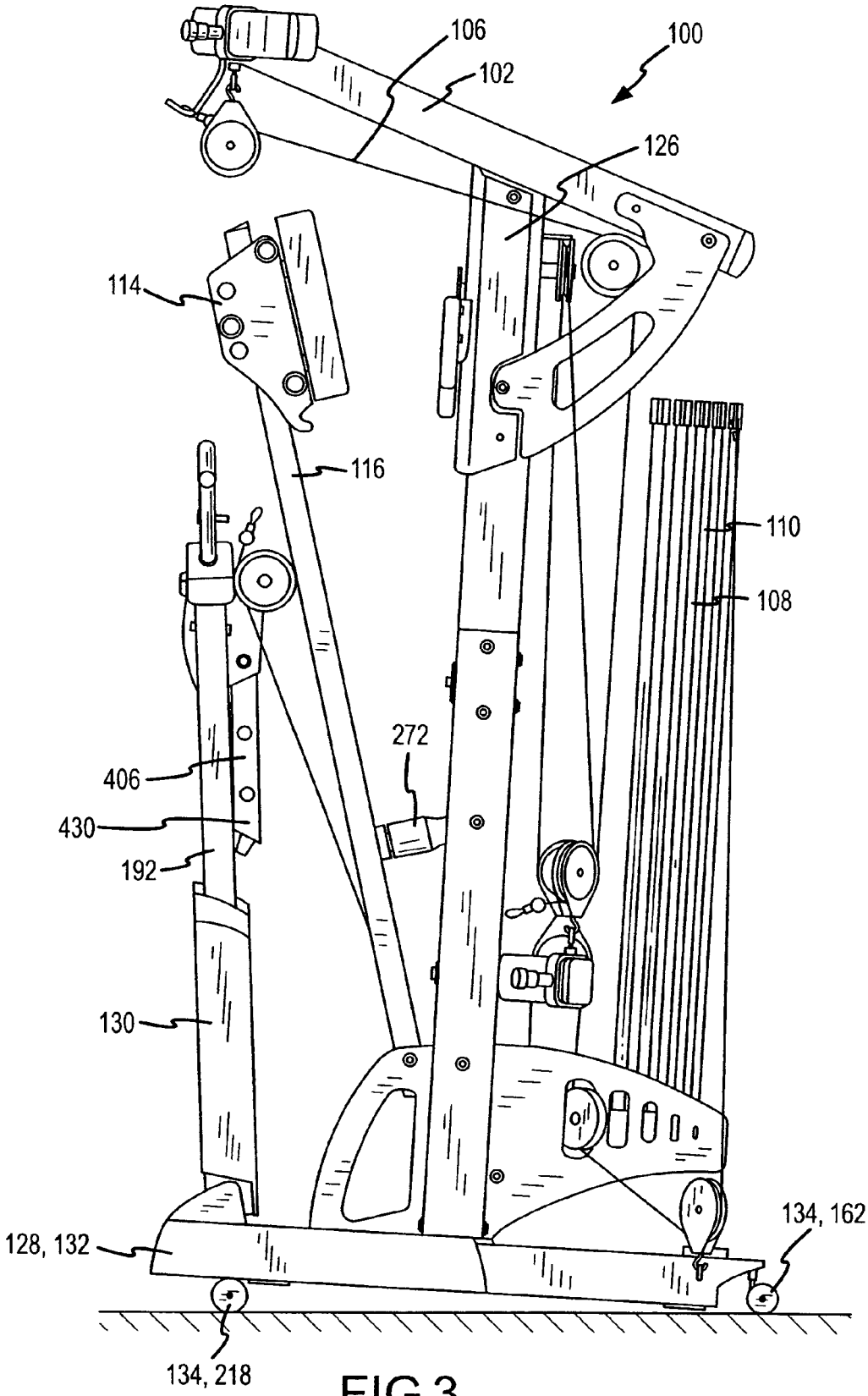
FIG. 3 is a side view of the exercise device in a storage configuration.
Figure 4:
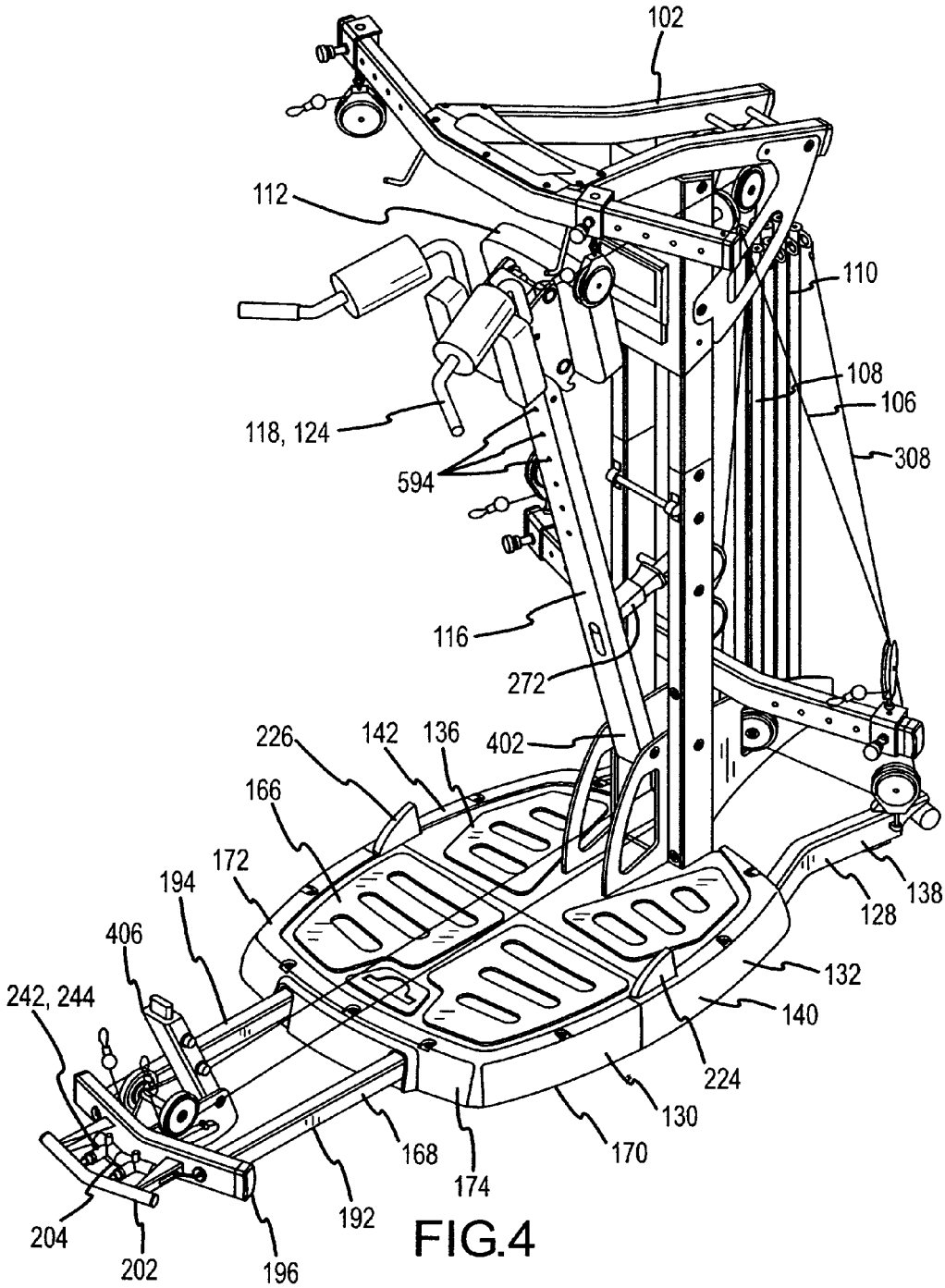
FIG. 4 is a view of the exercise device with a squat exercise accessory configured to perform squat exercises.
Figure 5:
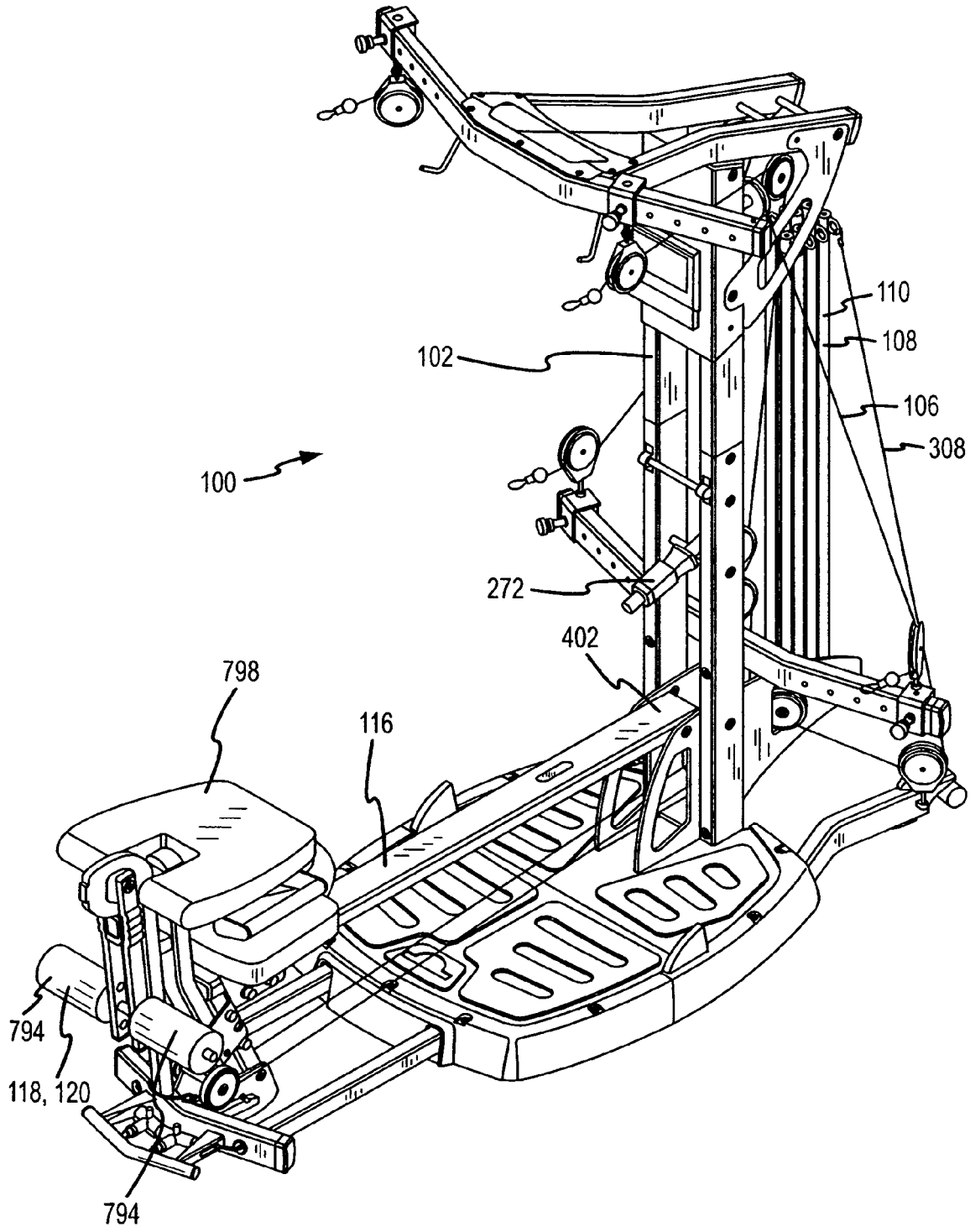
FIG. 5 is a view of the exercise device with a multi-purpose exercise accessory configured to perform leg extension exercises.
Figure 6:
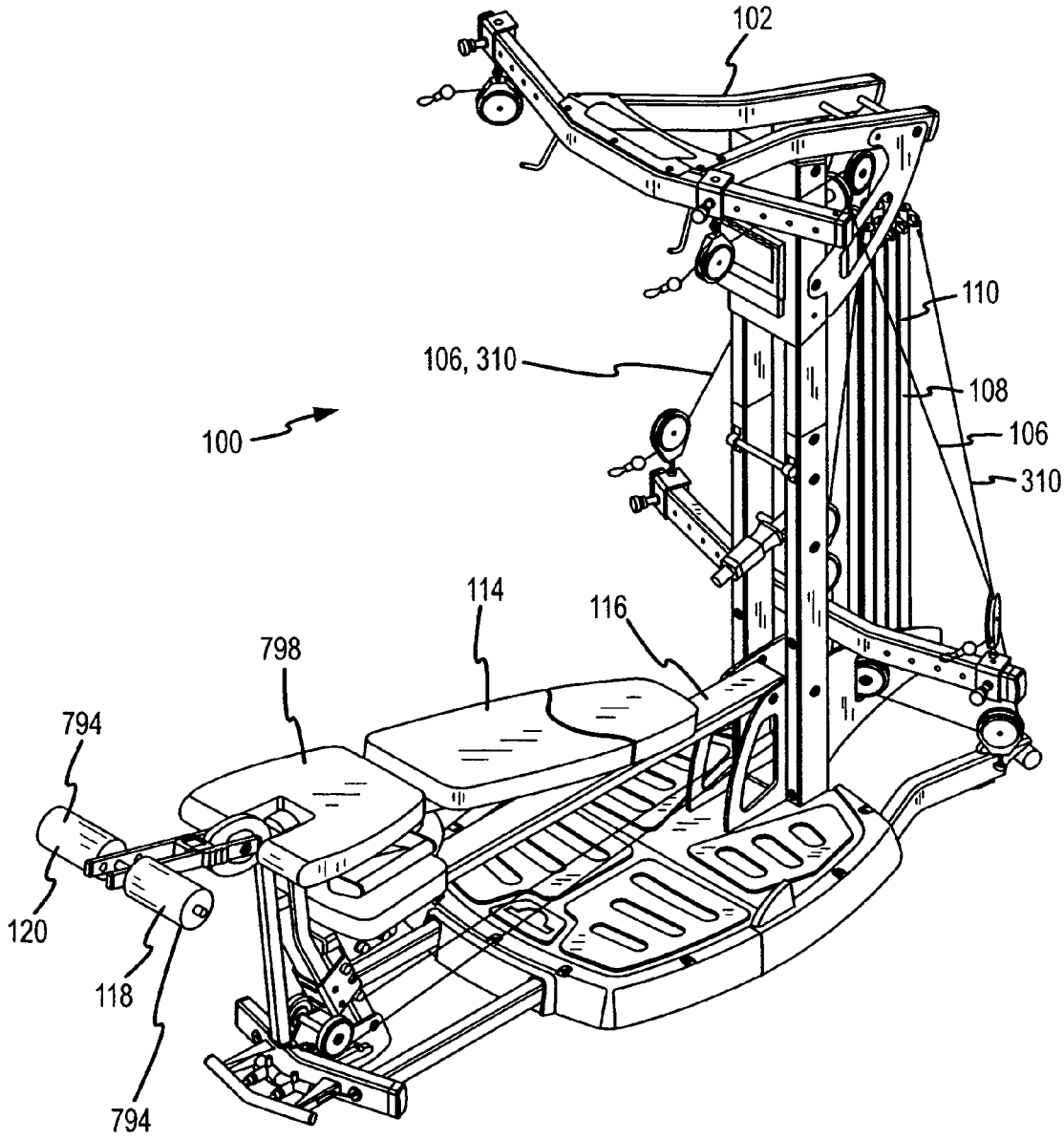
FIG. 6 is a view of the exercise device with a multi-purpose exercise accessory configured to perform leg curl exercises.
Figure 7:
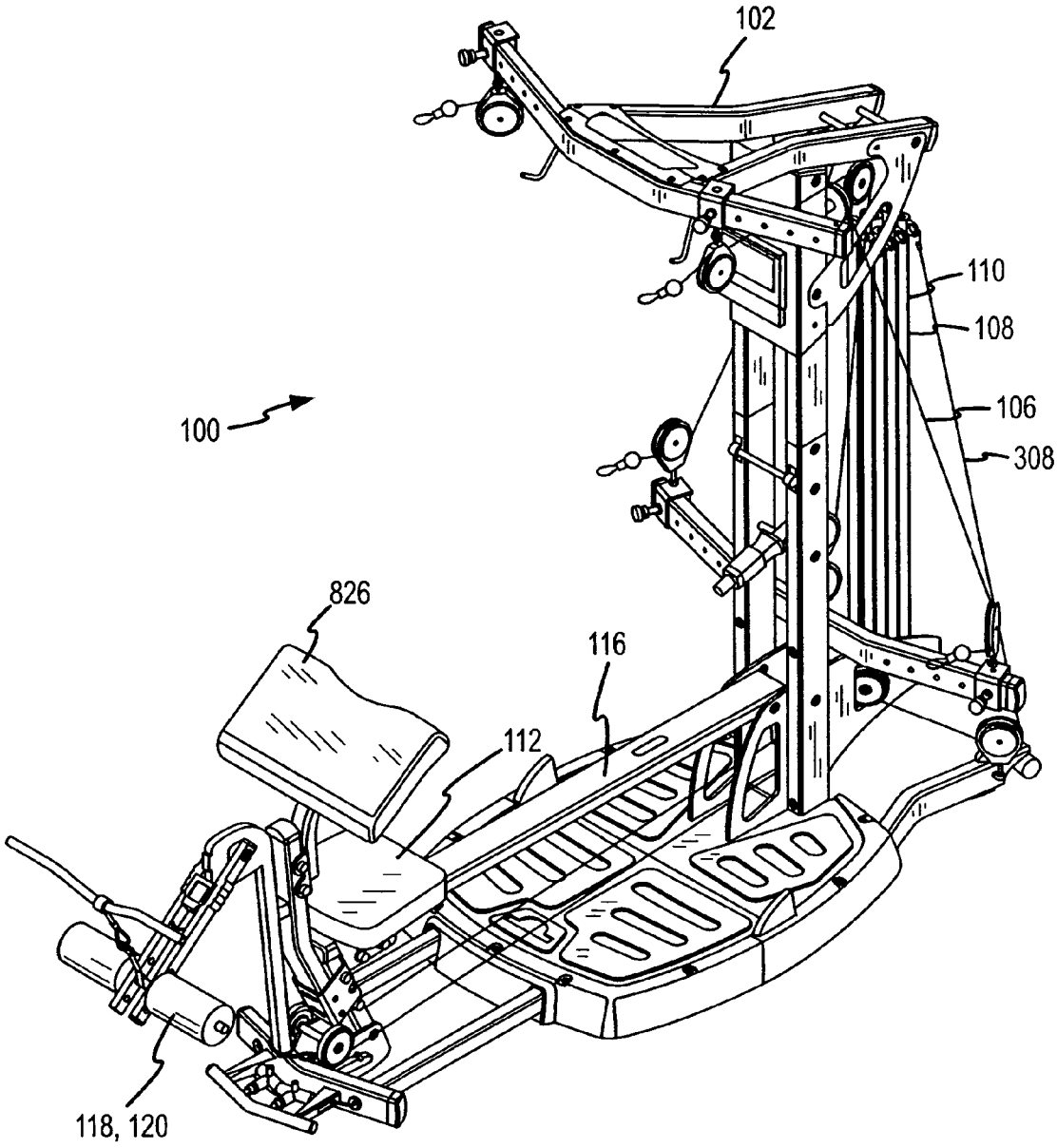
FIG. 7 is a view of the exercise device with a multi-purpose exercise accessory configured to perform arm curl exercises.
Figure 8:
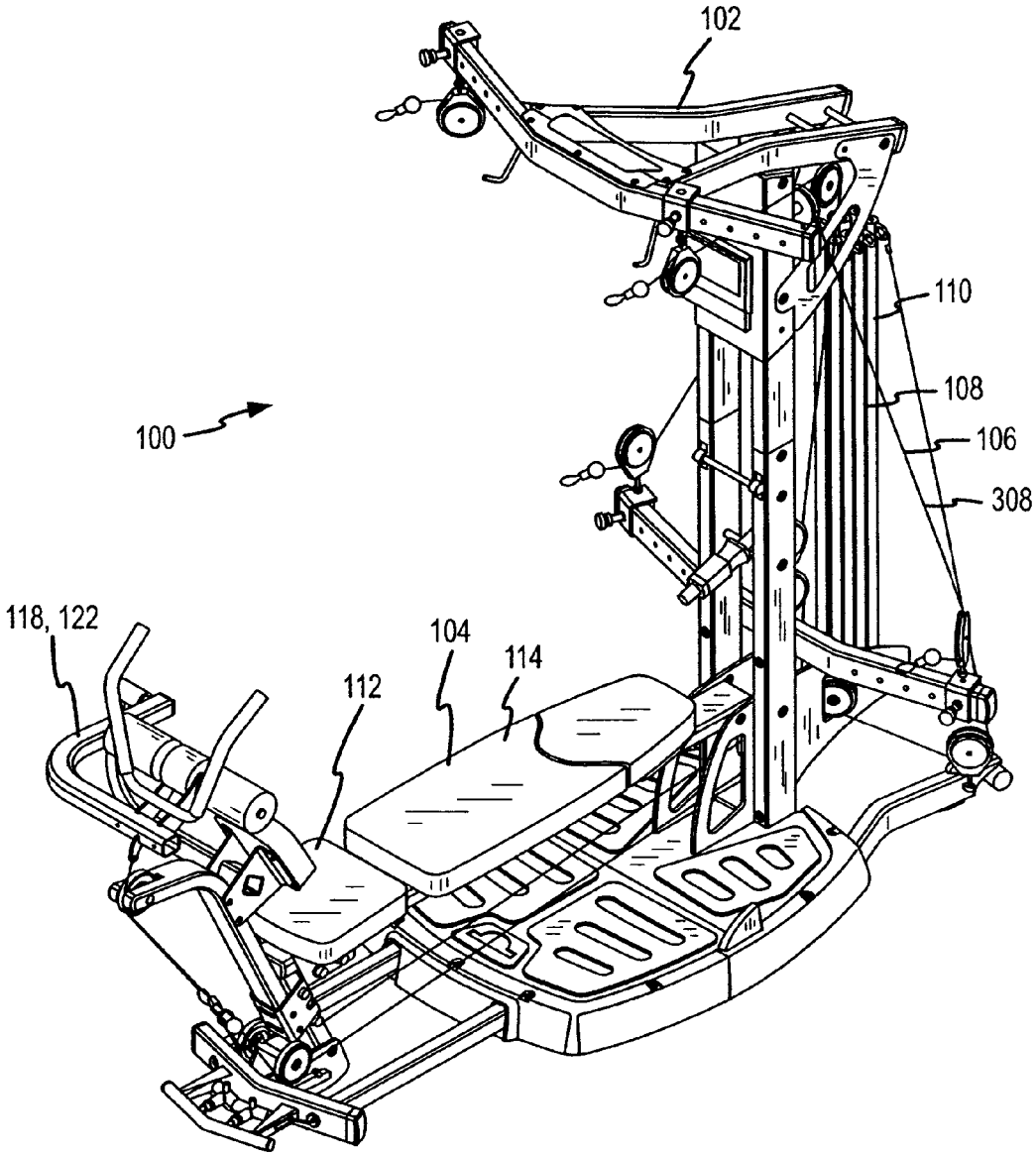
FIG. 8 is a view of the exercise device with an abdominal exercise accessory configured to perform abdominal exercises.

FIGS. 1-8 illustrate the exercise device 100 in various orientations and configurations to perform various exercises. In particular, FIG. 2 shows the back support 114 in a position that is inclined with respect to the seat rail 116, whereas FIG. 1 shows the back support 114 adjacent the seat rail wherein the back support and bench seat collectively define a relatively flat bench. FIGS. 4-8 show various exercise accessories or assemblies 118 releasably connected with the bench assembly 104 and frame 102 that allow a user to perform different exercises. In particular, FIGS. 5-7 show the exercise device with a multi-purpose exercise accessory 120 connected with the bench assembly 104. As shown in FIG. 5, the multi-purpose exercise assembly 120 is configured for leg extension exercises. FIG. 6 shows the exercise device with the multi-purpose exercise accessory 120 configured for leg curl exercises, and FIG. 7 shows the exercise device with the multi-purpose exercise accessory 120 configured for arm curl exercises. As shown in FIG. 8, the exercise device 100 is configured for abdominal exercises with an abdominal exercise accessory 122 connected thereto. In FIG. 4, the exercise device is configured for squat exercises with the seat rail 116 in an upright position and a squat exercise accessory 124 connected with the bench seat 112. FIG. 3 shows the exercise device 100 in a storage configuration wherein the exercise device can be rolled along a support surface from location to another. Detailed descriptions related to component structures of the exercise device that provide the various reconfiguration capabilities are provided below.

As previously mentioned, the frame 102 of the exercise device 100 supports the bench assembly 104, the resistance system 108, and the cable-pulley system 106. As shown in FIGS. 1-3, the frame 102 includes an upright portion 126 supported by a base portion 128. As discussed in more detail below, the base portion 128 of the frame 102 is configured to fold when placing the exercise device in the storage configuration. As shown in FIGS. 1-4, the base portion 128 includes a forward base structure 130 pivotally connected with a rearward base structure 132. When the exercise device 100 is in the operating configuration, the forward base structure 130 is orientated in substantially the same plane as the rearward base structure 132, as shown in FIGS. 1-2 and others. As such, the base portion 128 of the frame 102 is supported on the support surface by the forward and rearward base structures. To place the exercise device in the storage configuration, the forward base structure 130 is pivoted upward with respect to the rearward base structure 132 toward the upright portion 126 of the frame 102, as shown in FIG. 3. The seat rail 116 is pivoted upward and locked in an upright position before pivoting the forward base structure upward to the storage configuration. As discussed in more detail below, pivoting the forward base structure 130 upward also acts to bring four wheels 134 connected with the base portion 128 of the frame 102 into engagement with the support surface. As discussed in more detail below with reference to FIG. 9 and others, two of the four wheels 134 are connected with the rearward base structure 132, and two wheels are connected with the forward base structure 130. In the storage configuration, the exercise device is supported on the support surface by the four wheels, which allows a user to roll the exercise device along the support surface to a desired location. As discussed in more detail below, the forward base structure can be locked in either the downward or upward pivotal position relative to the rearward base structure when the exercise device is in the operating and storage configurations, respectively.

Figure 9:
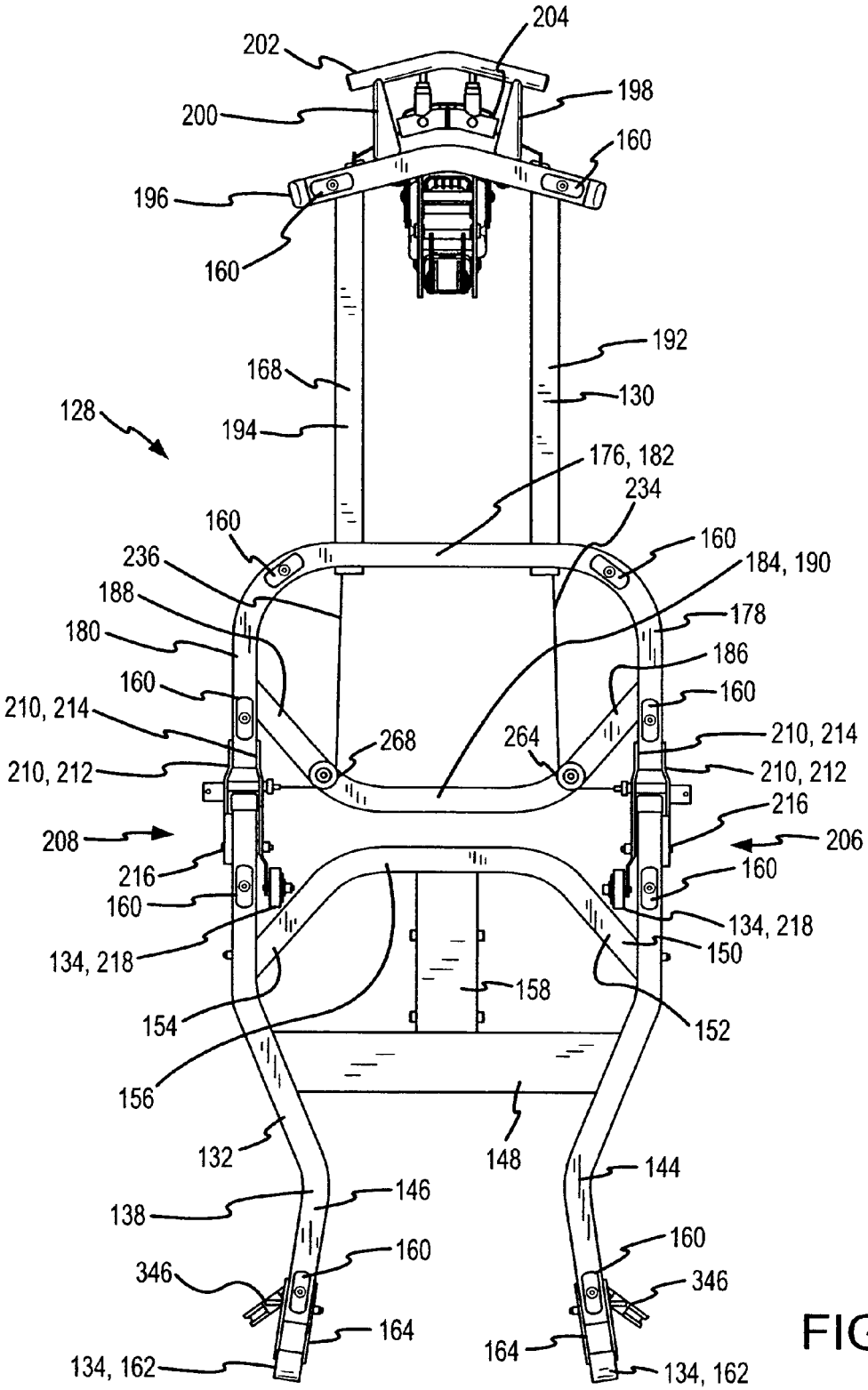
FIG. 9 is a bottom view of the exercise device showing a base portion of a frame.

As previously mentioned, the rearward base structure 132 provides support for the upright portion 126 of the frame 102 and is also pivotally connected with the forward base structure 130. Referring to FIGS. 4 and 9, the rearward base structure 132 includes a rear platform plate 136 supported on a rear base frame 138. A portion of the rear base frame adjacent the rearward platform plate is covered by right and left side shields 140, 142. As shown in FIG. 9, the rear base frame 138 includes right and left rearward base members 144, 146 connected with and separated by a first rear cross member 148 and a second rear cross member 150. The second rear cross member 150 is spaced forwardly from the first rear cross member 148 and is defined by right and left leg portions 152, 154 separated by and extending rearward from a cross portion 156. A rear center member 158 extends rearwardly from the cross portion 156 of the second rear cross member 150 and connects with the first rear cross member 148. Support pads 160 are connected with bottom sides of opposing end portions of the right and left rearward base members 144, 146. In addition, caster wheels 162 are connected with and are supported by caster brackets 164 extending from rear end portions of the right and left rearward base members 144, 146. When the exercise device 100 is in the operative configuration, the rearward base structure 132 of the frame 102 is supported by the support pads 160 engaging the support surface. At the same time, the caster wheels 162 are positioned adjacent to and slightly above the support surface. As discussed in more detail below, the caster wheels are brought into engagement with the support surface when the exercise device is placed in the storage configuration. Although the embodiment of the exercise device disclosed herein utilizes caster wheels connected with the rearward base structure, it is to be appreciated that rollers, skid plates, or other components may be used in conjunction with or in place of the caster wheels.

As previously mentioned, the forward base structure 130 is pivotally connected with the rearward base structure 132. As shown in FIG. 4, the forward base structure includes a forward platform plate 166 supported on a forward base frame 168. A portion of the forward base frame adjacent the forward platform plate is covered a right side shield 170, a left side shield 172, and a front side shield 174. As shown in FIG. 9, the forward base frame 168 includes a U-shaped forward base member 176 defined by right and left leg portions 178, 180 separated by and extending rearward from a cross portion 182. As shown in FIG. 9, support pads 160 are connected with bottom sides of rear end portions of the right and left leg portions 178, 180 of the U-shaped forward base member 176. In addition, support pads 160 are connected with bottom sides of opposing ends of the cross portion 182 of the U-shaped forward base member 176. A forward cross member 184 is connected with and extends between the right and left leg portions 178, 180 of the U-shaped forward base member 176. The forward cross member 184 is a generally elongate member with right and left end portions 186, 188 angled forwardly from opposing ends of a mid portion 190. As shown in FIGS. 4 and 9, right and left forward base members 192, 194 are connected with opposing end portions of a foot member 196 and extend rearwardly therefrom to connect with the cross portion 182 of the U-shaped forward base member 176. Support pads 160 are connected with the bottom side of opposing end portions of the foot member 196. As shown in FIGS. 4 and 9, right and left handle brackets 198, 200 extend forward from the foot member 196 to connect with opposing end portions of a front base handle 202. As described in more detail below, the front base handle 202 provides support for a base handle grip 204 used to selectively lock the forward base structure 130 in either the downward or upward pivotal position. The front base handle 202 also provides a gripping location for a user when pivoting the forward base structure either upward or downward.

Figure 10:
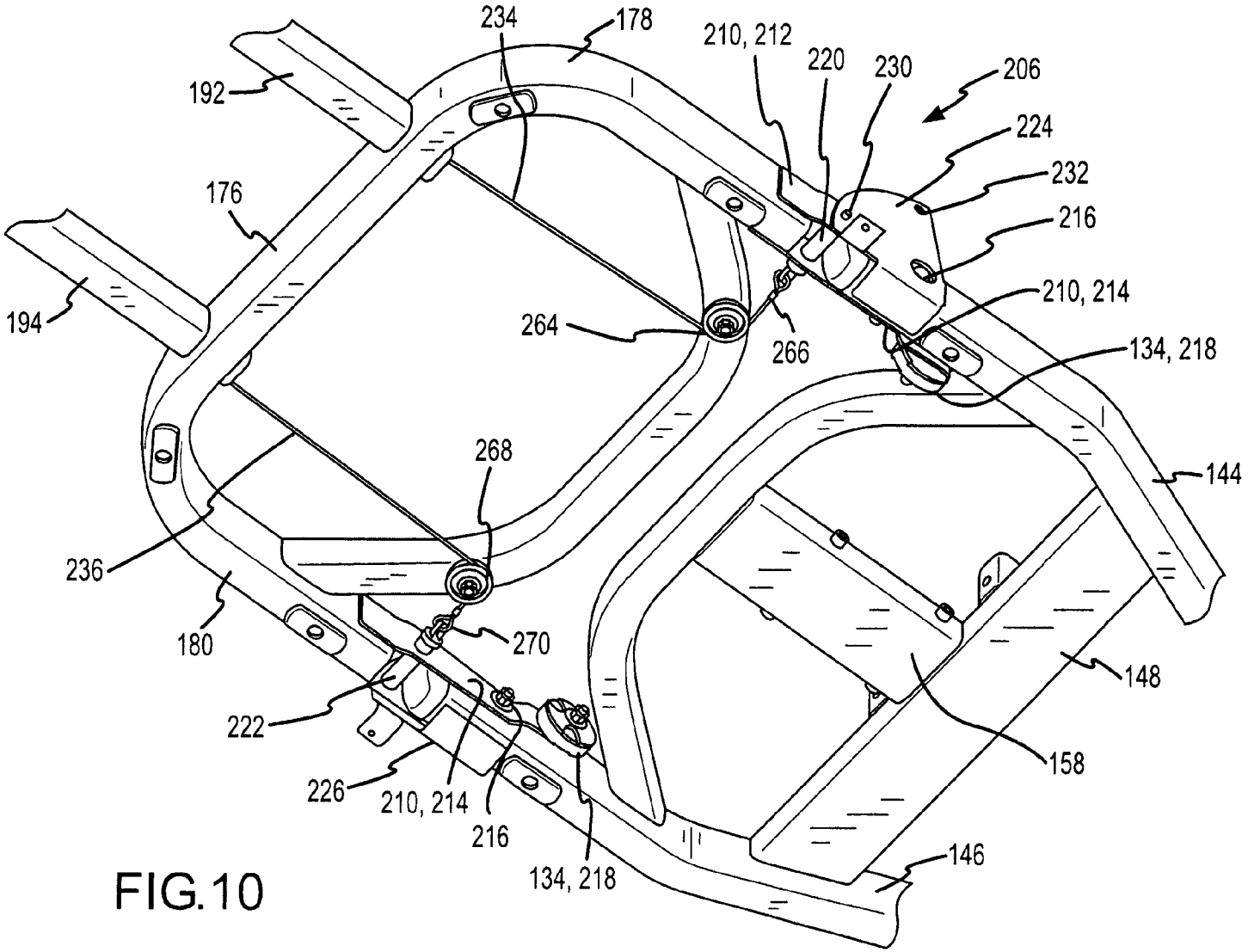
FIG. 10 is a view of the base portion of the frame showing right and left pivotal connections between a forward base structure and a rear base structure.
Figure 11:
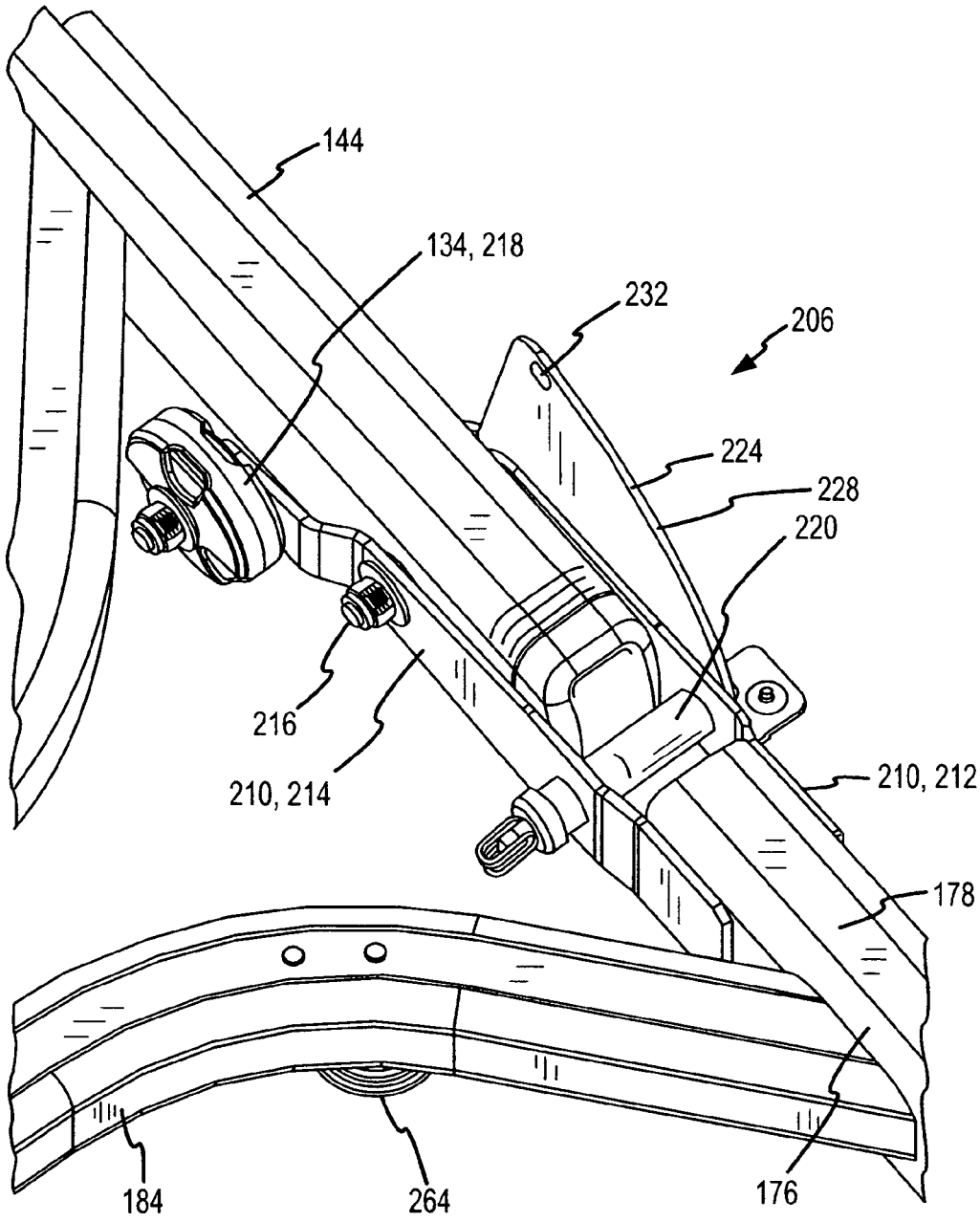
FIG. 11 is a detailed view of the right pivotal connection between the forward base structure and the rear base structure.

As previously mentioned, the forward base structure 130 can pivot relative to the rearward base structure 132 when placing the exercise device 100 in the storage and operating configures. As shown in detail in FIGS. 9-11, the forward base structure 130 is pivotally connected with the rearward base structure 132 through right and left pivotal connections 206, 208, each including hinge brackets 210 connected with the forward base structure 130. More particularly, outer and inner hinge brackets 212, 214 are connected with opposing sides of the right leg portion 178 of the U-shaped forward base member 176. From the right leg portion 178, the outer and inner hinge brackets extend rearwardly along opposing sides of the right rearward base member 144. The pivotal connection 208 between the left sides of the forward base structure 130 and the rearward base structure 132 is substantially a mirror image of the pivotal connection 206 between the right sides of the forward base structure and the rearward base structure. As such, outer and inner hinge brackets 212, 214 are connected with opposing sides of the left leg portion 180 of the U-shaped forward base member 176. From the left leg portion 180, the outer and inner hinge brackets extend rearwardly along opposing sides of the left rearward base member 146. As shown in FIGS. 9-11, hinge bolts 216 extend through the hinge brackets 212, 214 and the right and left rearward base members 144, 146. As such, the hinge brackets can pivot around an axis of rotation defined by the hinge bolts 216 when placing the exercise device in the storage and operating configurations. For example, the hinge brackets rotate clockwise (as viewed from the right side of the exercise device) around the axis of rotation defined by the hinge bolts when pivoting the forward base portion upward to place the exercise device in the storage configuration. Conversely, the hinge brackets rotate counterclockwise (as viewed from the right side of the exercise device) around the axis of rotation defined by the hinge bolts when pivoting the forward base portion downward to place the exercise device in the operating configuration.

As previously mentioned, the four wheels 134 connected with base portion 128 of the frame 102 are moved into engagement with the support surface when pivoting the forward base structure 130 sufficiently upward. As described in more detail below with reference to FIGS. 3 and 9-11, pivoting the forward base structure upward a sufficient distance moves two forward wheels 218 connected with the forward base structure 130 into engagement with the support surface. Continued upward pivotal movement of the forward base structure tilts the rearward base structure 132 to move the caster wheels 162 into engagement with the support surface. As such, when in the storage configuration, the exercise device 100 is supported by the two caster wheels 162 connected the rearward base structure 132 and two forward wheels 218 connected with the forward base structure 130, as shown in FIG. 3. When the exercise device 100 is in the operating configuration, the forward and rearward base structures 130, 132 of the frame 102 are supported by the previously described support pads 160 engaging the support surface. In addition, the two forward wheels 218 and the two caster wheels 162 are positioned adjacent to and slightly above the support surface. Although the exercise device depicted and discussed herein utilizes four wheels, it is to be appreciated that other embodiments of the exercise device include more or less than four wheels.

As shown in FIGS. 9-11, the two forward wheels 218 are rotatably connected with rear end portions of the inner hinge brackets 214. More particularly, the forward wheels 218 are located rearward of the axis of rotation defined by the hinge bolts 216. As such, when the inner hinge brackets 214 rotate clockwise (as viewed from the right side of the exercise device) around the hinge bolts 216, such as when pivoting the forward base structure 130 upward, the forward wheels 218 swing downward and are brought into engagement with the support surface. As the inner hinge brackets 214 continue to rotate clockwise, the forward wheels 218 move in a forward direction under the axis of rotation defined by the hinge bolts 216, while at the same time causing the forward end portions of the right and left rearward base members 144, 146 to be lifted upward. As the forward end portions of the rearward base members 144, 146 move upward a sufficient distance, the right and left rearward base members pivot about rear end portions until the caster wheels 162 are placed in engagement with the support surface. As such, the exercise device is supported by the two forward wheels and the two caster wheels, as shown in FIG. 3. Therefore, unlike an exercise device having two wheels connected with the frame that require the frame to be tipped onto the wheels in order to roll the device from location to another, the present exercise device can be moved while in the storage configuration while supported by more than two wheels without the need to tip the frame.

As previously mentioned, the base handle grip 204 supported by front base handle 202 can be used to locked in the operating and/or storage configurations. As discussed in more detail below, the base handle grip is operably coupled with base pop-pins 220, 222 used to selectively lock the forward base structure in either the downward (operational) or upward (storage) pivotal position. As shown in FIGS. 9-11, the right and left base pop-pins 220, 222 are connected with and supported by the inner and outer hinge plates 212, 214 connected with the right and left leg portions 178, 180 of the forward base member 176, respectively. The base pop-pins 220, 222 each include a body housing a spring operably connected with a pin, as is known in the art. The springs in each base pop-pin 220, 222 act to forced the pins against respective right and left locking plates 224, 226, which are connected with the forward end portions of the right and left rearward base members 144, 146, respectively. Each of the locking plates 224, 226 includes a curved forward edge 228 extending upward and rearward from forward end portions of the rearward base members 144, 146. The base pop-pins 220, 222 are adapted to engage first apertures 230 and second apertures 232 in each locking plate. More particularly, when the pins from the base pop-pins 220, 222 are received within the first apertures 230 of the locking plates 224, 226, the forward base structure 130 is locked in the downward position. As such, the exercise device 100 is locked in the operating configuration, as shown in FIGS. 4, 9-11, and others. When pins of the base pop-pins 220, 222 are received within the second apertures 232 of the locking plates 224, 226, the forward base structure 130 is locked in the upward position. As such, the exercise device is locked in the storage configuration, shown in FIG. 3.

As previously mentioned, the base handle grip 204 shown in FIGS. 4 and 9 is used to actuate the base pop-pins 220, 222. As discussed in more detail below with reference to FIGS. 4, 9-12, and others, the base pop-pins 220, 222 are disengaged from respective locking plates 224, 226 by moving the base handle grip 204 toward the front base handle 202. The base handle grip 204 is connected with the base pop-pins 220, 222 through pop-pin cables 234, 236. The base handle grip 204 is also configured to slide back and forth along right and left guide pins 238, 240 extending from the front base handle 202. As such, sliding the base handle grip along the guide pins 238, 240 toward the front base handle 202 applies tension to the pop-pin cables 234, 236 which in turn, pulls the pins in each base pop-pin 220, 222 away from the locking plates 224, 226, disengaging the base pop-pins from the locking plates. Because the base pop-pins 220, 222 are spring-loaded, the springs in the base pop-pins force the pins back toward the locking plates 224, 226 when the base handle grip is released, automatically reengaging the base pop-pins with the locking plates. Because the base pop-pins 220, 222 are connected with the base handle grip 204 through the pop-pin cables 234, 236, the base handle 204 grip is pulled by the pop-pin cables away from the front base handle 202 as the base pop-pins reengage the locking plates.

Figure 12:
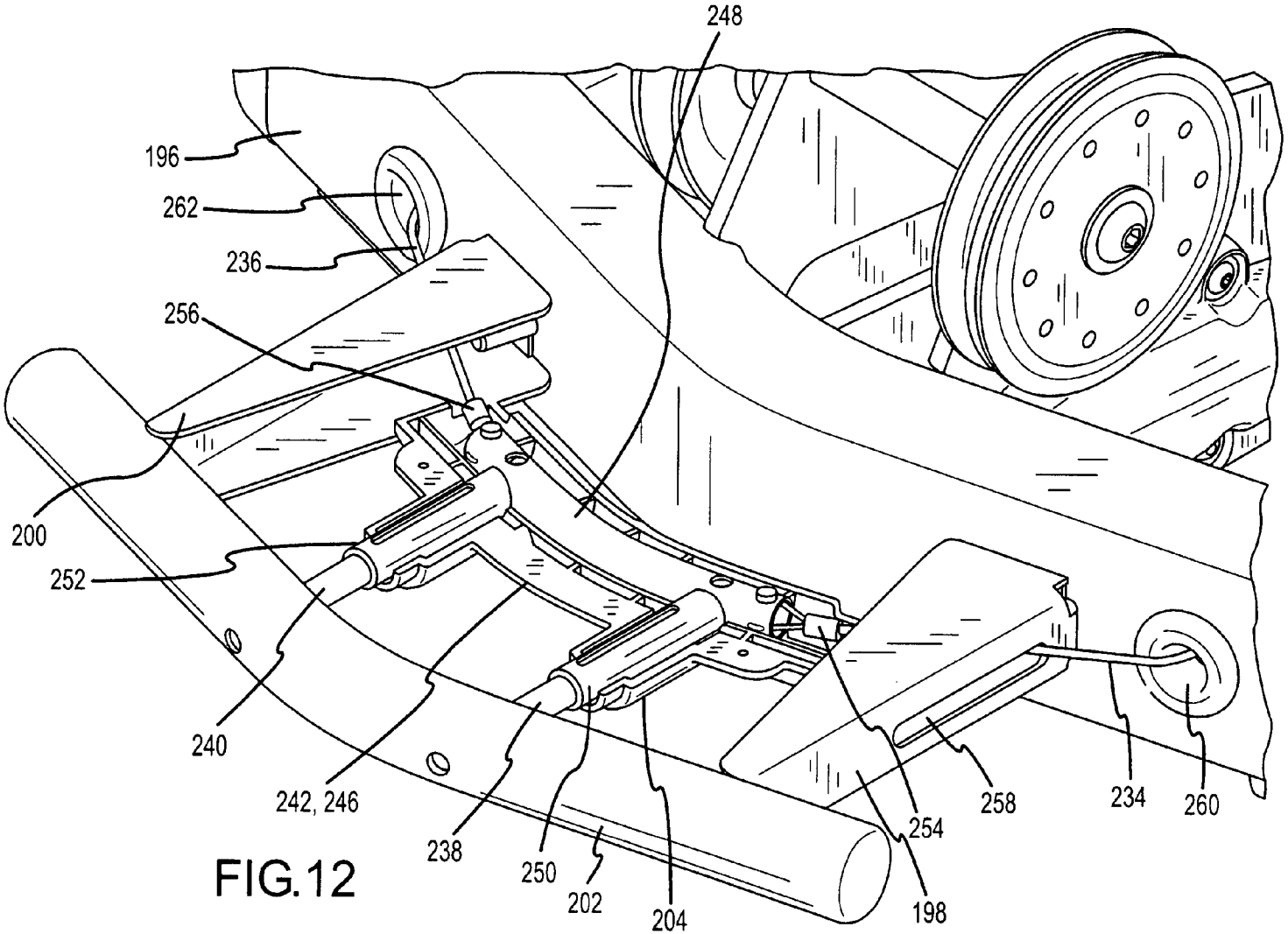
FIG. 12 is a detailed view of a base handle grip with an upper housing removed.

FIG. 12 shows the details of the base handle grip 204 as well as the sliding connection between the base handle grip and the front base handle 202. The base handle grip 204 includes a housing assembly 242 having upper and lower housings 244, 246. The upper housing 244 is not shown in FIG. 12, but is substantially a mirror image of the lower housing 246. The upper housing 244 is shown in FIGS. 4 and others. Referring back to FIG. 12, the housing assembly 242 partially enclose a cross tube member 248 and right and left slider tube members 250, 252. The right and left slider tube members 250, 252 are connected with and extend forward from the cross tube member 248. The right and left slider tube members are also hollow and are adapted to slidingly receive the right and left guide pins 238, 240, respectively. As such, the base handle grip 204 is supported by and is adapted to slide back and forth along guide pins. As shown in FIG. 12, first end portions 254, 256 of the right and left pop-pin cables 234, 236 are connected with opposing end portions of the cross tube 248 of the base handle grip. From the first end portions 254, 256, the right and left pop-pin cables 234, 236 extend through slots 258 in the right and left handle brackets 198, 200 and through right and left apertures 260, 262 in the opposing end portions of the foot member 196. From the foot member 196, the right and left pop-pin cables 234, 236 extend rearward through the insides of the right and left forward base members 192, 194, respectively. As shown in FIGS. 9 and 10, the right pop-pin cable 234 exits the right forward base member 192 and extends rearwardly to a right pop-pin cable pulley 264. From the right pop-pin cable pulley 264, the right pop-pin cable 234 extends to a second end portion 266 connected with the right base pop-pin 220. Similarly, the left pop-pin cable 236 exits the left forward base member 194 and extends rearward to a left pop-pin cable pulley 268. From the left pop-pin cable pulley 268, the left pop-pin cable extends to a second end portion 270 connected with the left base pop-pin 222.

A description of the operation of the components associated with the placing the exercise device 100 in the operating and storage configurations is provided below with reference to FIGS. 3, 4, and 9-12. Descriptions of rotational directions (i.e. clockwise and counterclockwise) are from a point of reference as viewed from the right side of the exercise device 100.

As shown in FIGS. 4, 9-11, and others, the exercise device 100 is in the operating configuration with the forward base structure 130 in the downward position. In this configuration, the right base pop-pin 220 is engaged with the first aperture 230 on the right locking plate 224, and the left base pop-pin 222 is engaged with the first aperture 230 on the left locking plate 226. As such, the base pop-pins lock the forward base structure in the downward position. In addition, the caster wheels 162 and the forward wheels 218 are positioned adjacent to and slightly above the support surface. Therefore, the exercise device 100 is supported on the support surface by the previously described support pads 160.

To place the exercise device 100 in the storage position, as shown in FIG. 3, the seat rail 116 is first pivoted upward and locked in the upright position. As discussed in more detail below, the seat rail 116 is locked in the upright position by pivoting the seat rail upward toward the upright portion 126 of the frame 102 and into engagement with a rail locking mechanism 272. As discussed in more detail below, the rail locking mechanism 272 selectively holds the seat rail in the upright position. Next, a user moves the base handle grip 204 toward the front base handle 202. As the base handle grip slides along the guide pins 238, 240 extending from the front base handle, the base handle grip 204 pulls on the pop-pin cables 234, 236. When sufficient movement and tension is applied to the pop-pin cables, the pop-pin cables 234, 236 pull the respective base pop-pins 220, 222 from the first apertures 230 in the locking plates 224, 226. At this point, the forward base structure 130 is free to pivot relative to the rear base structure 132 about the hinge bolts 216. As such, the front base structure can be lifted upward and pivoted clockwise (as viewed from the right side of the exercise device) about the hinge bolts. Once the forward base structure 130 is pivoted upward a sufficient distance to move the base pop-pins 220, 222 out of alignment with the first apertures 230 in the locking plates 224, 226, the base handle grip 204 can be released. The springs inside the base pop-pins 220, 222 will cause the base pop-pins to engage and slide along the inner surface of the locking plates as the forward base structure continues to pivot upward. As the front base structure continues to pivot clockwise, the hinge brackets 212, 214 also rotate clockwise around the hinge bolts 216, swinging the forward wheels 218 downward and into engagement with the support surface. As the forward base structure further pivots clockwise, the forward wheels 218 lift the forward end portions of the rearward base members 144, 146 upward, bringing the caster wheels 162 into engagement with the support surface. At this point, the exercise device is supported by the two forward wheels 218 and the two caster wheels 162. Once the base pop-pins 220, 222 are aligned with the second apertures 232 in the locking plates 224, 226, the springs inside base pop-pins will cause the base pop-pins to engage the second apertures and lock the forward base structure 130 in the upright position with the exercise device supported by the four wheels. Although the exercise device can be placed in a storage configuration wherein the exercise device is supported by wheels, it is to be appreciated that other embodiments of the exercise device configured without wheels can also be placed in the space-saving storage configuration described above.

To return the exercise device 100 to the operating configuration, the user moves the base handle grip 204 toward to the front base handle 202, which disengages the base pop-pins 220, 222 from the second apertures 232 in the locking plates 224, 226. At this point, the forward base structure 130 can be lowered, or pivoted counterclockwise (as viewed from this right side of the exercise device) about the hinge bolts 216 until the base pop-pins are brought into alignment with and reengage the first apertures 230 on the locking plates 224, 226.

Figure 13:
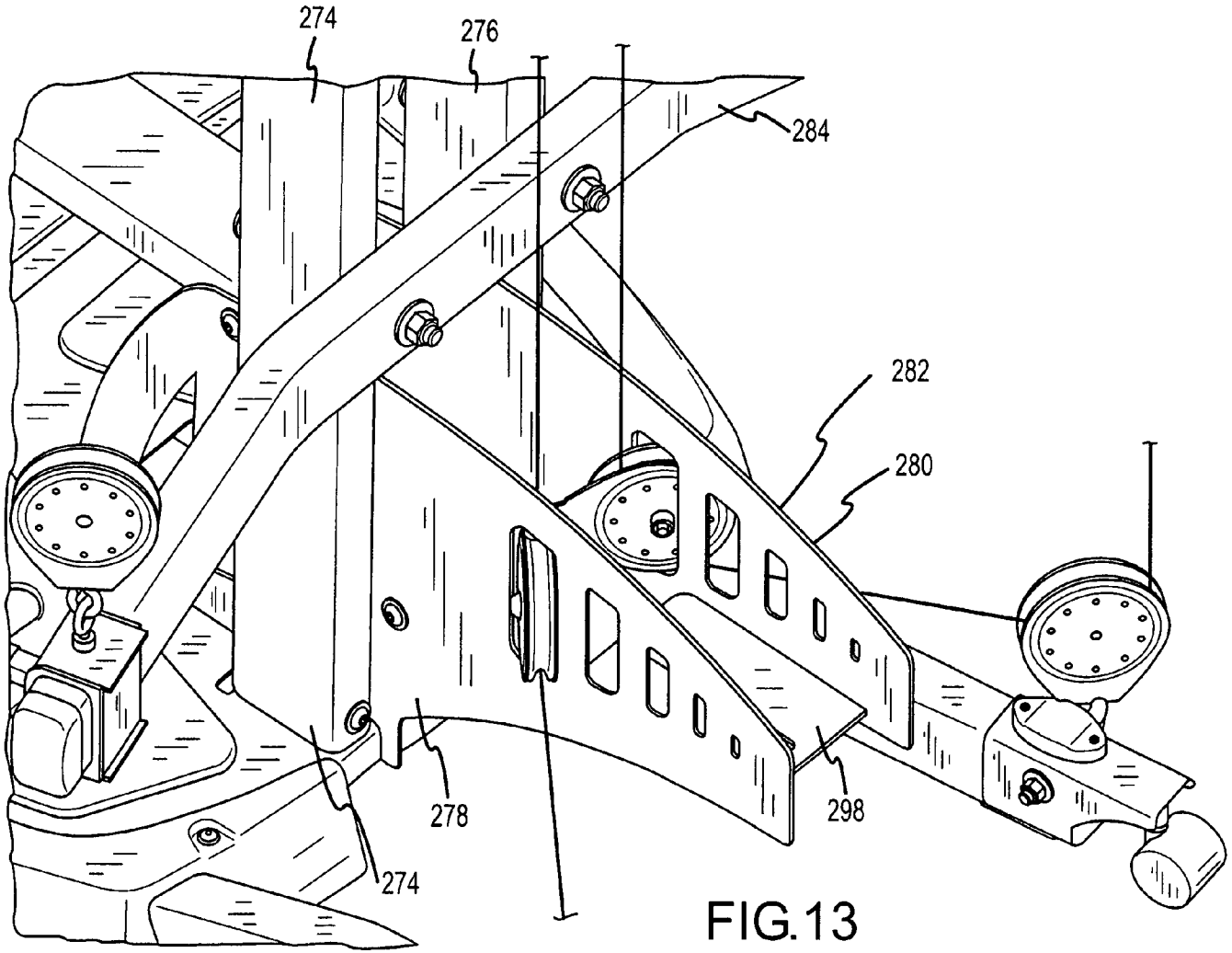
FIG. 13 is a detailed view of a rod housing on an upright portion of the frame.
Figure 14:
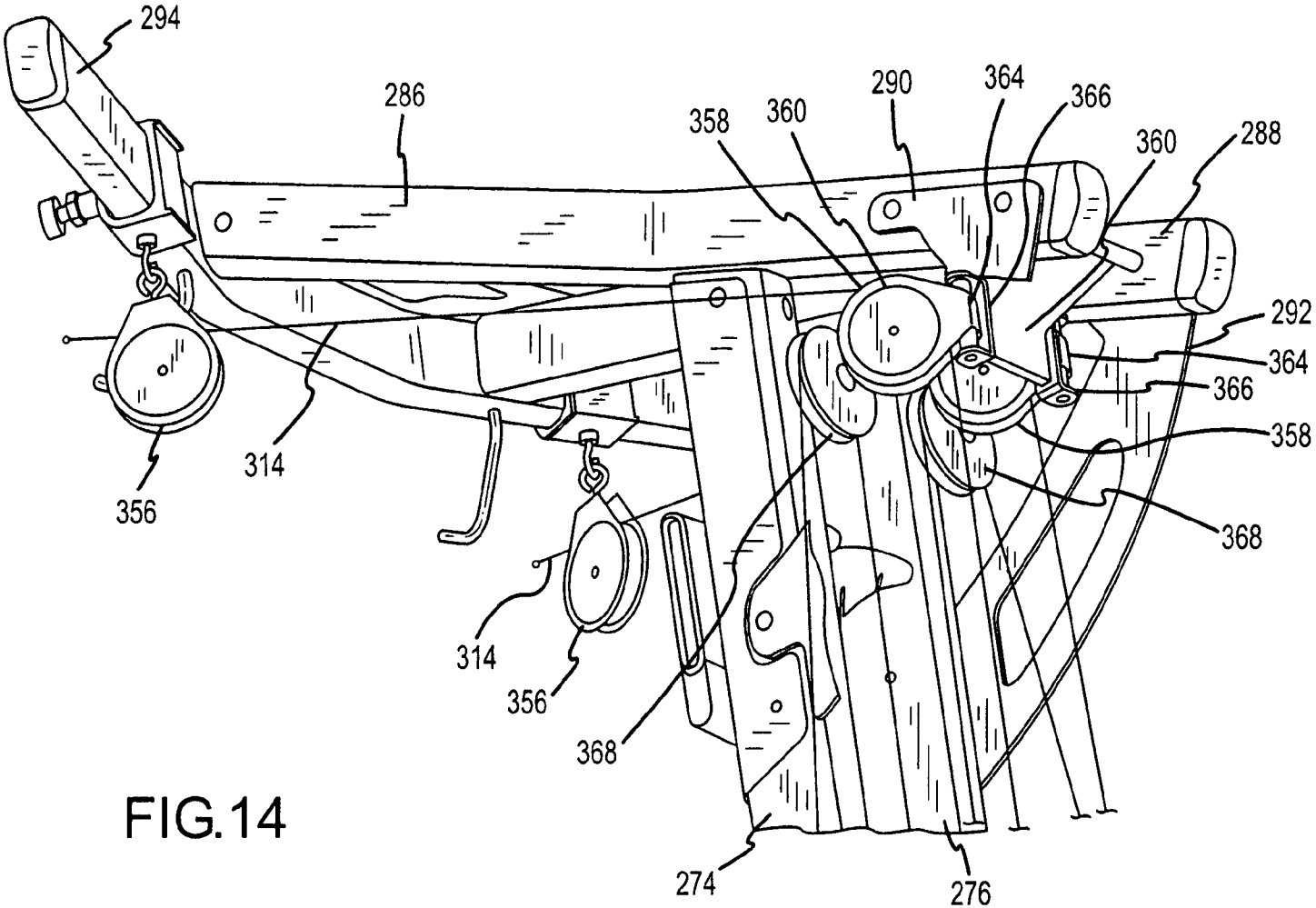
FIG. 14 is a detailed view of the upright portion of the frame showing first and second upper directional pulleys.

As previously mentioned, the upright portion 126 of the frame 102 is supported by the base portion 128. Collectively, the upright portion 126 and the base portion 128 of the frame support the bench assembly 104, the resistance system 108, and the cable-pulley system 106. As shown in FIGS. 1, 13, 14, and others, the upright portion 126 of the frame 102 includes right and left upright members 274, 276 connected with and extending upward from the first rear cross member 148 of the rear base frame 138. Right and left side plates 278, 280 connected with opposing sides of the rear center member 158 of the rear base frame 138 extend upward and rearward adjacent to the inside surfaces of the right and left upright members 274, 276, respectively. As discussed in more detail below, the right and left side plates 278, 280 extend rearward of the right and left upright members to define a portion of a rod housing 282 that supports the resistance system 108. A lower cross member 284 is connected with the rear sides of the upright members above the right and left side plates 278, 280. As discussed in more detail below, the lower cross member adjustably supports two pulleys that define part of the cable-pulley system.

As shown in FIGS. 1 and 14, right and left cross support members 286, 288 are connected with the upper end portions of the right and left upright members 274, 276, respectively. More particularly, the upper end portions of the upright members 274, 276 intersect with mid-portions of the cross support members 286, 288. The cross support members 286, 288 are angularly oriented with respect to the support surface. As such, the cross support members extend rearward and downward as well as forward and upward from the upper end portions of the upright members. Right and left tension members 290, 292 connected with rear end portions of the cross support members extend forward and downward to connect with the right and left upright members 274, 276, respectively. The right tension member 290 is shown as partially cut-away in FIG. 14 to better illustrate other components discussed below. An upper cross member 294 is connected with the forward ends of the right and left cross support members 286, 288. As discussed in more detail below, the upper cross member 294 adjustably supports two pulleys that define part of the cable-pulley system. A cross plate 296 connected with the upper surfaces of the right and left cross support members 286, 288 and upper cross member 294 provide additional strength to the connections.

Figure 15:
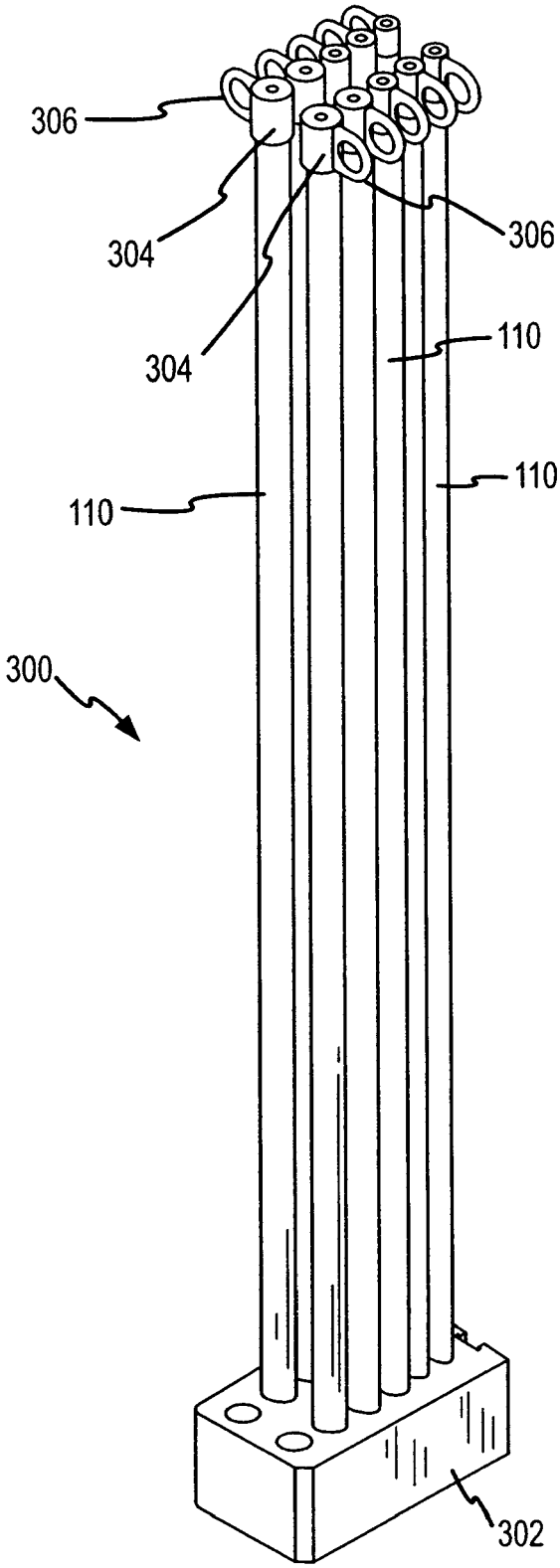
FIG. 15 is a detailed view of a rod box assembly.

As previously mentioned, the rod housing 282 supports the resistance system 108. As shown in FIGS. 1, 13, and others, the rod housing 282 includes a base plate 298 connected with and separating rear end portions of the right and left side plates 278, 280. The resistance system 108 includes a rod box assembly 300, such as the one shown in FIG. 15, which includes the plurality of resistance rods 110. The rod box assembly 300 is adapted to be connected with and supported on the base plate 298 of the rod housing 282. The resistance rods shown in FIG. 15 can be configured similar to the resistance rods disclosed in U.S. Pat. No. 4,620,704, titled "Universal Exercising Machine," filed on Apr. 27, 1984, and U.S. Pat. No. 4,725,057, titled "Universal Exercising Machine," filed on Nov. 3, 1986, both of which are hereby incorporated by reference herein. The rod box assembly 300 shown in FIG. 15 includes 10 resistance rods 110 (2 rows of 5 rods) connected with and extending upward from a base portion 302. Although the rod box assembly 300 shown herein includes 10 resistance rods, it is to be appreciated that embodiments of the exercise device can utilize different numbers of resistance rods. The resistance rods can also have varying diameters and lengths. It is also to be appreciated that the rod box assembly can be configured to connect with additional rod box assemblies to provide additional resistance capabilities. Still referring to FIG. 15, an end cap 304 with a ringed member 306 is connected with the upper end portions of each resistance rod 110. As discussed in more detail below, a user can set a desired resistance by connecting a selected number of resistance rods 110 with a resistance cable. Sufficient force applied to the resistance cable will cause the selected resistance rods connected thereto to bend, which imparts resistance against the cable force. Because the rods are resilient, when the force is lessened or removed from the resistance cable, the connected resistance rods will tend to be biased to return to a substantially straight orientation, as shown in FIGS. 1, 15, and others.

As previously mentioned, the user actuates the resistance system 108 through the cable-pulley system 106. The cable-pulley system 106 includes right and left cable-pulley systems 308, 310 that operably couple an actuation component with selected resistance rods 110 extending upward from right and left sides of the base portion 302 of the rod box assembly 300. It is to be appreciated that various types and configurations of actuation components, such as handles, straps, bars, hooks, levers, pedals, and others, can be used with the exercise device. It is also to be appreciated that other embodiments of the exercise device can utilize different means for connecting the resistance cables with the resistance system than what is described and depicted below. Although the following description refers mainly to the components of the right cable-pulley system, it is to be appreciated that the left cable-pulley system may substantially be a mirror image of the right cable-pulley system, and as such, may include the same components as the right cable-pulley system, which operate in relation with each other and with the frame as the right cable-pulley system.

Figure 16:
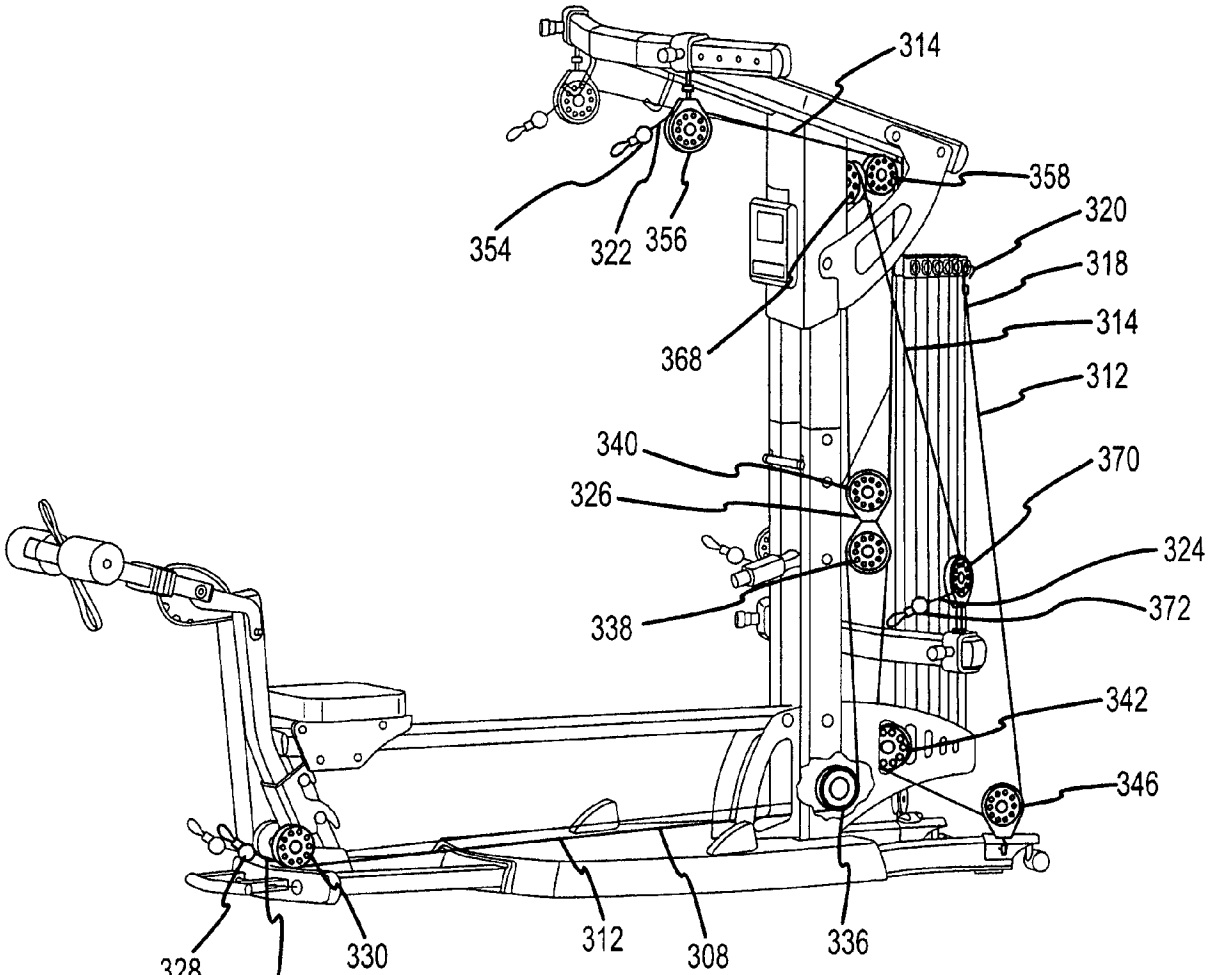
FIG. 16 shows first and second resistance cable routings associated with a right cable-pulley assembly.

FIG. 16 illustrates the cable routing of the right cable-pulley system 308. As shown in FIG. 17, the right cable-pulley system includes a first resistance cable 312 and a second resistance cable 314. The first resistance cable 312 extends from a first end portion 316, through various pulleys, and to a second end portion 318. As discussed in more detail below, a hook 320 connected with the second end portion 318 of the first resistance cable 312 can be selectively connected with a desired number of resistance rods 110. The second resistance cable 314 extends from a first end portion 322 through various pulleys supported on the upright portion 126 of the frame 102 to a second end portion 324. As discussed in more detail below, the first resistance cable 312 is operably coupled with the second resistance cable 314 through a floating pulley assembly 326.

Figure 16A:
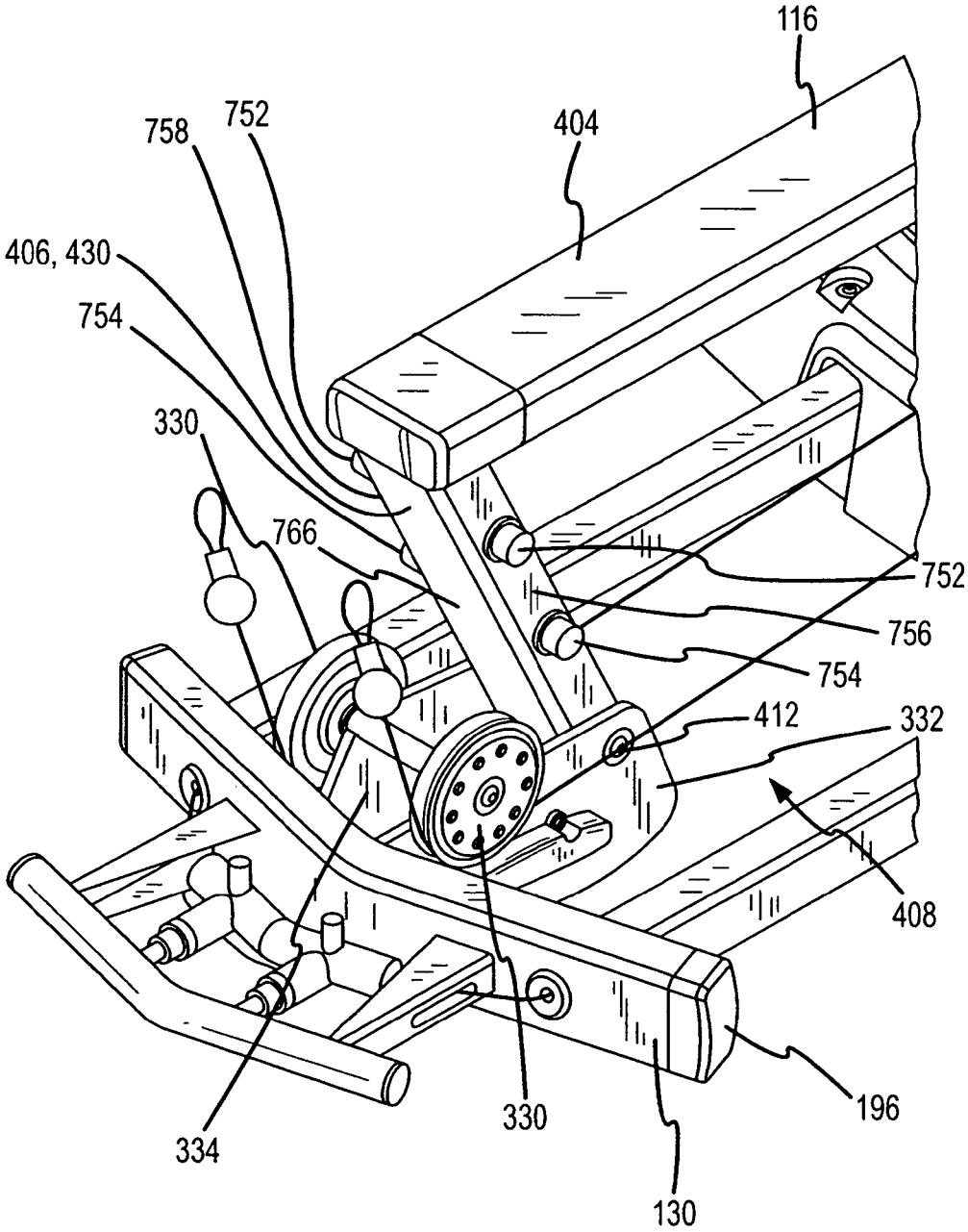
FIG. 16A is a detailed of the exercise device showing right and left forward pulleys.
Figure 16B:
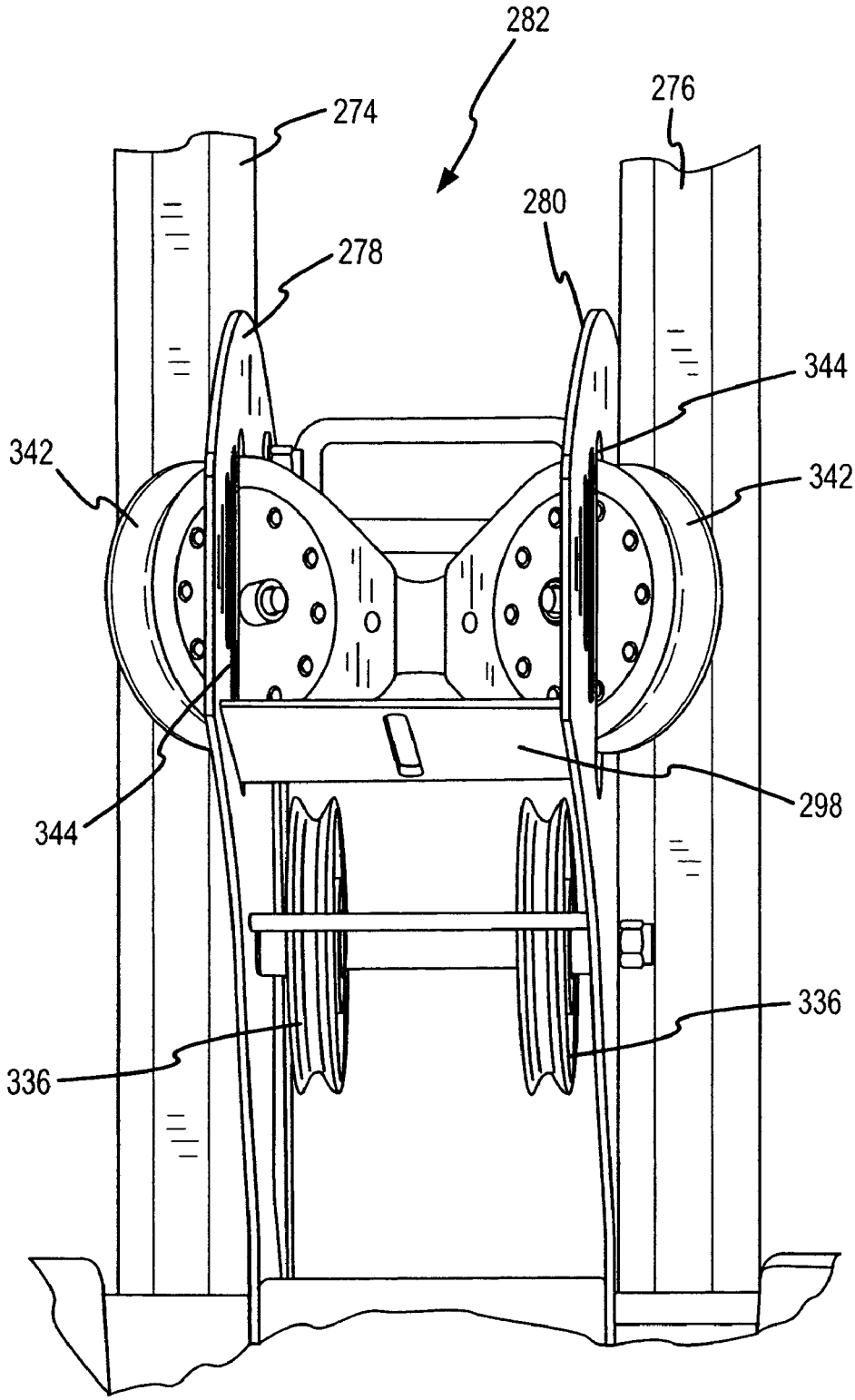
FIG. 16B is a detailed view of a rod housing showing directional pulleys.

As shown in FIG. 16, from the first end portion 316, the first resistance cable 312 extends through a cable stop 328 engaged with a forward pulley 330. As shown in FIG. 16A, right and left pivot brackets 322, 324 connected with the foot member 196 rotatably support two forward pulleys, each associated with respective right and left cable-pulley systems. The cable stop 328 connected with the first end portion 316 of the first resistance cable 312 prevents the cable from withdrawing through the forward pulley 330 in the rearward direction. Referring back to FIG. 16, from the forward pulley 330, the first resistance cable 312 extends rearward along the top of the base portion 128 of the frame 102 to a lower directional pulley 336. As shown in FIG. 16B, two lower directional pulleys 336, each associated with respective right and left cable-pulley systems, are rotatably supported by the rod housing 282 between the right and left side plates 278, 280 and beneath the base plate 298. Referring back to FIG. 16, from the lower directional pulley 336, the first resistance cable 312 extends upward to the floating pulley assembly 326. The exercise device 100 includes two floating pulley assemblies, each associated with respective right and left cable-pulley assemblies. As shown in FIG. 16, the floating pulley assembly 326 includes a bottom pulley 338 connected with a top pulley 340. The first resistance cable 312 partially wraps around the bottom pulley 338, and as discussed below, the second resistance cable 314 partially wraps around the top pulley 340. From the bottom pulley 338 of the floating pulley assembly 326, the first resistance cable 312 extends downward to a first rear directional pulley 342. As shown in FIG. 16B, two rear directional pulleys, each associated with respective right and left cable-pulley systems, are rotatably supported by and extend through slots 344 located in the right and left side plates 278, 280 of the rod housing assembly 282.

Figure 16D:
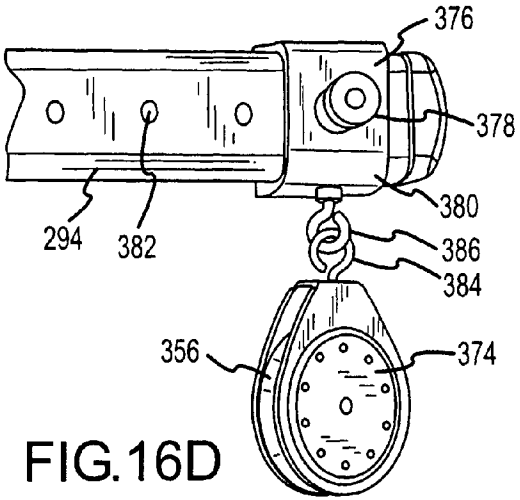
FIG. 16D is a detailed view of a right upper pulley.
Figure 16E:
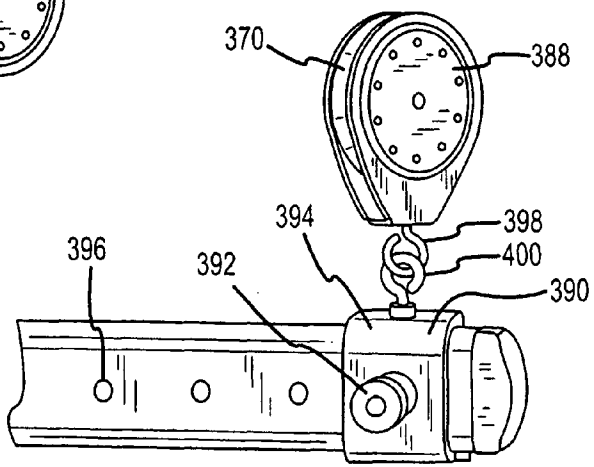
FIG. 16E is a detailed view of a right lower pulley.
Figure 16C:
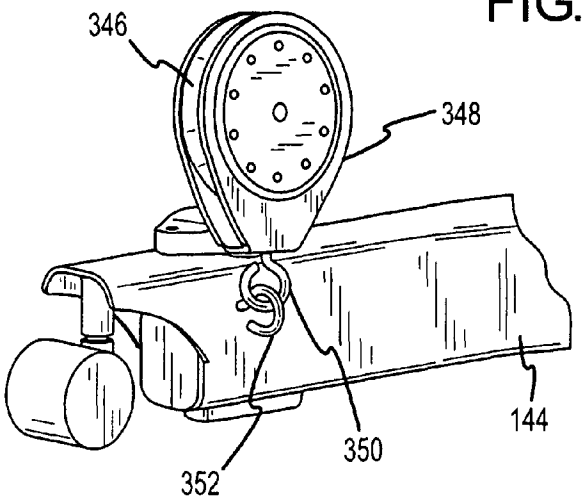
FIG. 16C is a detailed view of a right second rear directional pulley.

Referring back to FIG. 16, from the first rear directional pulley 342, the first resistance cable 312 extends rearward and downward to a second rear directional pulley 346. As shown in FIGS. 9, 16C, and others, two second rear directional pulleys, each associated with respective right and left cable-pulley systems, are connected with the right and left rearward base members 144, 146 of the rear base frame 138. More particularly, the second rear directional pulleys 346 are rotatably supported by housings 348 having eye bolts 350 extending therefrom, which in turn, are connected with hooks 352 extending from the outer sides of the rearward base members 144, 146. As such, the second rear directional pulleys 346 have a degree of mobility in three dimensions. Referring back to FIG. 16, the first resistance cable 312 extends upward from the second rear directional pulley 346 to the hook 320 connected with the second end portion 318 of the first resistance cable. As previously mentioned, the hook 320 is used to connect a desired number of resistance rods 110 with the first resistance cable.

FIG. 16 also illustrates the cable routing of the second resistance cable 314 of the right cable-pulley system 308, which extends through various pulleys supported by the upper portion 126 of the frame 102. As shown in FIG. 16, the second resistance cable 314 extends from the first end portion 322 through a cable stop 354 engaged with an upper pulley 356. The cable stop 354 connected with the first end portion 322 of the second resistance cable 314 prevents the second resistance cable from withdrawing through the upper pulley 356. As shown in FIG. 14, the exercise device 100 includes two upper pulleys, each associated with respective right and left cable-pulley systems, supported by the upper cross member 294. As discussed in more detail below, the upper pulleys can be selectively positioned at various locations along the length of the upper cross member. Referring back to FIG. 16, from the upper pulley 356, the second resistance cable 314 extends rearward to a first upper directional pulley 358. As shown in FIG. 14, the exercise device includes two first upper directional pulleys 358, each associated with respective right and left cable-pulley systems. The first upper directional pulleys are rotatably supported by housings 360 that are pivotally connected with a linking plate 362 supported between the rear end portions of the cross support members 286, 288. More particularly, swivel tubes 364 on the housings 360 of the first upper directional pulleys 358 are pivotally connected with C-brackets 366 on opposing end portions of the linking plate. As such, the housings 360 of the first upper directional pulleys 358 can pivot about an axis defined by the swivel tubes 364.

Referring back to FIG. 16, the second resistance cable 314 extends downward from the first upper directional pulley 358 to the top pulley 340 of the floating pulley assembly 326. From the top pulley 340 of the floating pulley assembly, the second resistance cable extends upward to a second upper directional pulley 368. As shown in FIG. 14, two second upper directional pulleys, each associated with respective right and left cable-pulley assemblies, are rotatably connected with rear sides of the right and left upright members 274, 276. Referring back to FIG. 16, the second resistance cable 314 extends downward from the second upper directional pulley 368 to a lower pulley 370. The second resistance cable 314 extends from the lower pulley 370 to a cable stop 372 connected with the second end portion 324 of the second resistance cable. The cable stop 372 prevents the second resistance cable from withdrawing through the lower pulley 370. As shown in FIGS. 1, 16E, and others, the exercise device includes two lower pulleys 370, each associated with respective right and left cable-pulley systems, supported by the lower cross member 284. As discussed in more detail below, the lower pulleys can be selectively positioned at various locations along the length of the lower cross member.

As previously mentioned, the upper pulleys 356 are supported by and can be selectively positioned at various locations along the length of the upper cross member 294. As shown in FIGS. 1 and 16D, the upper pulleys 356 are rotatably supported by housings 374, which in turn, are connected with and suspended from slider assemblies 376 supported on opposing end portions of the upper cross member 294. Each slider assembly 376 includes a slider pop-pin 378 mounted on a slider member 380. The slider member 380 defines a hollow cross section that is adapted to receive the upper cross member 294 such that the slider member can slide along the length the upper cross member. The slider pop-pin 378 is adapted to selectively engage a plurality of apertures 382 located on the front side of the upper cross member 294. As such, a user can selectively adjust the position of the upper pulleys 356 along the length of the upper cross member 294 by moving the slider member 380 along the length the of the upper cross member and engaging the slider pop-pin 378 with one of the plurality of apertures 382 at a desired position. To provide additional degrees of motion to the upper pulleys 356, the upper pulley housings 374 are connected with the slider members 380 through eye-bolts 384 extending from the housings 374 of the upper pulleys and eye-bolts 386 extending from the slider members 380.

As previously mentioned, the lower pulleys 370 are supported by and can be selectively positioned at various locations along the length of the lower cross member 284. The lower pulleys 370 are connected with the lower cross member 284 in a similar manner as the upper pulleys 356 are connected with the upper cross member 294 described above. As shown in FIG. 1 and 16E, the lower pulleys 370 are rotatably supported by housings 388, which in turn, are connected with and suspended from slider assemblies 390 supported on opposing end portions of the lower cross member 284. Each slider assembly 390 includes a slider pop-pin 392 mounted on a slider member 394. The slider member 394 defines a hollow cross section that is adapted to receive the lower cross member 284 such that the slider member can slide along the length the lower cross member. The slider pop-pin 392 is adapted to selectively engage a plurality of apertures 396 located on the front side of the lower cross member 284. As such, a user can selectively adjust the position of the lower pulleys 370 along the length of the lower cross member 284 by moving the slider member 380 along the length the of the lower cross member and engaging the slider pop-pin 392 with one of the plurality of apertures 396 at a desired position. To provide additional degrees of motion to the lower pulleys 370, the lower pulley housings 388 are connected with the slider members 394 through eye-bolts 398 extending from the housings 388 of the lower pulleys and eye-bolts 400 extending from the slider members 394.

As previously mentioned, a user can select the desired amount of resistance for exercising by connecting the hooks 320 on the second end portions 318 of the first resistance cables 312 with the ringed members 306 on a desired number of resistance rods 110. The user can then exercise by applying forces to the first end portions 316 of the first resistance cables 312 which in turn, pulls the first end portions of the first resistance cables outward from the forward pulleys 330. The user can also exercise by applying forces to the first end portions 322 or second end portions 324 of the second resistance cables 314, which in turn, pulls the selected cable end portions outward from either the upper pulleys 356 or lower pulleys 370, respectively. Because the second end portions 318 of the first resistance cables 312 are connected with a selected number of resistance rods 110, pulling the selected cable end portions causes the selected resistance rods to bend, which imparts a resistance force to the user. As described below, during exercise, a user can apply forces to a selected end portion of only the right or left resistance cables or by simultaneously applying forces to selected end portions of the left and right resistance cables. A more detailed description of the operation of the components associated with the cable-pulley system 106 and resistance system 108 is provided below with reference to FIGS. 1, 14, 16-16E, and others. Descriptions of rotational directions (i.e. clockwise and counterclockwise) are from a point of reference as viewed from the right side of the exercise device.

In one exercise scenario, a user can apply forces to the first resistance cable 312 associated with the right cable-pulley assembly 308, which pulls the first end portion 316 of the first resistance cable forward from the forward pulley 330 adjacent the right pivot bracket 332, causing the forward pulley to rotate clockwise. At the same time, the first resistance cable 312 is pulled forward from the lower directional pulley 336 adjacent the right side plate 278 of the rod housing 282, causing the lower directional pulley to rotate clockwise. The first resistance cable 312 is also pulled downward from the bottom pulley 338 of the floating pulley assembly 326 associated with the right cable-pulley system 308, causing the lower pulley to rotate counterclockwise. In addition, the forces applied to the first resistance cable 312 pull on the floating pulley assembly in a downward direction, which in turn, applies forces to the second resistance cable 314 partially wrapped around the top pulley 340 of the floating pulley assembly 326. The forces applied to the second resistance cable 314 from the floating pulley assembly are translated to the first and second end portions 322, 324 of the second resistance cable 314. As previously mentioned, the cable stop 354 connected with the first end portion 322 of the second resistance cable 314 prevents the first end portion from withdrawing through the upper pulley 356 on the right end portion of the upper cross member 294. Similarly, the cable stop 372 connected with the second end portion 318 of the second resistance cable 314 prevents the second end portion from withdrawing through the lower pulley 370 on the right end portion of the lower cross member 284. As such, the first and second portions of the second resistance cable do not move through the upper and lower pulleys, which in turn, prevents the floating pulley assembly 326 from moving downward in response to the forces applied to the first end portion 316 of the first resistance cable 312. Therefore, the first resistance cable 312 is pulled upward from the first rear directional pulley 342 adjacent the right side plate 278 of the rod housing 282, causing the first rear directional pulley to rotate clockwise. The first resistance cable is also pulled inward and forward from the second rear directional pulley 346 connected with the right rearward base member 144, causing the second rear directional pulley to rotate clockwise. Further, as the first resistance cable is pulled around the second rear directional pulley, the second end portion 324 of the first resistance cable 312 pulls in downward and rightward directions on the upper end portions of selected resistance rods 110 connected with the hook 320 on the second end portion 318 of the first resistance cable. The forces applied to the resistance rods 110 though the hook 320 causes the resistance rods to bend in a rightward direction.

In another scenario, a user can apply forces to the first resistance cable 312 associated with the left cable-pulley assembly 310, which pulls the first end portion 316 of the first resistance cable forward from the forward pulley 330 adjacent the left pivot bracket 334, causing the forward pulley to rotate clockwise. At the same time, the first resistance cable 312 is pulled forward from the lower directional pulley 336 adjacent the left side plate 280 of the rod housing 282, causing the lower directional pulley to rotate clockwise. The first resistance cable 312 is also pulled downward from the bottom pulley 338 of the floating pulley assembly 326 associated with the left cable-pulley system 310, causing the bottom pulley to rotate counterclockwise. In addition, the forces applied to the first resistance cable 312 pull on the floating pulley assembly in a downward direction, which in turn, applies forces to the second resistance cable 314 partially wrapped around the top pulley 340 of the floating pulley assembly 326. The forces applied to the second resistance cable 314 from the floating pulley assembly are translated to the first and second end portions 322, 324 of the second resistance cable 314. As previously mentioned, the cable stop 354 connected with the first end portion 322 of the second resistance cable 318 prevents the first end portion from withdrawing through the upper pulley 356 on the left end portion of the upper cross member 294. Similarly, the cable stop 372 connected with the second end portion 318 of the second resistance cable 314 prevents the second end portion from withdrawing through the lower pulley 370 on the left end portion of the lower cross member 284. As such, the first and second portions of the second resistance cable do not move through the upper and lower pulleys, which in turn, prevents the floating pulley assembly 326 from moving downward in response to the forces applied to the first end portion 316 of the first resistance cable 312. Therefore, the first resistance cable 312 is pulled upward from the first rear directional pulley 342 adjacent the left side plate 280 of the rod housing 282, causing the first rear directional pulley to rotate clockwise. The first resistance cable is also pulled inward and forward from the second rear directional pulley 346 connected with the left rearward base member 146, causing the second rear directional pulley to rotate clockwise. Further, as the first resistance cable is pulled around the second rear directional pulley, the second end portion 324 of the first resistance cable 312 pulls in downward and leftward directions on the upper end portions of selected resistance rods 110 connected with the hook 320 on the second end portion 318 of the first resistance cable. The forces applied to the resistance rods 110 though the hook 320 causes the resistance rods to bend in a leftward direction.

With regard to both scenarios described above, when the user releases the first resistance cable 312, the resilient characteristics of the selected resistance rods 110 cause the resistance rods to substantially return to their original upright orientations. As the resistance rods 110 substantially return to their original upright orientations, forces are applied to the first resistance cable 312, which pull the first end portion 316 of the first resistance cable rearward until the cable stop 328 reengages the forward pulley 330.

In yet another scenario, the user can apply forces of the second resistance cable 314 associated with the right cable-pulley system 308, pulling the first end portion 316 of the second resistance cable from the upper pulley 356 connected with the right end portion of the upper cross member 294, causing the upper pulley to rotate. At the same time, the second resistance cable 314 is pulled forward from the first upper directional pulley 358 adjacent the right end portion of the linking plate 362. In addition, the second resistance cable is pulled upward from the top pulley 340 of the floating pulley assembly 326 associated with the right cable-pulley system 308. As previously mentioned, the cable stop 372 connected with the second end portion 324 of the second resistance cable 314 prevents the second resistance cable from withdrawing through the lower pulley 370 connected with the right end portion of the lower cross member 284. As such, the forces applied to the second resistance cable pulls the floating pulley assembly in an upward direction, which in turn, applies forces to the first resistance cable 312 partially wrapped around the bottom pulley 338 of the floating pulley assembly 326. In turn, the forces applied to the first resistance cable 312 from the floating pulley assembly 326 are translated to the first and second end portions 316, 318 of the first resistance cable. As previously mentioned, the cable stop 328 connected with the first end portion 316 of the first resistance cable 312 prevents the first end portion from being withdrawn through the forward pulley 330 adjacent the right pivot bracket 332. However, the second end portion 318 of the first resistance cable is connected with a selected number of resistance rods 110. As such, the forces applied to the first resistance cable 312 from the floating pulley assembly 326 are carried through to the second end portion 318 of the first resistance cable, causing the selected resistance rods 110 to bend rightward as the floating pulley assembly moves upward.

When the user applies a force to the second end portion 324 of the second resistance cable 314 associated with the right cable-pulley system 308, the cable-pulley system functions in a similar manner as described above when pulling on the first end portion 322 of the second resistance cable 314. More particularly, the second end portion 324 of the second resistance cable 314 is pulled from the lower pulley 370 on the right end portion of the lower cross member 284, causing the lower pulley to rotate. At the same time, the second resistance cable 314 is pulled downward from the second upper directional pulley 368 connected with the right upright member 274. In addition, the second resistance cable is pulled upward from the top pulley 340 of the floating pulley assembly 326 associated with the right cable-pulley system 308. As described above, the cable stop 354 connected with the first end portion 322 of the second resistance cable 314 prevents the second resistance cable from withdrawing through the upper pulley 356 connected with the right end portion of the upper cross member 294. As such, the force applied to the second resistance cable pulls the floating pulley assembly 326 in an upward direction, which in turn, applies forces to the first resistance cable 312 partially wrapped around the bottom pulley 338 of the floating pulley assembly. As described above, the forces applied to the first resistance cable from the floating pulley assembly are translated to the first and second portions 316, 318 of the first resistance cable 312. The cable stop 328 connected with the first end portion 316 of the first resistance cable prevents the first end portion from being withdrawn through the forward pulley adjacent the right pivot bracket 332. However, the second end portion 318 of the first resistance cable is connected with a selected number of resistance rods 110. As such, the forces applied to the first resistance cable 312 from the floating pulley assembly 326 are carried through to the second end portion 318, causing the resistance rods 110 to bend rightward as the floating pulley assembly moves upward.

In still another scenario, the user can apply forces of the second resistance cable 314 associated with the left cable-pulley system 310, pulling the first end portion 322 of the second resistance cable from the upper pulley 356 connected with the left end portion of the upper cross member 294, causing the upper pulley to rotate. At the same time, the second resistance cable 314 is pulled forward from the first upper directional pulley 358 adjacent the left end portion of the linking plate 362. In addition, the second resistance cable is pulled upward from the top pulley 340 of the floating pulley assembly 326 associated with the left cable-pulley system 310. As previously mentioned, the cable stop 372 connected with the second end portion 324 of the second resistance cable 314 prevents the second resistance cable from withdrawing through the lower pulley 370 connected with the left end portion of the lower cross member 284. As such, the forces applied to the second resistance cable pulls the floating pulley assembly in an upward direction, which in turn, applies forces to the first resistance cable 312 partially wrapped around the bottom pulley 338 of the floating pulley assembly 326. In turn, the forces applied to the first resistance cable 312 from the floating pulley assembly 326 are translated to the first and second end portions 316, 318 of the first resistance cable. As previously mentioned, the cable stop 328 connected with the first end portion 316 of the first resistance cable 312 prevents the first end portion from being withdrawn through the forward pulley 330 adjacent the left pivot bracket 334. However, the second end portion 318 of the first resistance cable is connected with a selected number of resistance rods 110. As such, the forces applied to the first resistance cable 312 from the floating pulley assembly 326 are carried through to the second end portion 318 of the first resistance cable, causing the selected resistance rods 110 to bend leftward as the floating pulley assembly moves upward.

When the user applies a force to the second end portion 324 of the second resistance cable 314 associated with the left cable-pulley system 310, the cable-pulley system functions in a similar manner as described above when pulling on the first end portion 322 of the second resistance cable 314. More particularly, the second end portion 324 of the second resistance cable 314 is pulled from the lower pulley 370 on the left end portion of the lower cross member 284, causing the lower pulley to rotate. At the same time, the second resistance cable 314 is pulled downward from the second upper directional pulley 368 connected with the left upright member 276. In addition, the second resistance cable is pulled upward from the top pulley 340 of the floating pulley assembly 326 associated with the left cable-pulley system 310. As described above, the cable stop 354 connected with the first end portion 322 of the second resistance cable 314 prevents the second resistance cable from withdrawing through the upper pulley 356 connected with the left end portion of the upper cross member 294. As such, the force applied to the second resistance cable pulls the floating pulley assembly 326 in an upward direction, which in turn, applies forces to the first resistance cable 312 partially wrapped around the bottom pulley 338 of the floating pulley assembly. As described above, the forces applied to the first resistance cable from the floating pulley assembly are translated to the first and second portions 316, 318 of the first resistance cable 312. The cable stop 328 connected with the first end portion 316 of the first resistance cable prevents the first end portion from being withdrawn through the forward pulley adjacent the left pivot bracket 334. However, the second end portion 318 of the first resistance cable is connected with a selected number of resistance rods 110. As such, the forces applied to the first resistance cable 312 from the floating pulley assembly 326 are carried through to the second end portion 318, causing the resistance rods 110 to bend leftward as the floating pulley assembly moves upward.

With regard to the above scenarios, when the user releases the second resistance cable 314, the resilient characteristics of the selected resistance rods 110 cause the resistance rods to substantially return to the original upright orientations. As the resistance rods 110 substantially return to the original upright orientations, forces are applied to the first resistance cable 312, which in turn pulls floating pulley assembly 326 in a downward direction. As the floating pulley assembly 326 is pulled downward, the first and second end portions 322, 324 of the second resistance cable 314 are pulled rearward until the cable stops 354, 372 reengage respective upper and lower pulleys 356, 370.

Figure 17A:
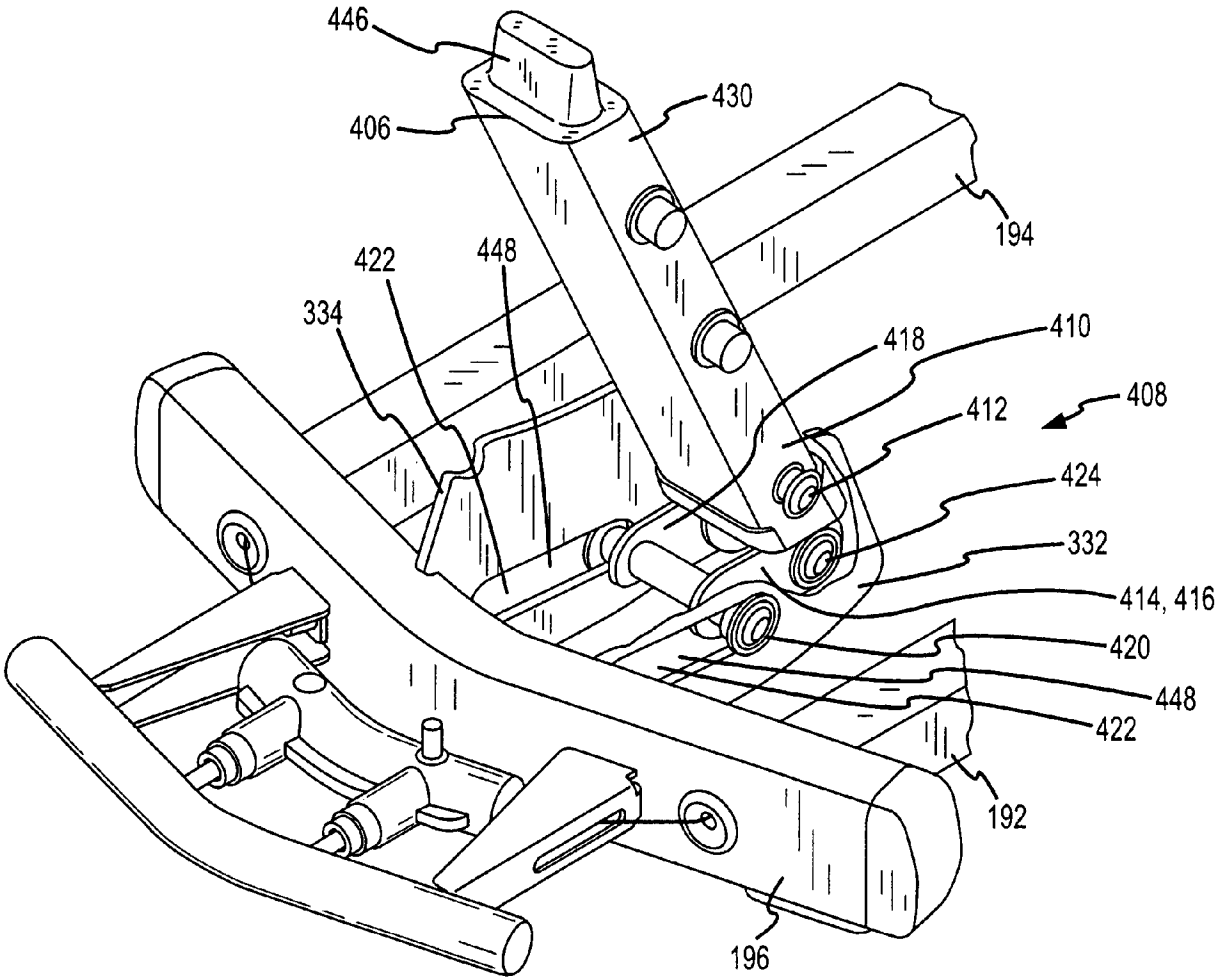
FIG. 17A is a detailed view of a pivotal connection between a forward support member and the base portion of the frame, showing the forward support member in an upright position.

As previously mentioned, the seat rail 116 supports the adjustable bench assembly 104 that includes the adjustable back support 114 and bench seat 112. As shown in FIGS. 1, 5, and others, a rear end portion 402 of the seat rail is pivotally connected with the exercise device frame 102. As such, the seat rail can be pivoted between a downward position as shown in FIGS. 1 and 5, and an upward position as shown in FIGS. 3 and 4. As shown in FIGS. 1 and 16A, when the seat rail is in the downward position, a forward end portion 404 of the seat rail 116 is supported by a forward support member 406 pivotally connected with the forward base structure 130. As discussed in more detail below, the forward support member 406 is connected with the foot member 196 through a pivot assembly 408 that allows the forward support member to pivot from an upward position shown in FIGS. 1 and 17A to a downward into a storage position shown in FIGS. 3 and 17B. The forward support member 406 is placed in the storage position to avoid contact with the upright portion 126 of the frame 102 when the forward base structure 130 of the exercise device 100 is placed in the storage configuration. As previously mentioned, the seat rail 116 can also be pivoted upward and selectively locked in an upright position as shown in FIGS. 1 and 17A. As discussed in more detail below, the seat rail can be held in the upright position with the rail locking mechanism 272 connected with the upright portion of the frame. Although the seat rail depicted herein is not locked into the downward position, it is to be appreciated that other embodiments of the exercise device can be configured to lock the seat rail in the downward position.

Figure 17B:
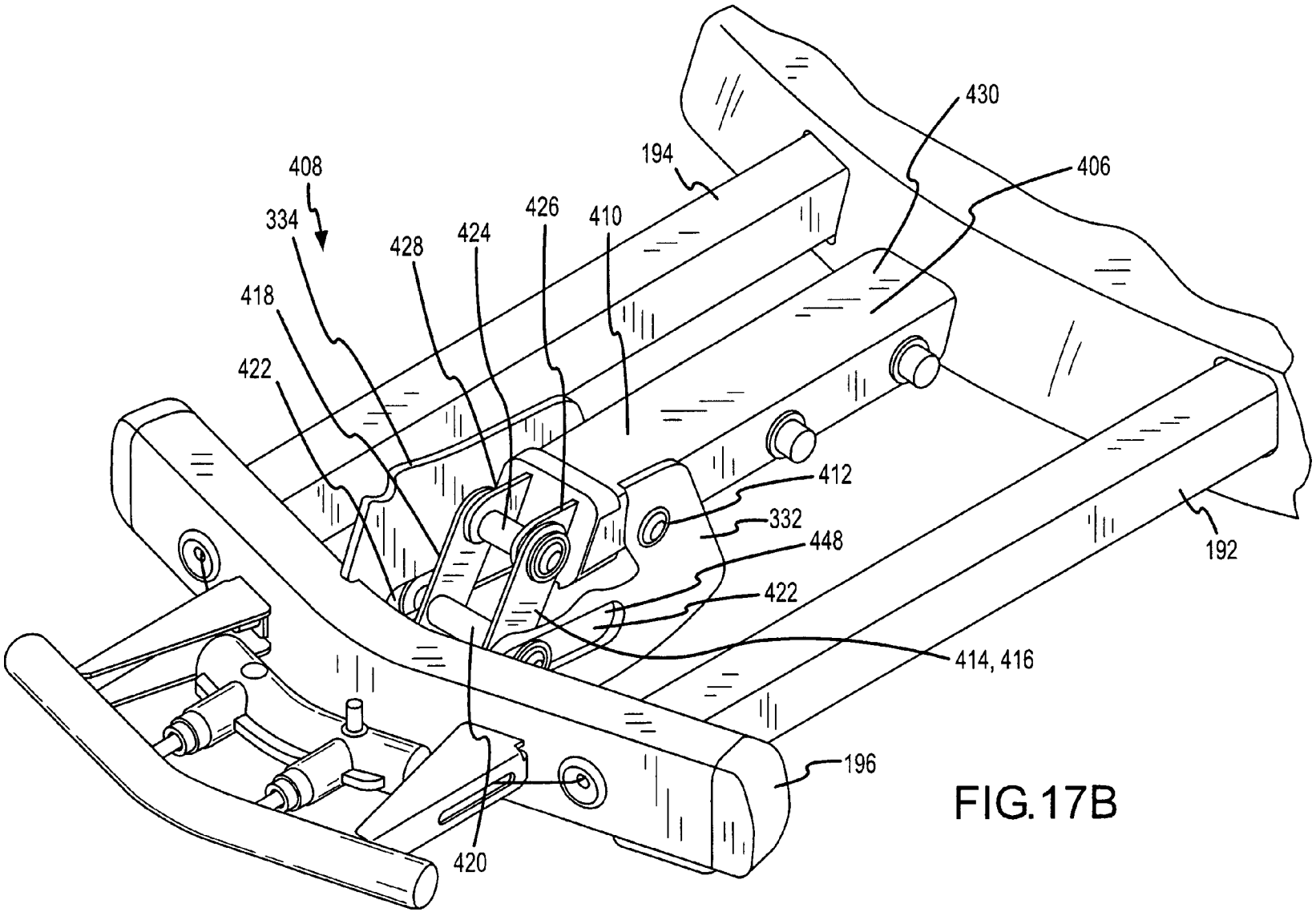
FIG. 17B is a detailed view of a pivotal connection between the forward support member and the base portion of the frame, showing the forward support member in a downward position.

FIGS. 1 and 16A shows the forward support member 406 positioned under the forward end portion 404 of the seat rail 116. As previously mentioned, the pivot assembly 408 pivotally connects the forward support member 406 with the foot member 196. The pivot assembly 408 allows the forward support member 406 to pivot downward in a clockwise direction (as viewed from the right side of the exercise device). As such, the forward support member 406 can be placed in a storage position where the forward support members is substantially aligned with the right and left base members 192, 194, as shown in FIGS. 3 and 17B. Pivoting the forward support member 406 downward helps prevent the forward support member from colliding with the upright portion 126 of the frame 102 when the exercise device 100 is placed in the storage configuration. The pivot assembly 408 also limits the pivotal movement of the forward support member 406 in the counterclockwise direction (as viewed from the right side of the exercise device) when placed in an upright position to support the seat rail 116. As such, when the seat rail 116 is supported on the forward support member 406, the pivot assembly 408 resists forces exerted on the seat rail in a forward direction as well as in a lateral direction. Other embodiments of the exercise device utilize a forward support member coupled with the frame that only supports the forward end portion of the seat and does not resist forces on the seat rail in either forward, rearward, or lateral directions.

As shown in FIGS. 16A, 17A, and 17B, the pivot assembly 408 includes the right and left pivot brackets 332, 334 connected with and extending rearward of the foot member 196. The right pivot bracket is shown partially broken away in FIGS. 17A and 17B for clarity. A pivot axle 412 is connected with and supported between the right and left pivot brackets 332, 334. A first end portion 410 of the forward support member 406 is rotatably connected with the pivot axle 412. As such, the forward support member 406 can pivot about an axis defined by the pivot axle 412. The first end portion 410 of the forward support member 406 is also connected with the right and left pivot brackets 332, 334 through a pivot link assembly 414. As discussed in more detail, the connection between the pivot link assembly 414 and the pivot brackets limit the range of pivotal movement of the forward support member 406. The pivot link assembly 414 includes right and left linkage plates 416, 418 connected with and separated by a link shaft 420. Opposing end portions of the link shaft 420 are adapted to be received in corresponding slots 422 in the right and left pivot brackets 332, 334. In addition, the right and left linkage plates 416, 418 are pivotally connected with a link axle 424 extending between right and left end links 426, 428 extending from the first end portion 410 of the forward support member 406.

Figure 18A:
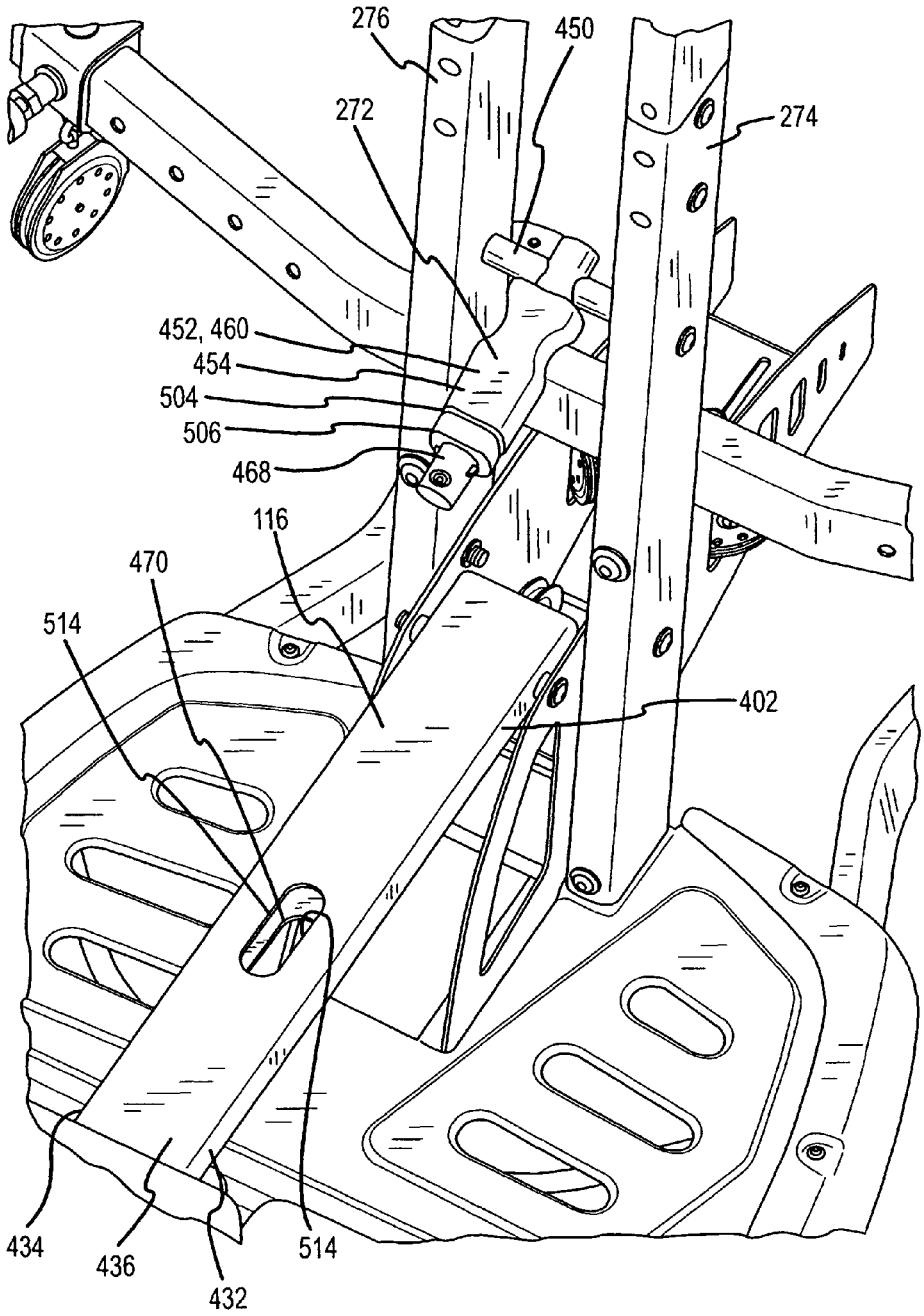
FIG. 18A is a detailed view of the seat rail and a rail locking mechanism.
Figure 19A:
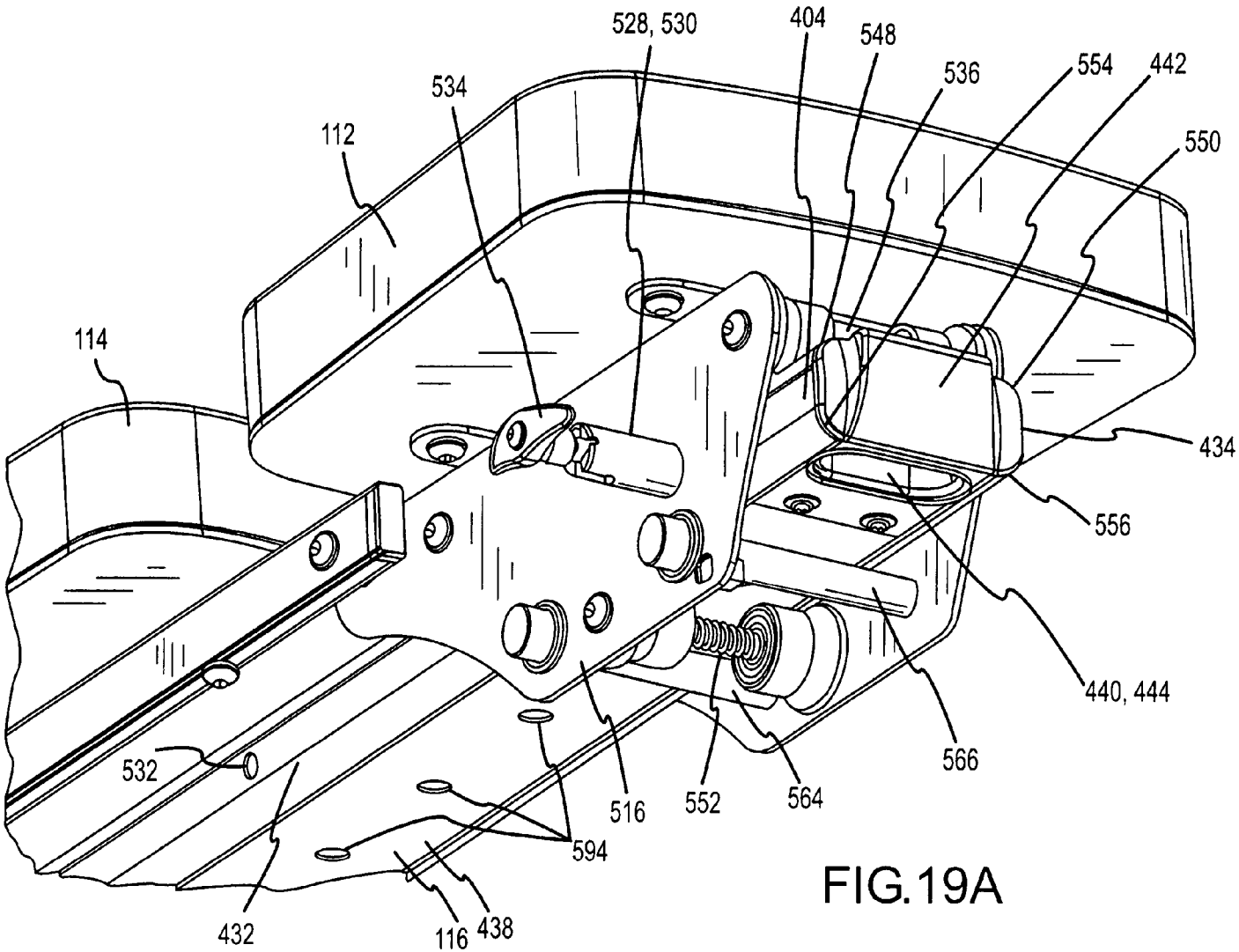
FIG. 19A is a detailed view of a forward end portion of the seat rail and bench seat.

As previously mentioned, when the seat rail 116 is in the downward position, forward support member 406 resists downward forces exerted on the forward end portion 404 of the seat rail 116. In addition, the seat rail 116 engages a second end portion 430 of the forward support member 406 such that the forward support member also resists forces exerted on the seat rail in forward and lateral directions. Further, the seat rail 116 is not locked in the downward position when engaged with the forward support member, and as such, can be freely raised. However, it is be appreciated that other embodiments of the present invention are configured to lock the seat rail in the downward position. As shown in FIGS. 16A, 18A, and 19A, the seat rail 116 is hollow and defines a generally rectangular cross section, defining right and left sides 432, 434 connected with and separated by top and bottom sides 436, 438. As shown in FIG. 19A, an elongated aperture 440 is located near the forward end portion 404 on the bottom side 438 of the seat rail. A forward plug 442 inserted into the forward end portion 404 of the seat rail 116 includes a cavity 444, the opening of which substantially aligns with the elongated aperture 440 in the seat rail. The cavity 444 is adapted to receive a projection 446, shown in FIG. 17A, extending from the second end portion 430 of the forward support member 408 when the seat rail 116 is placed in the downward position.

As shown in FIGS. 1 and 17A, the forward support member 406 is in the upright position to support the seat rail 116. As illustrated, the forward support member is angled forwardly with respect to the frame 102, and the link shaft 420 of the pivot link assembly 414 is positioned at rear end portions 448 of the slots 422 in the pivot brackets 332, 334. The engagement of the link shaft 420 with the rear end portions of the slots limits the pivotal movement of the forward support member 406 in a counterclockwise direction (as viewed from the right side of the exercise device). To place the forward support member 406 in the downward position shown in FIGS. 3 and 17B, the second end portion 430 of the forward support member 406 is pivoted clockwise (as viewed from the right side of the exercise device) about the pivot axle 412. As the forward support member 406 pivots clockwise, the link shaft 420 moves forward along the slots 422 in the pivot brackets 332, 334 until the forward support member 406 is substantially aligned with the right and left linkage plates 416, 418 of the pivot link assembly 414. As the forward support member continues to pivot clockwise, the link shaft 420 moves slightly rearward along the slots 422 in the pivot brackets until the forward support member 406 is substantially aligned with the right and left base members 192, 194.

As previously mentioned, the rear end portion 402 of the seat rail 116 is pivotally connected with the frame 102. As such, a user can lift and selectively lock the seat rail in an upright position, as shown in FIGS. 3 and 4. More particularly, the seat rail 116 is pivoted upward toward the upright portion 126 of the frame 102 and is held in position by the rail locking mechanism 272 connected with the upright portion of the frame. As previously mentioned, the seat rail 116 is placed in the upright position before placing the exercise device in the storage configuration. As discussed in more detail below, the seat rail can also be placed in the upright position when the exercise device 100 is configured for a squat exercise.

As shown in FIG. 18A, the rail locking mechanism 272 is pivotally supported on an axle 450 extending between the first and second upright members 274, 276. As shown in FIGS. 18A-18D, the rail locking mechanism 272 includes a housing assembly 452 having upper and lower housings 454, 456 that partially enclose an engagement cylinder 458. The outer surface of the housing assembly forms a grip 460 and is adapted to slide back and forth along the length of the engagement cylinder 458. The engagement cylinder 458 is hollow and partially encloses a spring-loaded linkage assembly 462 that extends along the inside the engagement cylinder 458 between a first end plug 464 and a second end plug 466. The linkage assembly 462 operates to selectively connect the engagement cylinder 458 with the seat rail 116. More particularly, when the seat rail is pivoted to the upright position, a forward end portion 468 of the engagement cylinder 458 is received within an elongated aperture 470 in the top side 436 of the rear end portion 402 of the seat rail 116. The linkage assembly 462 selectively connects the top side 436 of the seat rail 116 with the engagement cylinder 458 to hold the seat rail in the upright position. The grip 460 and housing 452 are moved rearwardly along the length of the engagement cylinder 458 to actuate the linkage assembly 462 and disconnect the seat rail 116 from the rail locking mechanism 272.

Figure 18B:
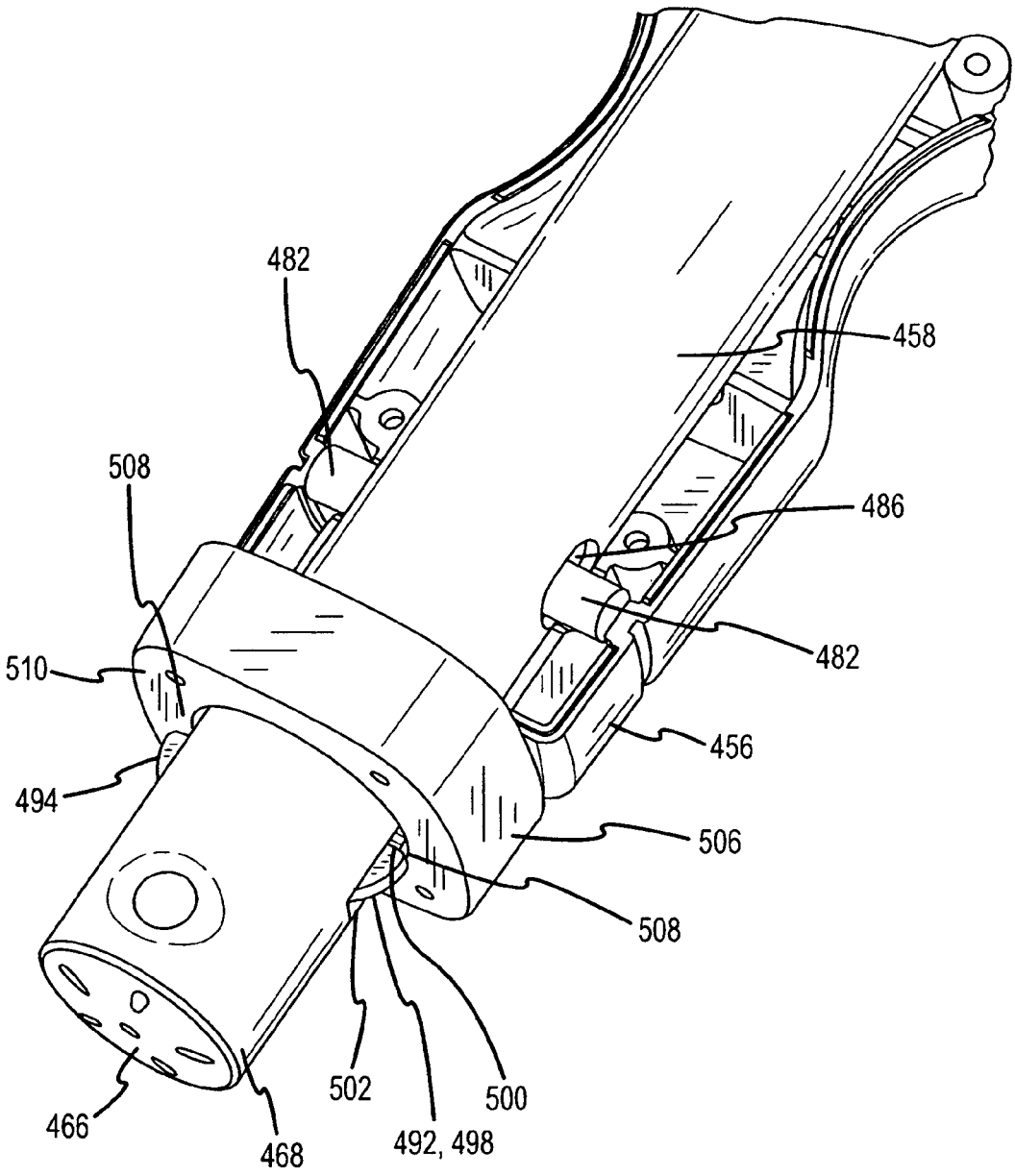
FIG. 18B is a view of the rail locking mechanism of FIG. 18A with an upper housing removed.
Figure 18C:
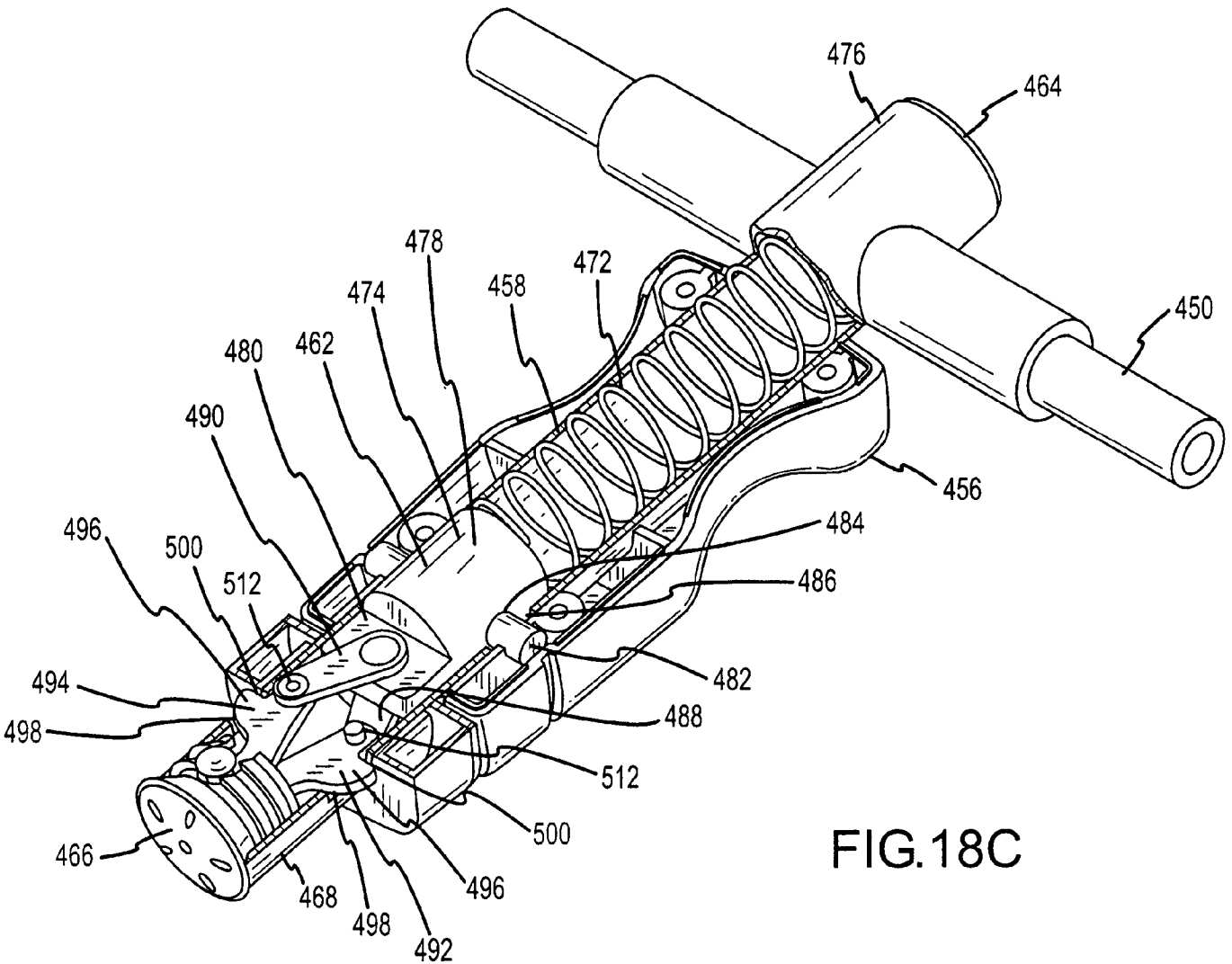
FIG. 18C is a view of the rail locking mechanism of FIG. 18A with the upper housing removed and an engagement cylinder broken away, showing rail pawls extended through slots in the engagement cylinder.
Figure 18D:
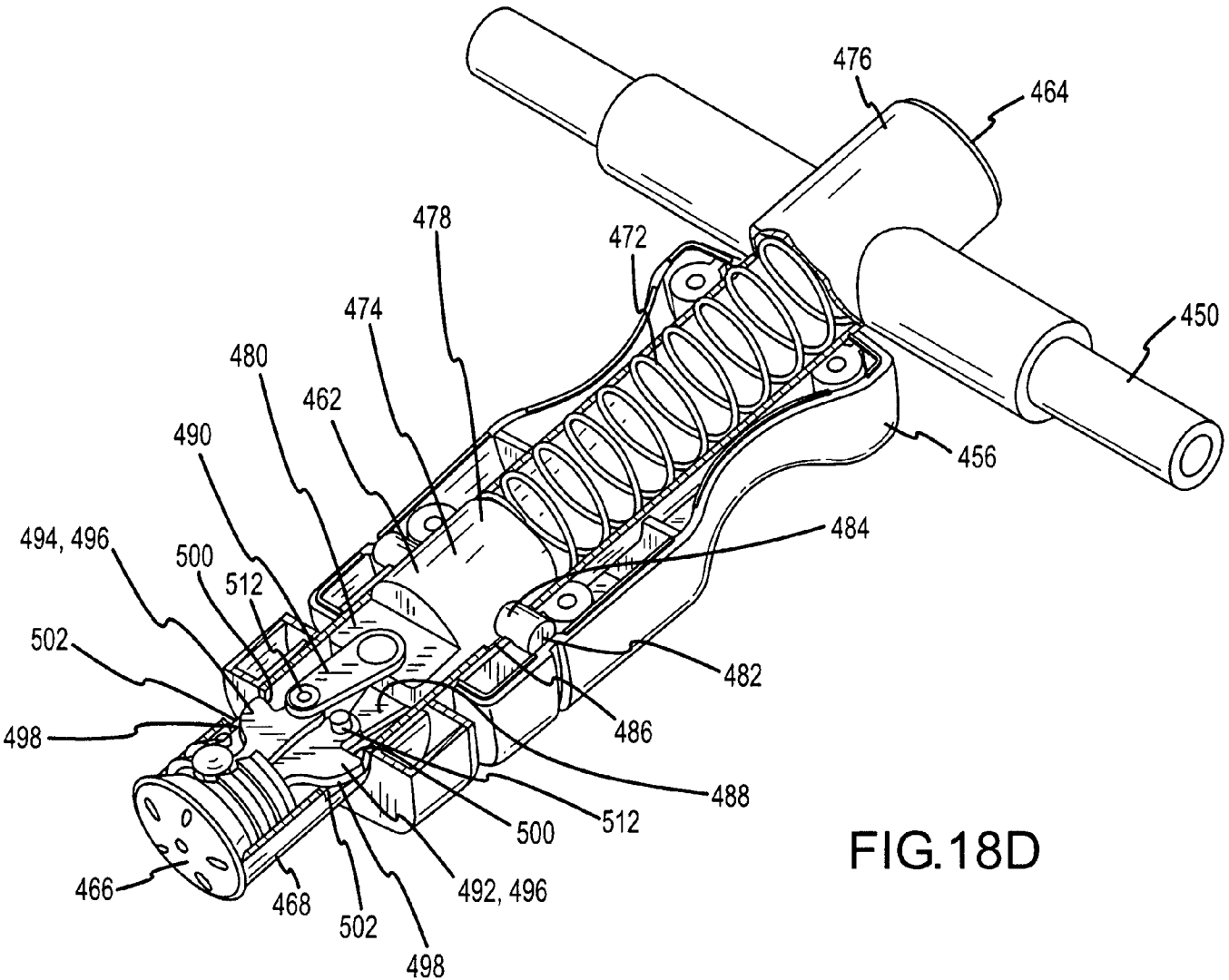
FIG. 18D is a view of the rail locking mechanism of FIG. 18A with the upper housing removed and an engagement cylinder broken away, showing rail pawls retracted through the slots and into in the engagement cylinder.

As shown in FIGS. 18B-18D, the linkage assembly 462 includes a compression spring 472 connected between a guide piston 474 and the first end plug 464. The first end plug 464 is inserted into and held in position within a rear end portion 476 of the engagement cylinder 458. The guide piston 474 includes a cylindrical portion 478 and a plate portion 480 extending therefrom. The cylindrical portion 478 is adapted to be received within the engagement cylinder 458. A release pin 482 extends through apertures 484 in opposing sides of the cylindrical portion 478 of the guide piston 474. Opposing end portions of the release pin 482 also extend through elongated apertures 486 in opposing sides of the engagement cylinder 458 and are connected with the housing assembly 452. As such, a sufficient force applied to the housing assembly 452 in a direction toward the axle 450 will cause the release pin 482 and guide piston 474 to move toward the rear end portion 476 of the engagement cylinder 458, as shown in FIG. 18D. As the guide piston 474 moves rearward, the spring 472 is compressed between the guide piston 474 and the first end plug 464. When the force is released from the housing assembly 452, the spring 472 will force the guide piston 474 forward to the original starting position, as shown in FIG. 18C. The distance which the guide piston 474 and release pin 482 can move is limited by the length of the elongated apertures 470 in the engagement cylinder 458.

As shown in FIGS. 18B-18D, the linkage assembly 462 includes first and second driving links 488, 490 pivotally connected with the plate portion 480 of the guide piston 474. The first and second driving links 488, 490 are also pivotally connected with first and second rail pawls 492, 494, respectively. In addition, the first and second rail pawls 492, 494 are pivotally connected with the second end plug 466, which is inserted into and held in position within the forward end portion 468 of the engagement cylinder 458. The first and second rail pawls 492, 494 each include extensions 496 having an arcuate forward edge 498 and a flat rear edge 500 that partially extend through slots 502 on opposing sides of the engagement cylinder 458. As shown in FIGS. 18A and 18B, the rail locking mechanism 272 also includes a stop shoulder 504 connected with the outer surface of the engagement cylinder 458 adjacent the housing assembly 452. A bumper 506 is connected with a forward side of the stop shoulder in a position to define a gap 508 between a forward surface 510 of the bumper 506 and each of the rear flat edges 500 of the rail pawl extensions 496 protruding from the slots 502 in engagement cylinder 458.

As shown in FIG. 18D, when the housing assembly 452 is moved along the length of the engagement cylinder 458 toward the axle 450, the plate portion 480 of the guide piston 474 pulls in a rearward direction on the first and second driving links 488, 490. In turn, the first and second driving links 488, 490 pull on the first and second rail pawls 492, 494, which causes pivotal connections 512 between the driving links and rail pawls to move toward each other. In turn, the extensions 496 of the first and second rail pawls 492, 494 are pulled through the slots 502 and inside the engagement cylinder 458. As shown in FIG. 18C, when the housing assembly 452 is released, the spring 472 pushes the guide piston 474 in a direction away from the axle 450, which imparts a force on the pivotal connections 512 between the driving links and rail pawls, driving the extensions 496 back through the slots 502 to extend outside the engagement cylinder 458.

To connect the seat rail 116 with the rail locking assembly 272, as shown in FIGS. 3, 4 and 18A-18D, the seat rail is pivoted upward to insert the forward end portion 468 of the engagement cylinder into the elongated aperture 470 in the top side 436 of the seat rail. As the forward end portion 468 of the engagement cylinder 458 is inserted into the elongated seat rail aperture 470, opposing side edges 514 of the elongated aperture 470 engage the arcuate edges 498 of the rail pawl extensions 496 protruding from the slots 502 in the engagement cylinder 458. The extensions are thus forced inside the engagement cylinder 458, causing the pivotal connections 512 between the driving links and rail pawls to move toward each other. As such, the guide piston 474 moves toward the rear end portion 476 of the engagement cylinder 458, causing the spring 472 to compress. Once the side edges 514 of the elongated aperture 470 move past the slots 502 in the engagement cylinder 458, the spring forces 472 the guide piston back toward the forward end portion 468 of the engagement cylinder 458, causing the pivotal connections 512 between the driving links and rail pawls to move away from each other. As such, the extensions 496 are forced back through the slots 502 in the engagement cylinder 458. At this point the top side 436 of the seat rail 116 is captured between the flat rear edges 500 of the rail pawl extensions 496 and the forward surface 510 of the bumper 506. More particularly, the thickness of the top side 436 of the seat rail 116 is slightly smaller than the previously mentioned gap 508 between flat rear edges 500 of the rail pawl extensions 496 and the forward surface 510 of the bumper 506. As such, the seat rail 116 is securely held in the upright position.

To release the seat rail 116 from the rail locking mechanism 272, the housing assembly 452 is moved in a direction toward the axle 450, causing the guide piston 474 to move toward the rear end portion 476 of the engagement cylinder 458. As the guide piston moves rearwardly, the pivotal connections 512 between the driving links and rails pawls move toward each other. As such, the rail pawl extensions 496 are retracted through the slots 502 in the engagement cylinder 458, as shown in FIG. 18D. With the rail pawl extensions retracted, edges 514 of the elongated aperture 470 in the top side 436 of the seat rail 116 can slide over the slots 502 and out of engagement with the forward end portion 468 of engagement cylinder 458.

Figure 19B:
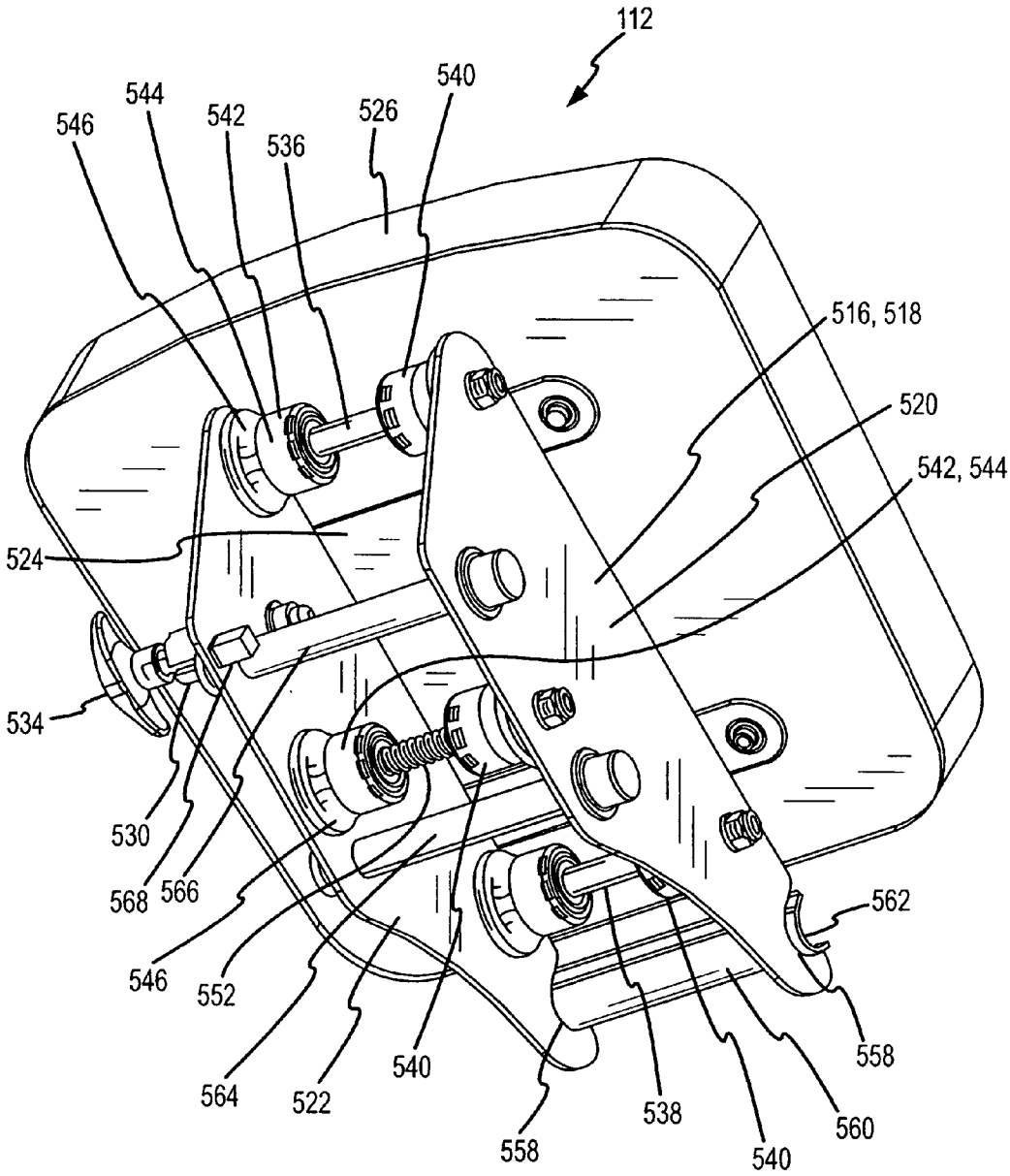
FIG. 19B is a detailed view of the bench seat.

As previously mentioned, the bench seat 112 of the exercise device 100 is adjustably connected with the seat rail 116. As shown in FIGS. 19A and 19B, the bench seat 112 is connected with the seat rail 116 through a wheel car assembly 516 that allows a user roll the bench seat back and forth along the length of the seat rail. The wheel car assembly 516 includes a main body 518 defined by right and left sides 520, 522 connected with and separated by a top side 524. The top side 524 supports a padded portion 526 of the bench seat 112. A spring-loaded bench seat pop-pin 528 is supported on the left side 522 of the main body 518 of the wheel car assembly 516. The bench seat pop-pin 528 includes a body 530 housing a spring operably connected with a pin, as is known in the art. The spring in the bench seat pop-pin 528 acts to force the pin against left side 434 of the seat rail 116. As discussed in more detail below, the bench seat pop-pin is adapted to selectively engage apertures 532 along the left side 434 of the seat rail 116 to selectively fix the bench seat 112 in a desired location along the length of the seat rail 116.

As previously mentioned and as shown in FIGS. 19A and 19B, the bench seat pop-pin 528 is adapted to engage apertures 532 in the left side 434 of the seat rail 116. More particularly, when the pin of the bench seat pop-pin 528 is received within one of the apertures 532, the bench seat 112 is locked in a position along the length of the seat rail 116. Various numbers of apertures can be located in the seat rail. In one embodiment of the exercise device, two apertures are located along the left side of the seat rail. A first aperture allows a user to fix the bench seat in a forward position along the length of the seat, as shown in FIG. 1. A second aperture allows a user to fix the bench seat in a mid-position along the length of the seat rail, as shown in FIG. 2. A user can pull a handle 534 on the bench seat pop-pin 528 to disengage the bench seat pop-pin from an aperture on the seat rail to enable the bench seat to roll backward or forward to a desired position along the length of the seat rail.

As previously mentioned, the bench seat pop-pin 528 is spring-loaded, and as such, the bench seat pop-pin will automatically reengage the left side 434 of the seat rail 116 once the user releases the handle. Therefore, when bench seat is moved to place the pin of bench seat pop-pin 528 in alignment with one of the apertures 532 on the left side of the seat rail 116, the bench seat pop-pin will automatically engage one of the apertures and lock the seat in a position along the length of the seat rail. The bench seat pop-pin can also be selectively configured to disable the spring-loaded feature to allow the wheel car assembly 516 and bench seat 112 to freely roll back and forth along the length of the seat rail 116. For example, in one form, the handle 534 of the bench seat pop-pin 528 can be pulled to disengage the bench seat pop-pin from the left side of the seat rail 116. With the bench seat pop-pin disengaged, the handle 534 can be turned to engage the body 530 of the bench seat pop-pin 528 hold the bench seat pop-pin in disengagement from the seat rail.

As shown in FIG. 19B, the bench seat assembly 112 includes a forward upper axle 536 and a rear upper axle 538 connected with and extending through the right and left sides 520, 522 of the wheel car assembly 516. The upper axles 536, 538 each support left and right rollers 540, 542 adapted to roll along the top side 436 of the seat rail 116. Each roller 540, 542 includes a cylindrically-shaped portion 544 and a ledged portion 546. The cylindrically-shaped portion 544 defines a constant radius flat rolling surface adapted to engage the top side 436 of the seat rail 116. The ledged portion 546 is adapted to engage upper right and left curved corner regions 548, 550 of the seat rail 116 defined by the intersection of right and left sides 432, 434 with the top side 436 of the seat rail, respectively. The ledged portions 546 of the rollers act as thrust bearings to absorb forces exerted on the bench seat 112 that have a sideway component perpendicular to the length seat rail 116. As such, the ledged portions 546 of the rollers help keep the wheel car assembly 516 aligned with the seat rail as it rolls back and forth along the length of the seat rail.

As shown in FIG. 19B, the wheel car assembly 516 includes a lower axle 552 connected with and extending through the right and left sides 520, 522 of the main body 518 under the upper axles 536, 538. The lower axle 552 supports right and left rollers 540, 542 adapted to roll along the bottom side 438 of the seat rail 116. Similar to the rollers connected with the upper axles, each roller 540, 542 supported by the lower axle 552 includes the cylindrically-shaped portion 544 and the ledged portion 546. The flat rolling surface defined by the cylindrically-shaped portion 544 is adapted to engage the bottom side 438 of the seat rail 116. The ledged portion 546 is adapted to engage lower right and left corner regions 554, 556 of the seat rail 116 defined by the intersection of right and left sides 432, 434 with the bottom side 438 of the seat rail, respectively. The combination of the rollers 540, 542 engaging the top and bottom sides 436, 438 of the seat rail 116 help prevent the wheel car 516 and bench seat 112 from tipping forward or backward or otherwise disengaging from the seat rail.

The bench seat assembly 112 shown in FIGS. 19A and 19B is adapted to connect with various components of the exercise device 100. For example, the right and left sides 520, 522 of the wheel car assembly 516 each include bench seat hooks 558 extending rearwardly therefrom. The bench seat hooks 558 are connected with a cross bar support 560 that defines an upwardly facing concave surface 562. As discussed in more detail below, the cross bar support 560 is adapted to engage various components, such as the back support 114. As shown in FIG. 19B, the bench seat assembly 112 also includes first and second attachment tubes 564, 566 extending between the right and left sides 520, 522 of the wheel car assembly 516, as a well as a lock pin 516 connected with the left side 522 of the wheel car assembly. As discussed in more detail below, the attachment tubes 564, 566 and lock pin 568 provide connection points for the squat exercise accessory 124.

Figure 20:
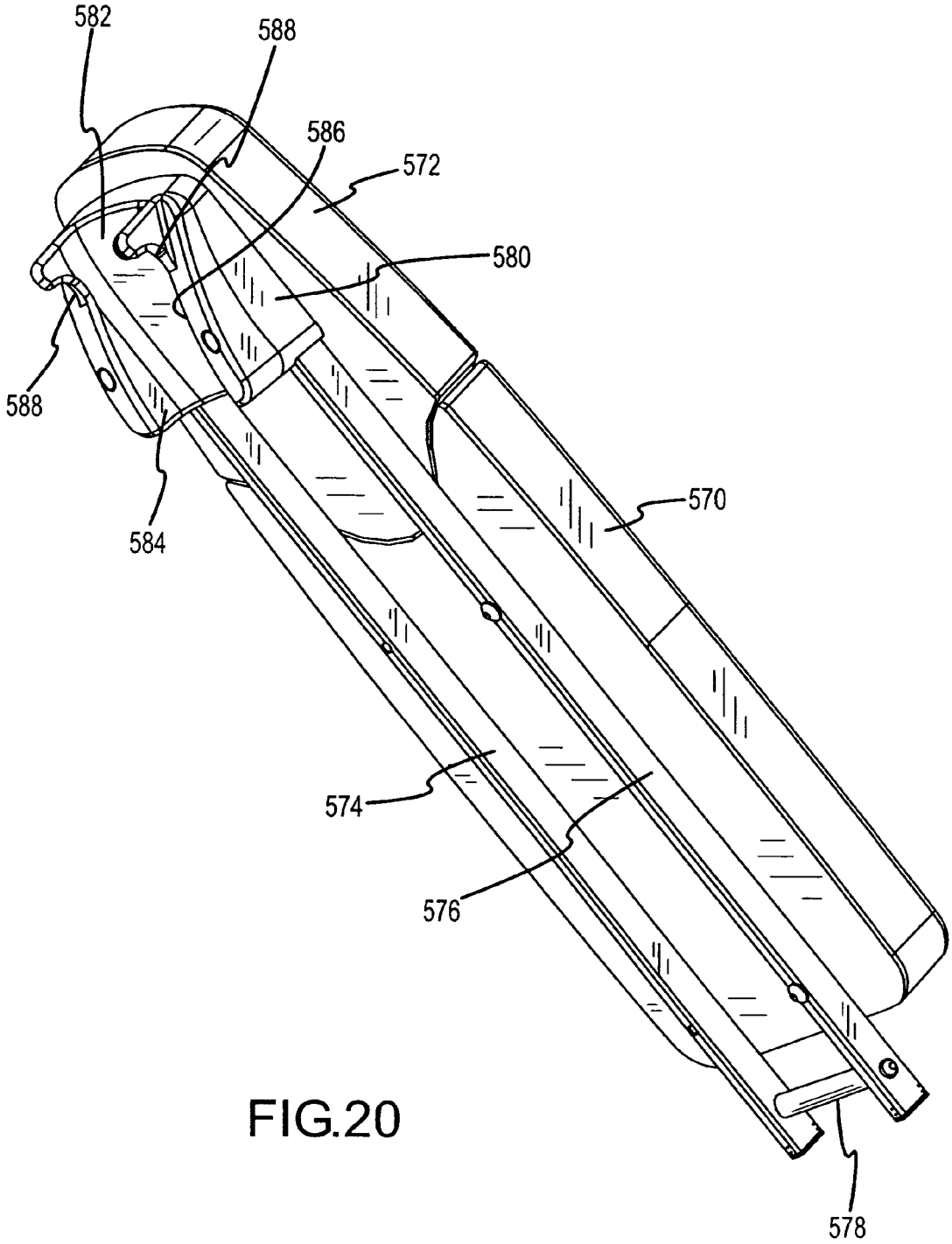
FIG. 20 is a detailed view of a back support.

As previously mentioned, the back support 114 of the bench assembly 104 is adapted to selectively connect with bench seat 112, seat rail 116, and the upright portion 126 of the frame 102. As shown in FIG. 20, the back support 114 includes forward and rear padded portions 570, 572 mounted on right and left back support rails 574, 576. Forward end portions of the back support rails 574, 576 are connected with and separated by a cross bar 578, shown in FIG. 1 and others. The cross bar 578 is adapted to releasably connect the forward end portion of the back support 114 with the bench seat 112. More particularly, as shown in FIG. 20, the upwardly facing concave surface 562 of the cross bar support 560 on the bench seat 112 is adapted to receive and support the cross bar 578 on the back support 114. As discussed in more detail below, the back support 114 can be positioned adjacent the seat rail 116 wherein the back support and bench seat 112 collectively define a relatively flat bench, as shown in FIG. 1. As shown in FIG. 20, the back support includes a back support member 580 defining a U-shaped channel 582 adapted to fit over the seat rail 116 when the back support is placed adjacent with the seat rail. The back support 114 can also be placed in an inclined position supported between the bench seat 112 and the frame 102, as shown in FIG. 2. As shown in FIG. 20, rear end portions of right and left sides 584, 586 of the U-shaped channel 582 define hooks 588 adapted to connect with the upright portion 126 of the frame 102, when the back support is in the inclined position.

As previously mentioned, the bench seat 112 and the back support 114 can be connected together on top of the seat rail 116 to form a flat bench, as shown in FIG. 1. To form the flat bench, the bench seat 112 is locked in position near the forward end portion 404 of the seat rail 116 and the cross bar 578 on the back support 114 is placed on the upwardly facing concave surface 562 of the cross bar support 560 on the bench seat 112. The U-shaped channel 582 under the back support 114 is positioned over a rear end region of the seat rail 116. Because the U-shaped channel 582 engages the right and left sides 432, 434 of the seat rail 116, the back support member 580 adds lateral stability to the back support 114, which helps prevent the back support from tipping from side-to-side on the seat rail. As previously mentioned, the back support 114 can also be connected between the bench seat 112 and upright portion 126 of the frame 102 such that the back support 114 is inclined relative to the bench seat 112, as shown in FIG. 2. More particularly, the hooks 588 on the U-shaped channel 582 are adapted to receive a back support bar 590 connected between the right and left upright members 274, 276 of the frame 102. In the inclined position, the bench seat 112 is locked in a position between the forward end portion 404 and rear end portion 402 of the seat rail 116. The cross bar 578 on the back support 114 is placed on and is supported by the concave surface 562 of the cross bar support 560 on the bench seat 112, and the back support member 580 is supported by the hooks 588 on the U-shaped channel 582 connected with the back support bar 590.

In light of the various structural details provided above with regard to the adjustable bench assembly 104, cable-pulley system 106, and frame 102, it is to be appreciated the exercise device 100 can be selectively configured to perform various exercises. In one example, the exercise device 100 can be configured for a pull-down exercise with the back support 114 removed and the bench seat 112 positioned along a mid-portion of the seat rail 116. Separate handles or a single lat bar can be connected with first end portions 322 of the second resistance cables 314. As such, a user can sit on the bench seat 112 and pull downward on the handles or lat bar. In another example, the exercise device 100 can be configured to perform an inclined chest press exercise with the back support 114 in an inclined position. Separate handles can be connected with second end portions 324 of the second resistance cables 314. As such, a user can sit on the bench seat 112 while leaning back onto the back support 114 and press his arms outward while grasping the handles. In yet another example, the back support 114 can be removed and the bench seat 112 positioned along the forward end portion of the seat rail 116. With separate handles connected with second end portions 324 of the second resistance cables 314, a user can stand on the base portion 128 of the exercise device 100 while grasping the handles and perform an arm curl exercise. In each of the above examples, the upper and lower pulleys 356, 370 can be selectively positioned along respective upper and lower cross members 294, 284 to adapted the exercise device for the particular exercise that is to be performed so as to suit the size and comfort of a particular user. It is to be appreciated that many additional exercise can be performed on the exercise device than what are shown and described herein.

As discussed above, the exercise device 100 can also include various exercise assemblies or accessories 118 that can be releasably connected with the bench assembly 104 and frame 102. The following provides a description of various examples of some exercise accessories 118, including the previously mentioned squat exercise accessory 124 shown in FIG. 4, which is releasably connectable with the bench seat 112 and seat rail 116. Other exercise accessories 118 include abdominal exercise accessory 122 shown in FIG. 8 as well as the multi-purpose exercise accessory 120 shown in FIGS. 5-7 that can be configured for leg extension, leg curl, and arm curl exercises. As discussed in more detail below, the multi-purpose exercise accessory and the abdominal exercise accessory are both releasably connectable with the forward support member 406.

One embodiment of the squat exercise accessory 124 is shown in FIGS. 4 and 21A-21C. As discussed in more detail below, the squat exercise assembly 124 can be connected with the bench seat 112 when the seat rail 116 is placed in the upright position, as shown in FIGS. 4 and 22A-22C. With the seat rail 116 locked in the upright position, the squat exercise assembly 124 is connected with the wheel car assembly 516 of the bench seat 112. The spring-loaded feature of the bench seat pop-pin 528 is also disabled to allow the bench seat 112 to freely roll back and forth along the length of the seat rail 116. As discussed in more detail below with reference to FIGS. 21A-21C, the squat exercise assembly 124 includes a locking pin 592 adapted to engage a plurality of apertures 594, show in FIGS. 4 and 19A, on the bottom side 438 of the seat rail 116. As such, a user can selectively lock the wheel car assembly 516 and squat exercise accessory 124 at various heights in a plurality of locations along the length of the seat rail. In use, the squat exercise accessory 124 and wheel car assembly 516 are first locked into a desired starting position. The second end portions 324 of the second resistance cables 314 can then be connected with the squat exercise accessory. Next, the second end portions 318 of the first resistance cables 312 are connected with a desired number of resistance rods 110. The user then stands on the base portion 128 of the frame 102 under the squat exercise accessory 124 and presses upward with his legs. The squat exercise accessory 124 also includes a release mechanism 596 that allows the user to disengage the locking pin 592 from the apertures 594 on the bottom side 438 of the seat rail 116. As such, the user can move the squat exercise accessory and bench seat up and down along the seat rail while under load. As discussed in more detail below, the squat exercise accessory can also be configured to prevent the locking pin 592 from disengaging the seat rail 116 until a sufficient upward force is applied to the squat exercise accessory. More particularly, the locking pin 592 will not disengage the seat rail 116 until the bench seat and squat exercise accessory are moved upward a small distance along the seat rail.

Figure 21A:
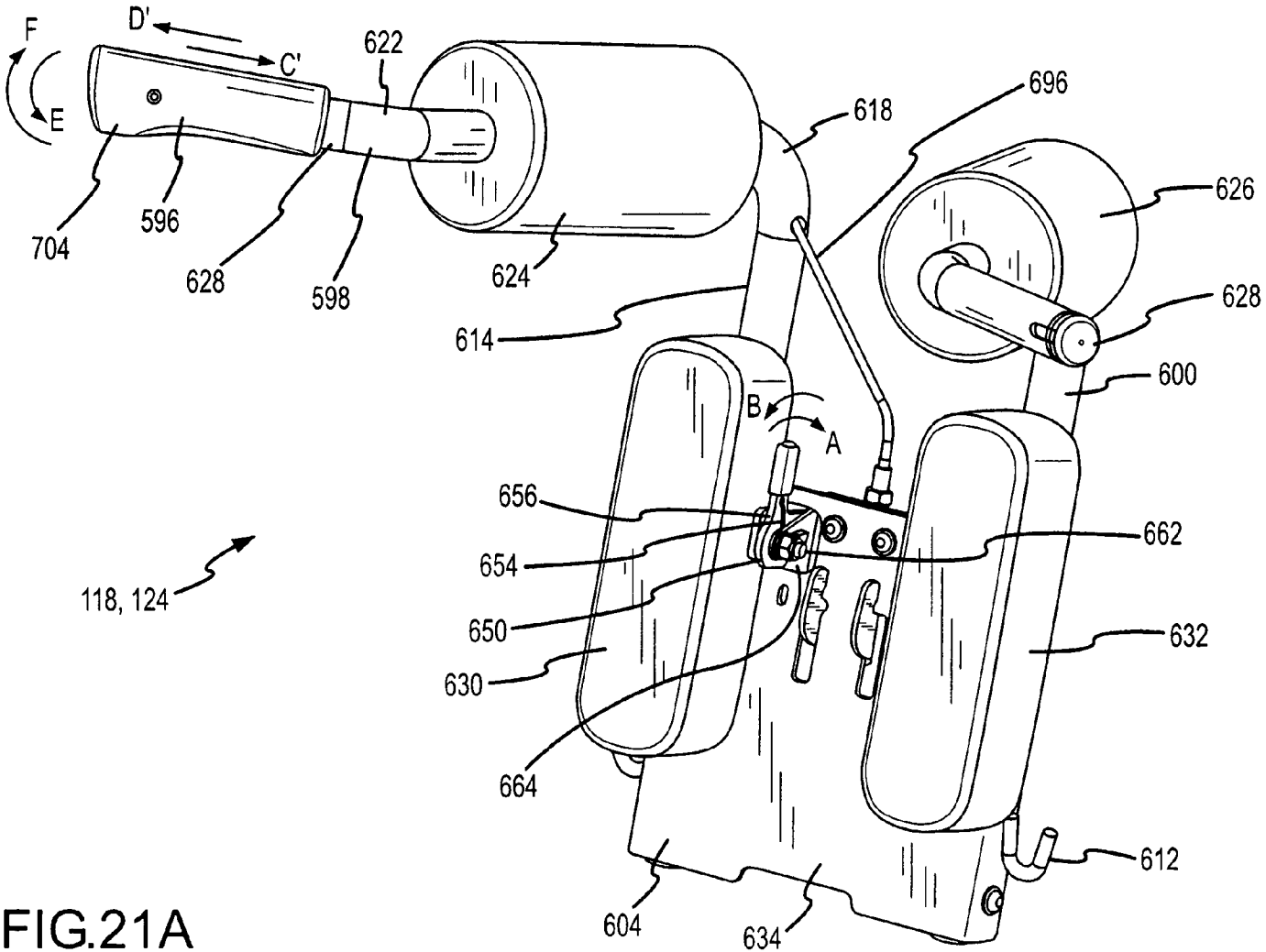
FIG. 21A is a view of the squat exercise accessory showing a front side of a base plate.
Figure 21B:
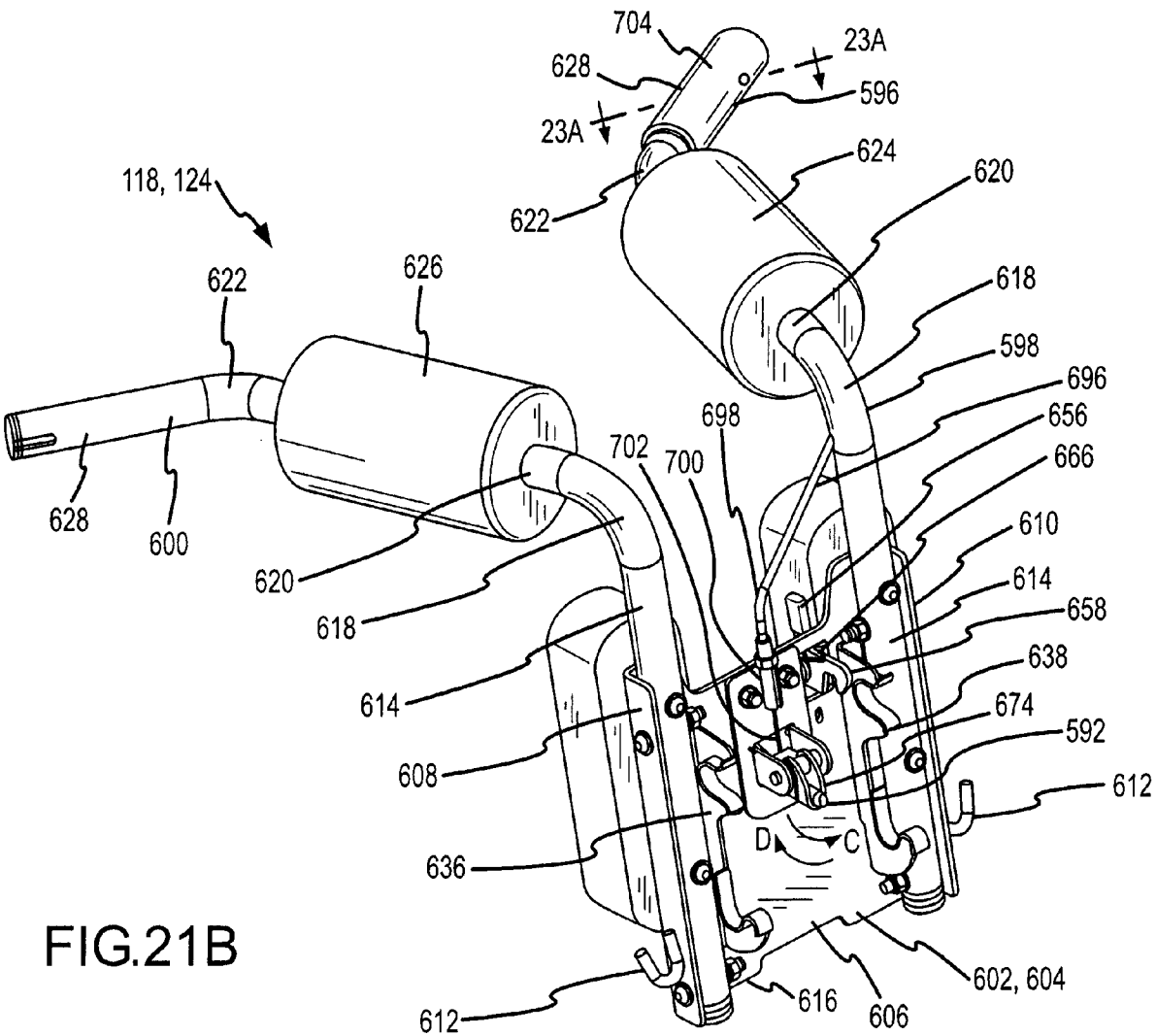
FIG. 21B is a view of the squat exercise accessory showing a rear side of the base plate.
Figure 21C:
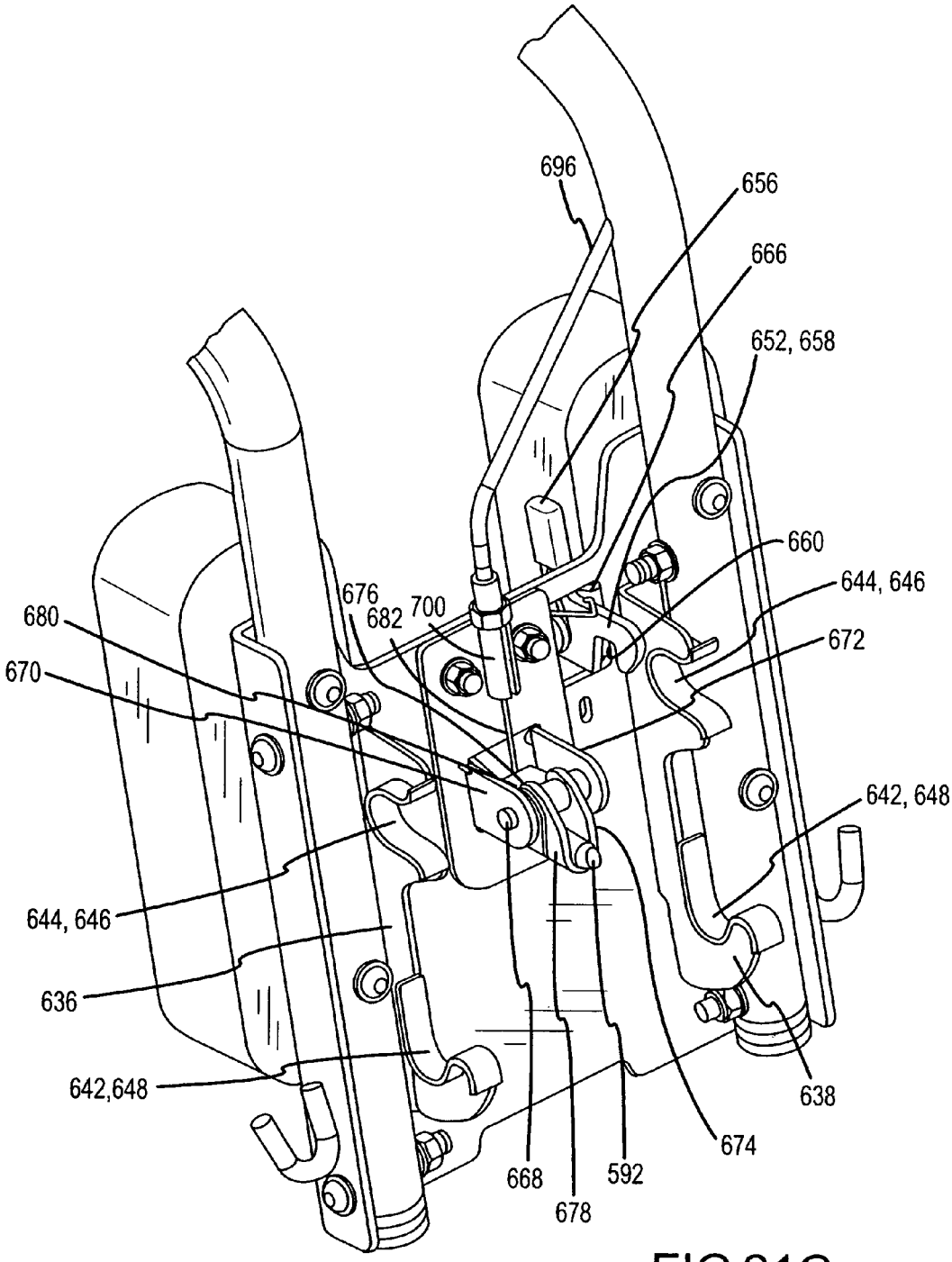
FIG. 21C is a detailed view of the rear side of the base plate shown in FIG. 21B.

As shown in FIGS. 21A-21C, the squat exercise accessory 124 includes first and second shoulder bar members 598, 600 connected with a rear side 602 of a base plate 604. The base plate 604 defines a generally rectangular-shaped base portion 606 with right and left folded side portions 608, 610 extending rearwardly therefrom. Cable hooks 612 extend outwardly from the right and left folded side portions 608, 610 to provide a connection location for the second end portions 372 of the second resistance cables 314. Upright portions 614 of the shoulder bar members 598, 600 extend upward from a bottom edge 616 of the base plate 604 adjacent respective right and left folded side portions 608, 610. From the base plate 604, the upright portions 614 of the shoulder bar members 598, 600 extend upward to first curved portions 618. From the first curved portions 618 of the shoulder bar members 598, 600, pad support portions 620 extend forwardly in a diverging relationship with each other to second curved portions 622. First and second shoulder pads 624, 626 are connected with the pad support portions 620 of the first and second shoulder bar members 598, 600. The shoulder pads provide cushioned surfaces for the user's shoulders during use. Hand grip portions 628 of the shoulder bar members 598, 600 extend from the second curved portions 622 in a further diverging relationship with each other. As shown in FIG. 21 A, the squat exercise accessory also includes first and second back pads 630, 632 connected with a front side 634 of the base plate 604. During use, the back pads 630, 632 provide a cushion for a portion of the user's back adjacent the base plate 604.

As previously mentioned, the squat exercise accessory 124 is adapted to releasably connect with the wheel car assembly 516 of the bench seat 112. Referring to FIGS. 21B and 21C, the squat exercise accessory 124 includes right and left side brackets 636, 638 connected with the rear side 602 of the base plate 604 adjacent the upright portions 614 of the shoulder bar members 598, 600. Rearwardly extending edges 640 of the side brackets each define a lower cup 642 and an upper cup 644. The upper cup 642 is defined by a C-shaped arcuate recess 646 opening in a rearward direction. The lower cup 644 is defined by an upwardly opening hook 648. As discussed in more detail below, when the squat exercise accessory 124 is placed in position to connect with the bench seat 112, the lower and upper cups 642, 644 engage the first and second attachment tubes 564, 566 on the wheel car assembly 516. In particular, the lower cups 642 of the right and left side brackets 636, 638 are adapted to engage the first attachment tube 564 on the wheel car assembly 516 of the bench seat 112, and the upper cups 644 of the right and left side brackets are adapted to engage the second attachment tube 566 on the wheel car assembly, as shown in FIG. 19B.

As shown in FIGS. 21A-21C, the squat exercise accessory 124 includes a lock pawl assembly 650 that is adapted to engage the lock pin 568 on the wheel car assembly 516 to selectively connect the base plate 604 with the bench seat 112. As shown in FIGS. 21 A and 21B, the lock pawl assembly 650 is pivotally connected with the base plate 604 of the squat exercise accessory 124. The lock pawl assembly includes a plate member 652 and a torsional spring member 654. The plate member 652 includes an upwardly extending handle portion 656 and a rearwardly extending hooked portion 658. As shown in FIG. 21B, the hooked portion 658 includes a generally square-shaped notch 660 with a downwardly facing opening. As discussed below, the notch 660 engages the lock pin 568 on the wheel car assembly 516 shown in FIG. 19B when the squat exercise accessory is connected with the bench seat. A bolt 662 pivotally connects the plate member 652 of the lock pawl assembly 650 with a generally square-shaped tab 664 on the front side 634 of the base plate 604. As shown in FIGS. 21A and 21B, the tab 664 is cut from the base plate 604 and folded to extend forward from the front side 634 of the base plate. An aperture 666 in the base plate 604 is defined by the portion of material folded forward to create the tab 664. The hooked portion 658 of the plate member 652 of the lock pawl assembly 650 extends rearwardly from the bolt 662 through the aperture 666 in the base plate 604 and protrudes from the rear side 602 of the base plate. As shown in FIG. 21A, the torsional spring 654 is connected with the plate member 652 of the lock pawl assembly 650 and the base plate 604. The torsional spring 654 is biased to pivot the plate member 652 in the clockwise direction (direction A shown in FIG. 21A), which forces the notch 660 on the hooked portion 658 of the plate member 652 in a downward direction. As discussed below, the torsional spring 654 is biased to maintain the notch 660 on the hooked portion of the plate member in engagement with the lock pin 568 on the wheel car assembly 516.

Figure 22A:
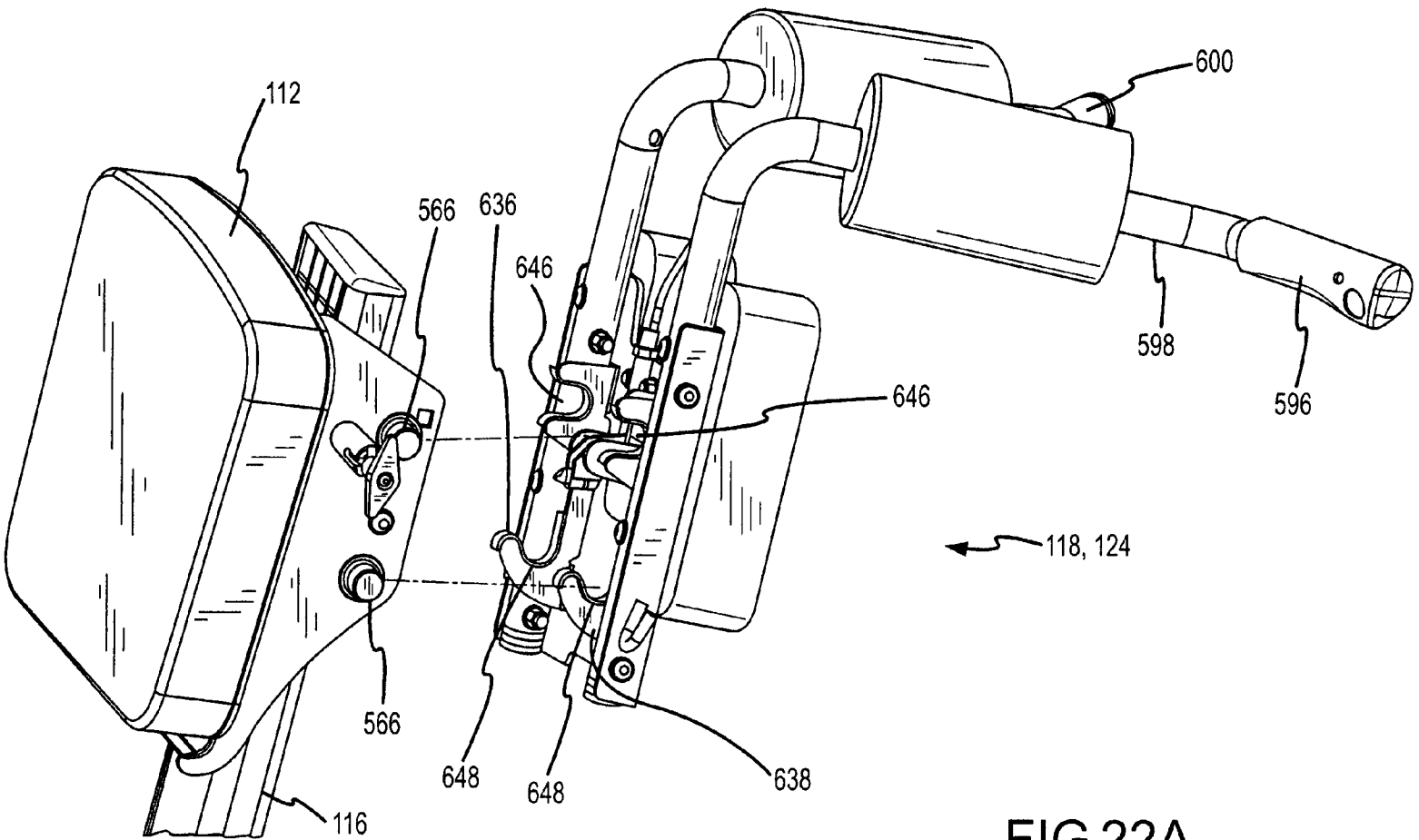
FIGS. 22A-22C show the squat exercise accessory being connected with the bench seat.
Figure 22B:
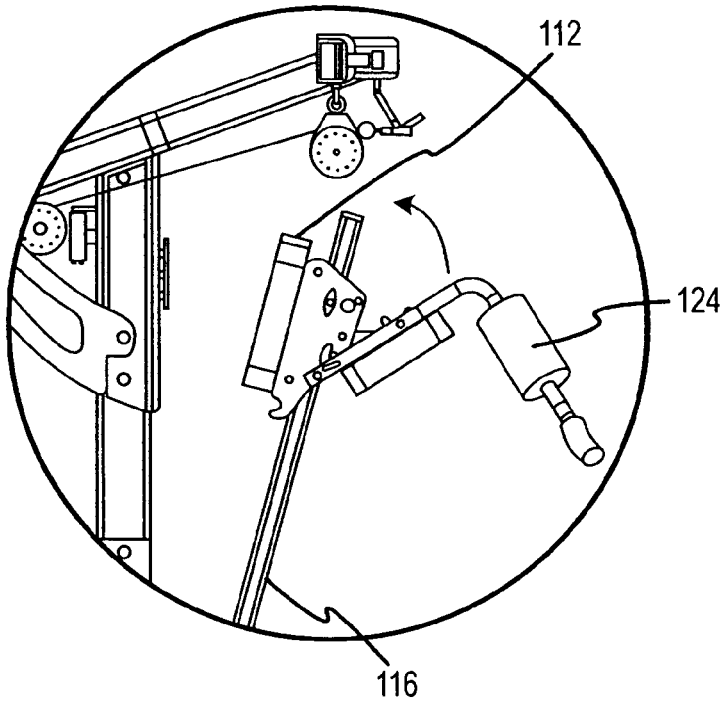
Figure 22C:
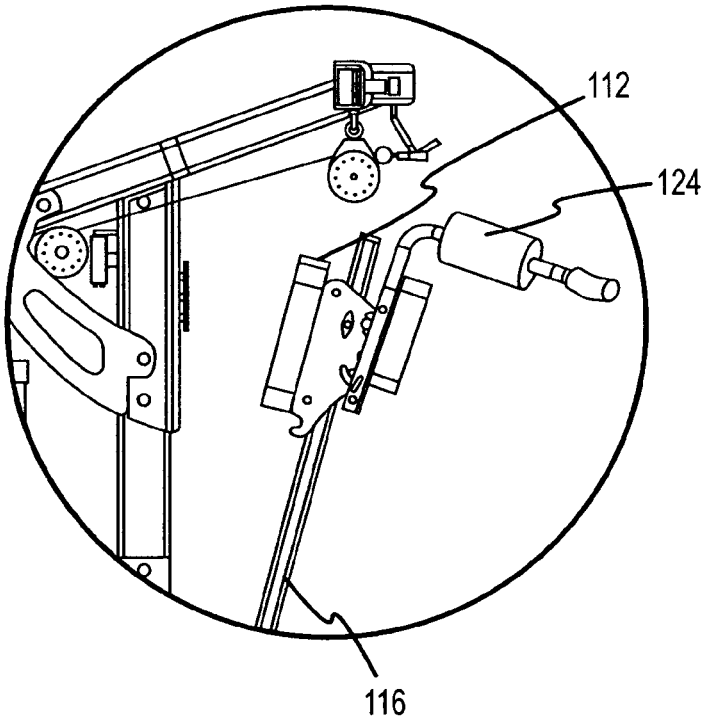

Referring to FIGS. 22A-22C, when connecting the base plate 604 of the squat exercise accessory 124 with the wheel car assembly 516, the base plate is positioned adjacent the wheel car assembly by first placing the opposing end portions of the first attachment tube 566 into the bottom of the hooks 648 in the right and left side brackets 636, 638. The base plate 604 is then pivoted about the first attachment tube 566 until opposing end portions of the second attachment tube 566 are seated in the C-shaped recesses 646 in the right and left side brackets 636, 638. As the squat exercise accessory 124 is pivoted rearwardly about the first attachment tube 564, as shown in FIGS. 22B and 22C, the hooked portion 658 of the spring-loaded lock pawl 650 on the base plate brought into engagement with the lock pin 568 on the wheel car assembly 516. To disconnect the base plate 604 from the bench seat 112, the handle portion 656 of the plate member 652 is moved to pivot the plate member in the counterclockwise direction (direction B shown in FIG. 21A). As such, the hooked portion 658 is lifted upward and the notch 660 is disengaged from the lock pin. The base plate can then be pivoted rearwardly about the first attachment tube and lifted from engagement with the wheel car assembly.

As previously mentioned, the squat exercise accessory 124 includes a spring-loaded locking pin 592 adapted to engage the plurality of apertures 594 on the bottom side 438 of the seat rail 116. As such, the locking pin 592 allows a user to lock the wheel car assembly 516 and squat exercise accessory 124 in different positions at various heights along the seat rail. As shown in FIG. 21C, a locking pin shaft 668 extending between right and left locking pin brackets 670, 672 on the rear side 602 of the base plate 604 pivotally supports an L-shaped pin support member 674. The pin support member 674 includes a cable bracket portion 676 and a pin connection portion 678. The locking pin 592 is connected with and extends rearwardly from the pin connection portion 678 of the pin support member. The longitudinal axis of the locking pin 592 is positioned below the longitudinal axis of the locking pin shaft 668. As such, the locking pin 592 is offset from an axis of rotation defined by the locking pin shaft 668. As discussed in more detail below, the offset relationship between the locking pin 592 and the locking pin shaft 668 helps to prevent the locking pin from disengaging the seat rail 116 until the squat exercise accessory is moved upward along the seat rail a sufficient distance.

As shown in FIG. 21C, a torsional spring 680 is connected with the pin support member 674 and the base plate 604. The torsional spring 680 is biased to force the pin support member 674 to pivot in a counterclockwise direction (direction C shown in FIG. 21B), which tends to force the locking pin 592 in a rearward direction. As such, the torsional spring 680 is biased to force the locking pin 592 into engagement with the bottom side 438 of the seat rail 116. As discussed in more detail below, the degree of rotation of the locking pin member in direction C is limited by a locking pin cable 682 connected between the cable bracket portion 676 of the pin support member 674 and the release mechanism 596 on the hand grip portion 628 of the first shoulder bar member 598. When the squat exercise accessory 124 is connected with the wheel car assembly 516 of the bench seat 112, the torsional spring 680 forces the locking pin 592 against the bottom side 438 of the seat rail 116 and into engagement with one of the plurality of apertures 594 located therein.

Figure 23A:
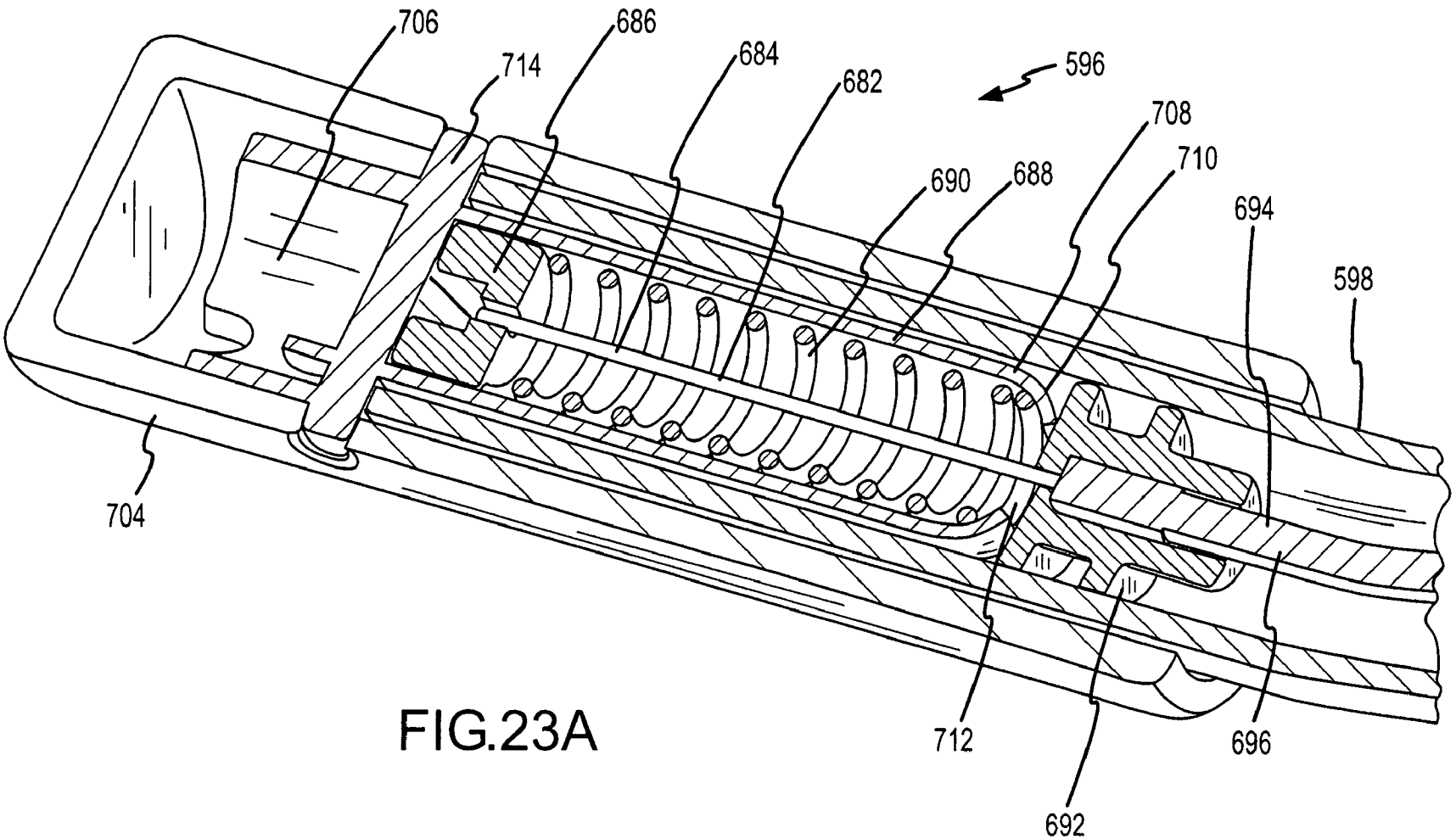
FIG. 23A is a cross sectional view of a release mechanism taken along lines 23A-23A in FIG. 21B.

As previously mentioned, the release mechanism 596 is connected with the pin support member 674 through the locking pin cable 682. The user can actuate the release mechanism 596 to pull on the locking pin cable 682, which pivots the pin support member 674 clockwise (direction D shown in FIG. 21B) to disengage the locking pin 592 from the seat rail 116. As shown in FIG. 23A, a first end portion 684 of the locking pin cable 682 is connected with a cable end keeper 686 inside the hand grip portion 628 of the first shoulder bar member 598. As discussed in more detail below, the cable end keeper 686 is operably connected with a guide piston 688 through a compression spring 690. From the cable end keeper 686, the locking pin cable 682 extends rearward through a first cable stop 692 and into a first end portion 694 of a conduit 696. The locking pin cable 682 and conduit 696 extend rearward through the second curved portion 622 and pad support portion 620 of the first shoulder bar member 598. From the pad support portion 620, the locking pin cable and conduit extend through the first curved portion 618 and into the upright portion 614 of the first shoulder bar member 598. As shown in FIG. 21B, the locking pin cable 682 and conduit 696 exit the upright portion 614 of the first shoulder bar member 598 and extend downward toward the pin support member 674. A second end portion 698 of the conduit 696 is connected with a second cable stop 700. A second end portion 702 of the locking pin cable 682 extends from the second cable stop 700 and connects with the cable bracket portion 676 of the pin support member 674. Although the release mechanism is described and depicted as being associated with the first shoulder bar member, it is to be appreciated that the release mechanism on other embodiments is associated with the second shoulder bar member.

As shown in FIGS. 21A, 21B, and 23A, the release mechanism 596 includes a grip housing 704 partially enclosing the hand grip portion 628 of the first shoulder bar member 598. As discussed in more detail below, the grip housing 704 is adapted to slide back and forth along a length of the hand grip portion, which in turn, engages and disengages the locking pin 592 with the seat rail 116. The hand grip portion 628 is hollow and partially encloses the guide piston 688. As previously mentioned, the compression spring 690 operably connects the guide piston 688 with the cable end keeper 686 connected with the first end portion 684 of the locking pin cable 682. Movement of the guide piston 688 in a direction away from the second curved portion 622 (direction D' in 21A) of the first shoulder arm member 598 causes the compression spring 690 to compress against the cable end keeper 686, which in turn, pulls the locking pin cable 682, causing the pin support member 674 to pivot and disengage the locking pin 592 from the seat rail 116.

As shown in FIG. 23A, the compression spring 690 is connected between the guide piston 688 and the cable end keeper 686 inside of the hand grip portion 628 of the first shoulder bar member 598. The first end portion 694 of the conduit 696 is connected with the first cable stop 692, and the first end portion 684 of the locking pin cable 682 extends from the conduit 696 and the first cable stop 692 to connect with the cable end keeper 686. A set screw (not shown) extending through the hand grip portion 628 of the first shoulder bar member 598 and connects with the first cable stop 692 to hold the first cable stop in a fixed position within the first shoulder bar member. The guide piston 688 is cylindrically-shaped with an open forward end portion 706 and rear end 708 partially enclosed by a rear side 710. In particular, the rear side 710 of the guide piston 688 includes an aperture 712 through which the locking pin cable 682 extends. The compression spring 690 extends along the inside of the guide piston 688 between the rear side 710 of the guide piston and the cable end keeper 686. As such, when the guide piston 688 is moved in a direction toward the cable end keeper 686, the compression spring 690 is compressed. As the compression spring is compressed, forces are applied against the cable end keeper 686, which in turn, pulls against the locking pin cable 682 to disengage the locking pin 592 from the bottom side of the seat rail 116.

Figure 23B:
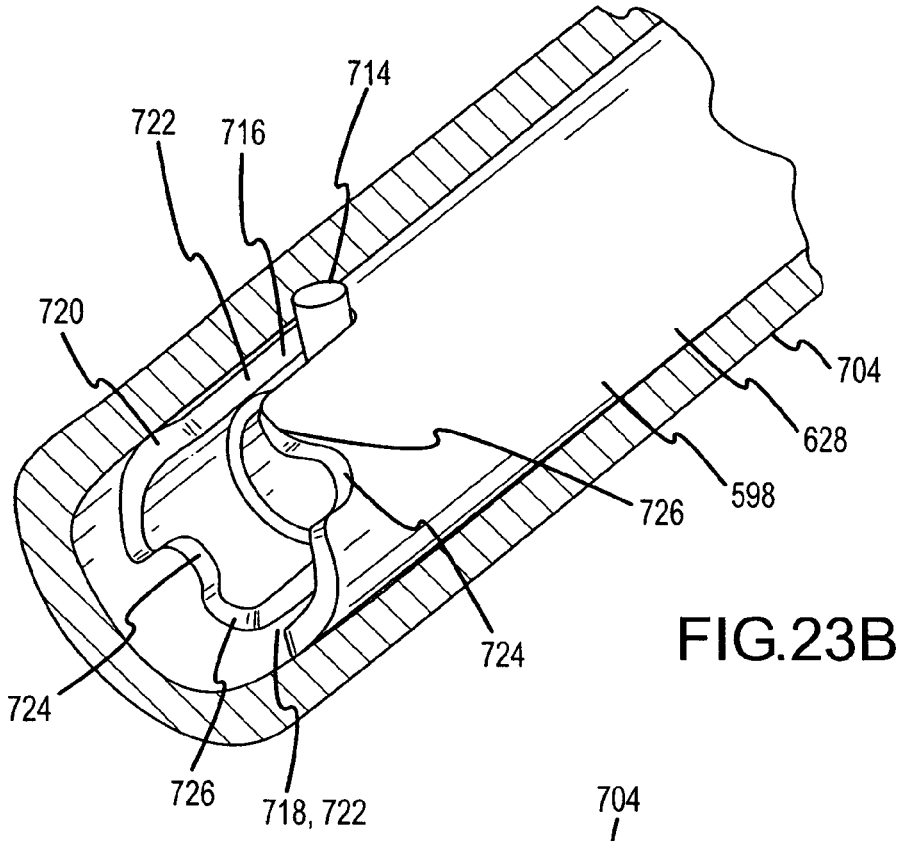
FIG. 23 B is a detailed view of the release mechanism of FIG. 23A shown in a rearward orientation with a spring-loaded feature of a locking pin enabled.
FIG. 23C is a detailed view of the release mechanism of FIG. 23A shown in a forward orientation with the spring-loaded feature of the locking pin disabled.
Figure 23C:
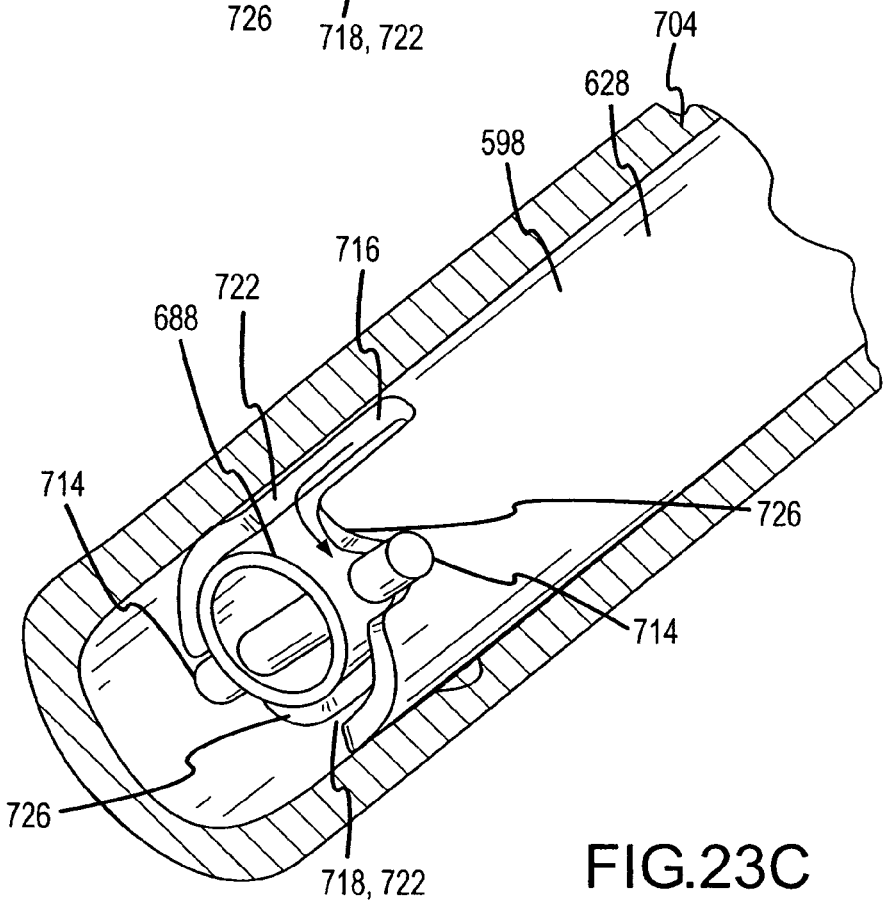

As shown in FIG. 23A, the guide piston 688 is adapted to be slidingly received within the hand grip portion 628 of the first shoulder bar member 598. As shown in FIGS. 23A-23C, the grip housing 704 is connected with the guide piston 688 through opposing end portions of a driving pin 714. More particularly, the opposing end portions of the driving pin 714 extend outward from opposing sides of the forward end portion 706 of the guide piston 688. As shown in FIGS. 23A-23C, the driving pin 714 also extends through first and second hook slots 716, 718 in opposing sides of a forward end 720 of the hand grip portion 628 the first shoulder bar member 598 and are connected with the grip housing 704. As such, a sufficient force applied to the grip housing 704 toward the forward end 720 of the hand grip portion (direction D' in FIG. 21A) will cause the driving pin 714 to move along the hook slots 716, 718 in the same direction D'. At the same time, the guide piston 688 moves in direction D' along the inside of the hand grip portion 628. As the guide piston moves forward, the compression spring 690 is compressed between the rear end 708 of the guide piston 688 and the cable end keeper 686. As such, the cable end keeper 686 pulls the first end portion 684 of the locking pin cable 682 in direction D'. As discussed below, the force exerted by compression spring 690 on the cable end keeper 686 and locking pin cable 682 can overcome the biasing force exerted by the torsional spring 680 on the pin support member 674. Therefore, the pin support member 674 will pivot to disengage the locking pin 592 from the seat rail 116. When the force is released from the grip housing 704, the compression spring 690 will push against rear side 710 of the guide piston 688 and the cable end keeper 686, which turn, moves the guide piston and grip housing in an opposite direction (direction C' in FIG. 21A) to an original starting position. At the same time, the torsional spring 680 can pivot the pin support member 674 to move the locking pin 592 back into engagement with the seat rail 116, which pulls the first end portion 684 of the locking pin cable 682 and cable end keeper 686 in direction C'.

As discussed in more detail below, the release mechanism 596 can also be configured to allow a user to disable the spring-loaded feature of the locking pin 592. With the spring-loaded feature disabled, the locking pin 592 does not automatically engage the apertures 594 in the bottom side 438 of the seat rail 116 when the user releases the grip housing 704. As such, the squat exercise accessory 124 can be connected with the wheel car assembly 516 to freely roll back and forth along the length of the seat rail 116 while exercising without the need to hold the grip housing 704 in a position to maintain the locking pin in disengagement from the seat rail.

As discussed below, the spring-loaded feature of the locking pin 592 is enabled or disabled based on the positions of the opposing end portions of the driving pin 714 within the first and second hook slots 716, 718 in opposing sides of the hand grip portion 628 of the first shoulder bar member 598. As shown in FIGS. 23B and 23C, the first and second hook slots 716, 718 each include an elongated portion 722 connected with an arcuate recessed portion 724. An arcuate extension 726 is defined near the transition between the arcuate recessed portion 724 and the elongated portion 722. The arcuate recessed portion 724 of the first hook slot 716 is downwardly adjacent to the elongated portion 722, and the arcuate recessed portion 724 of the second hook slot 718 is upwardly adjacent to the elongated portion 722. As such, a sufficient force applied to the grip housing 704 toward the forward end 720 of the hand grip portion 628 of the first shoulder bar member 598 (direction D' in FIG. 21A) will move the driving pin 714 in direction D' along the elongated portions 722 of the hook slots 716, 718. Once the driving pins are moved past the arcuate extensions 726 of each hook slot, the user can turn or twist the grip housing 704 in direction E shown in FIG. 21A, which also pivots the guide piston 688 and driving pin 714 in direction E. Pivoting the driving pin 714 in direction E aligns the driving pins with the recessed portions 724 of the hook slots 716, 718. Releasing the grip housing allows the compression spring 690 to push the guide piston 688 in an opposite direction (direction C' in FIG. 21A) to place the driving pins into engagement with the arcuate recessed portions of the hook slots as shown in FIG. 23C, which holds the guide piston in a forward position. When the guide piston 688 is held in a forward position inside the hand grip portion 628 of the first shoulder bar member 598, the force exerted by the compression spring 690 against the guide piston 688 and the cable end keeper 686 causes the cable end keeper to pull the locking pin cable 682 with enough force to overcome the bias force exerted by the torsional spring 680 on the locking pin support member 674. As such, the pin support member is held in a pivotal position that maintains the locking pin 592 in disengagement from the seat rail 116.

The spring-loaded feature of the locking pin 592 can be reenabled by first moving the grip housing 704 in direction D' shown in FIG. 21A far enough such that the opposing end portions of the driving pin 714 are located forward of the arcuate extensions 724 on the hook slots 716, 718. The grip housing can then be turned or twisted in direction F shown in FIG. 21A to realign the driving pins with the elongated portions 722 of the hook slots 716, 718. The grip housing 704 can then be released and the compression spring 690 will automatically push the guide piston 688 and grip housing 704 in direction C', which also moves the driving pin 714 in direction C' along the elongated portions 722 of the hook slots, as shown in FIG. 23B. Because the arcuate extensions 726 on the hook slots 716, 718 require the user to move the grip housing 704 forward in direction D' before twisting the grip housing in direction F to reenable the spring-loaded feature of the driving pin 592, the arcuate extensions 726 help prevent a user from inadvertently bumping the grip housing and re-engaging the locking pin with the seat rail while performing a squat exercise.

As previously mentioned, the squat exercise assembly 124 is also configured with a safety feature to help prevent the locking pin 592 from disengaging from the seat rail 116 while under load until the squat exercise assembly is moved upward slightly. This safety feature helps to ensure that locking pin is not inadvertently disengaged from the seat rail while under load, which could allow the squat exercise assembly 124 and bench seat 112 to rapidly roll downward along the seat rail 116. Operation of the safety feature of the squat exercise accessory is described below with reference to the previously described structural details of the exercise device and associated figures.

With the locking pin 592 engaged with one of the apertures 594 on the bottom side 438 of the seat rail 116, a user can connect the second end portions 324 of the second resistance cables 314 with the cable hooks 612 on the base plate 604 of the squat exercise accessory 124. The second end portions 318 of the first resistance cables 312 can then be connected with a desired number of resistance rods 110. At this point, the second resistance cables exert a downward forces on the squat exercise accessory 124 and wheel car assembly 112, but the engagement of the locking pin 592 with the seat rail 116 prevents the wheel car assembly from rolling downward along the seat rail. In addition, the downward forces exerted on the squat exercise accessory and bench seat from the resistance cables as well as gravity creates a frictional force between the locking pin 592 and an edge of the aperture 594 in the seat rail 116 with which locking pin is engaged. The frictional force is exerted on the locking pin 592 is greater than the force exerted by the compression spring 690 on the cable end keeper 686 when the grip housing 704 is moved in a forward position (direction D' in FIG. 21A). As such, movement of the grip housing 704 in direction D' does not cause the locking pin 592 to disengage from the seat rail 116 until an upward force is applied to the squat exercise assembly, which reduces or eliminates the friction force.

In addition to the frictional forces exerted on the locking pin 592 described above, the offset relationship between the locking pin 592 and the axis of rotation defined by the locking pin shaft 668 discussed above with reference to FIG. 21C helps prevent the locking pin 592 from disengaging from the seat rail until the squat exercise accessory 124 and bench seat 112 are moved upwardly along the seat rail a sufficient distance. More particularly, because the locking pin 592 is offset from the locking pin shaft 668, applying tension to the locking pin cable 682 through the release mechanism 596 to pivot pin support member 674 clockwise (direction D shown in FIG. 21B) causes a distal end portion of the locking pin 592 to swing downward. As such, disengaging the locking pin 592 from one of the apertures 594 in the bottom side 438 of the seat rail 116 would require sufficient tension be applied to the locking pin cable 682 to pivot the pin support member 674 clockwise (direction D shown in FIG. 21B), which in turn, would the cause the locking pin to lift the squat exercise accessory and bench seat upward a small distance as the locking pin swings downward against the side edge of the seat rail aperture. Therefore, the locking pin 592 is more easily disengaged from the seat rail aperture 594 when the squat exercise accessory 124 and bench seat 112 are moved upward a sufficient distance to allow the locking pin to swing downward as the pin support member is pivoted clockwise (direction D shown in FIG. 21B).

Use of the squat exercise accessory 124 is described below with reference to the previously described structural details of the exercise device and associated figures. With a desired amount of resistance selected and with the resistance cables connected with the squat exercise accessory, a user can stand on the base portion 128 of the frame 102 facing in a forward direction with his right shoulder under the first shoulder pad 624 and his left shoulder under the second shoulder pad 626. The user then begins to press upward against the shoulder pads and moves the grip housing 704 on the first shoulder bar member 598 to disengage the locking pin 592 from the seat rail 116. At this point, the user can continue to hold the grip housing 704 to prevent the locking pin 592 from engaging with the seat rail 116, or he can twist the hand grip housing to disable the spring-loaded feature of the locking pin. The user then presses with his legs, squatting up and down, to move the squat exercise accessory and bench seat up and down along the seat rail. Once the user is finished with the squat exercise, he can release the grip housing 704 and allow the locking pin 592 to automatically reengage one of the apertures 594 on the seat rail 116 to lock the squat exercise accessory and bench seat at a desired height along the length of the seat rail.

In another scenario, the user can first move the grip housing 704 forward on the hand grip portion 628 (direction D' in FIG. 21A) of the first shoulder bar member 598 and twist the grip housing in direction E shown in FIG. 21A to place the opposing end portions of the driving pin 714 within the recessed portions 724 of the hook slots 716, 718. Because the grip housing 704 and guide piston 688 are being held in a forward direction on the hand grip portion of the first shoulder bar member, the compression spring 690 between the guide piston 688 and the cable end keeper 686 is compressed, which exerts a tension force on the locking pin cable 682. However, the tension force in the locking pin cable created by the compression of the compression spring is not large enough to disengage the locking pin 592 from one of the apertures 594 on the bottom side 438 of the seat rail 116, as discussed above. At this point, the user can stand on the base portion 128 of the frame 102 facing in a forward direction with his shoulders under the shoulder pads 624, 626. Next, the user begins to press upward against the shoulder pads. As the user moves the bench seat 112 and squat exercise accessory 124 upward along the seat rail 116, the tension force in the locking pin cable 682 automatically disengages the locking pin 592 from the seat rail 116. The locking pin remains disengaged from the seat rail 116 until such time when the user manipulates the grip housing 704 on the shoulder bar member to reenable the spring-loaded feature of the locking pin, which allows the locking pin to re-engage the seat rail.

Although the seat rail 116 depicted and described herein is substantially straight, it is to be appreciated that in other embodiments, the entire length of the seat rail is curved. In still other embodiments, the seat rail includes a combination of straight and curved portions. In addition, as shown in FIGS. 3 and 4, the seat rail leans forward slightly from the upright portion 126 of the frame 102. In other embodiments the seat rail can be configured to stand in the upright position at different angles. For example, in one embodiment of the present invention, the seat rail is tilted forward to define a 15° angle from vertical. As such, the seat rail can be configured to match a user's natural movements while performing the squat exercise.

As previously mentioned, the exercise device 100 can also include the multi-purpose exercise accessory 120 shown in FIGS. 5-7 and others. The embodiment of the multi-purpose exercise assembly 120 shown in FIGS. 5-7 is releasably connectable with the forward support member 406 of the frame 102. As described in more detail below, the multi-purpose exercise assembly can be configured for leg extension and leg curl exercises, as shown in FIGS. 5 and 6, respectively. In addition, the multi-purpose exercise assembly can be configured to perform arm curl exercises, as shown in FIG. 7.

Figure 24A:
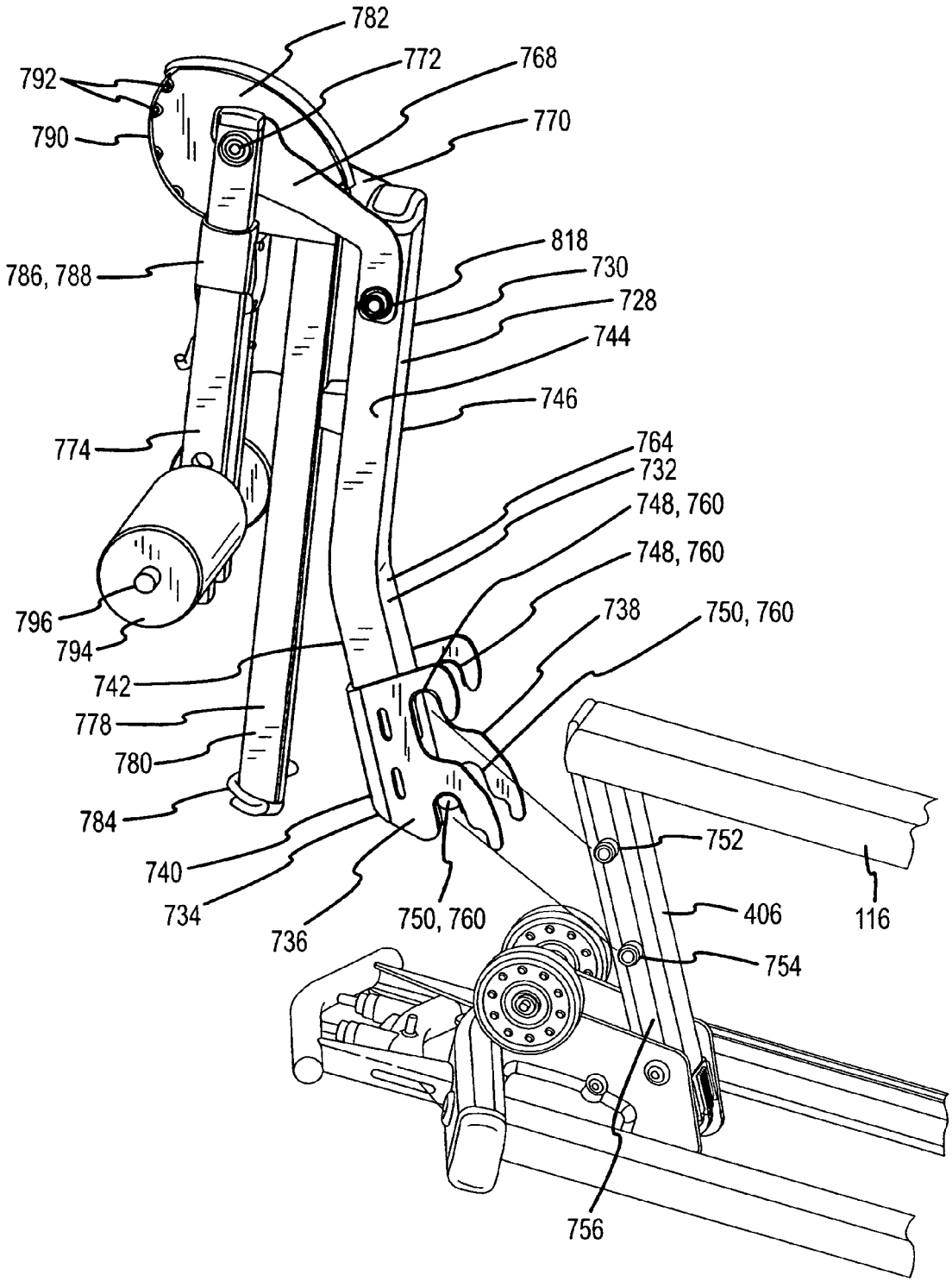
FIG. 24A is a view of the multi-purpose exercise accessory being connected with the forward support member.
Figure 24B:
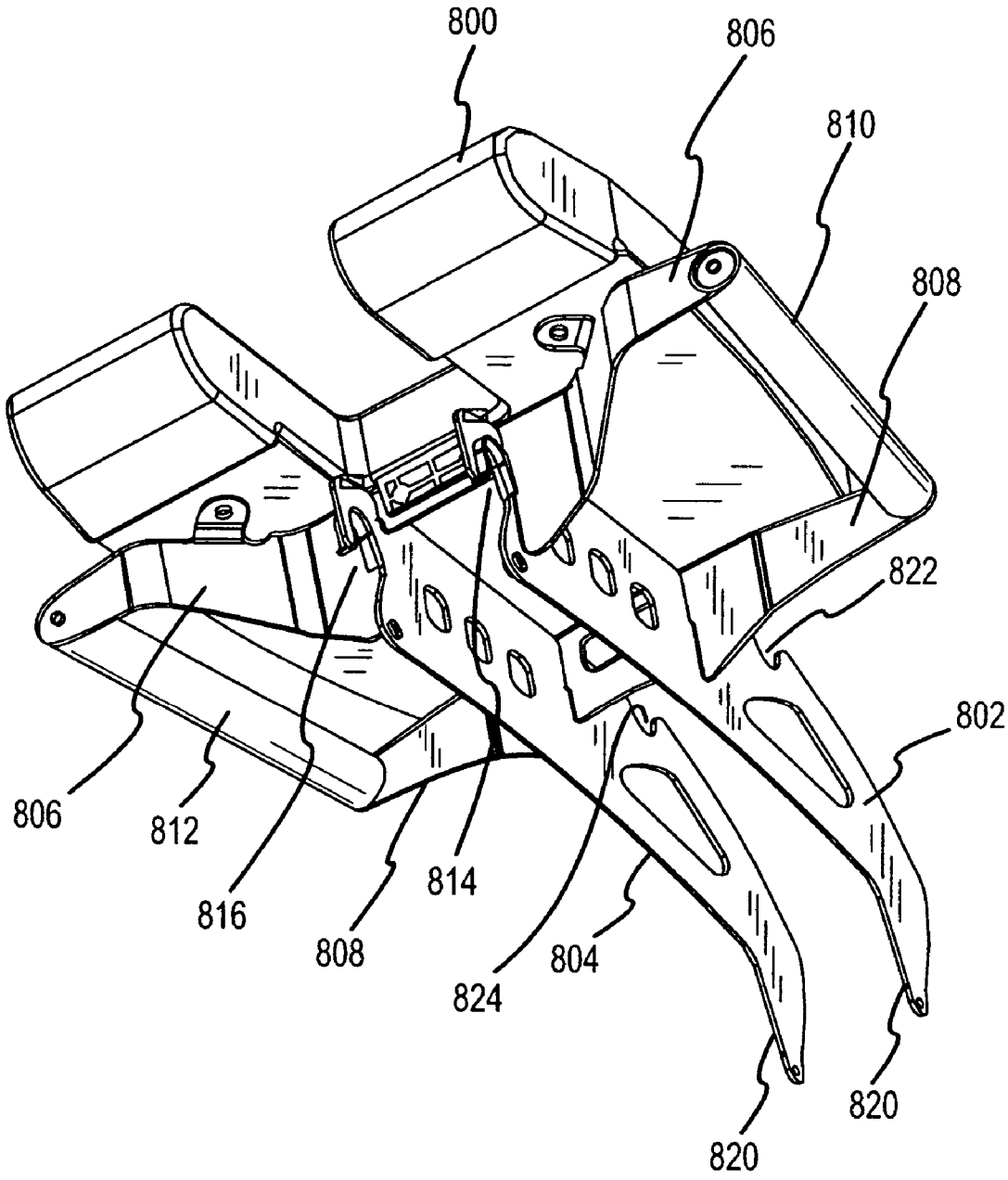
FIG. 24B is a detailed view of a leg extension seat assembly.
Figure 24C:
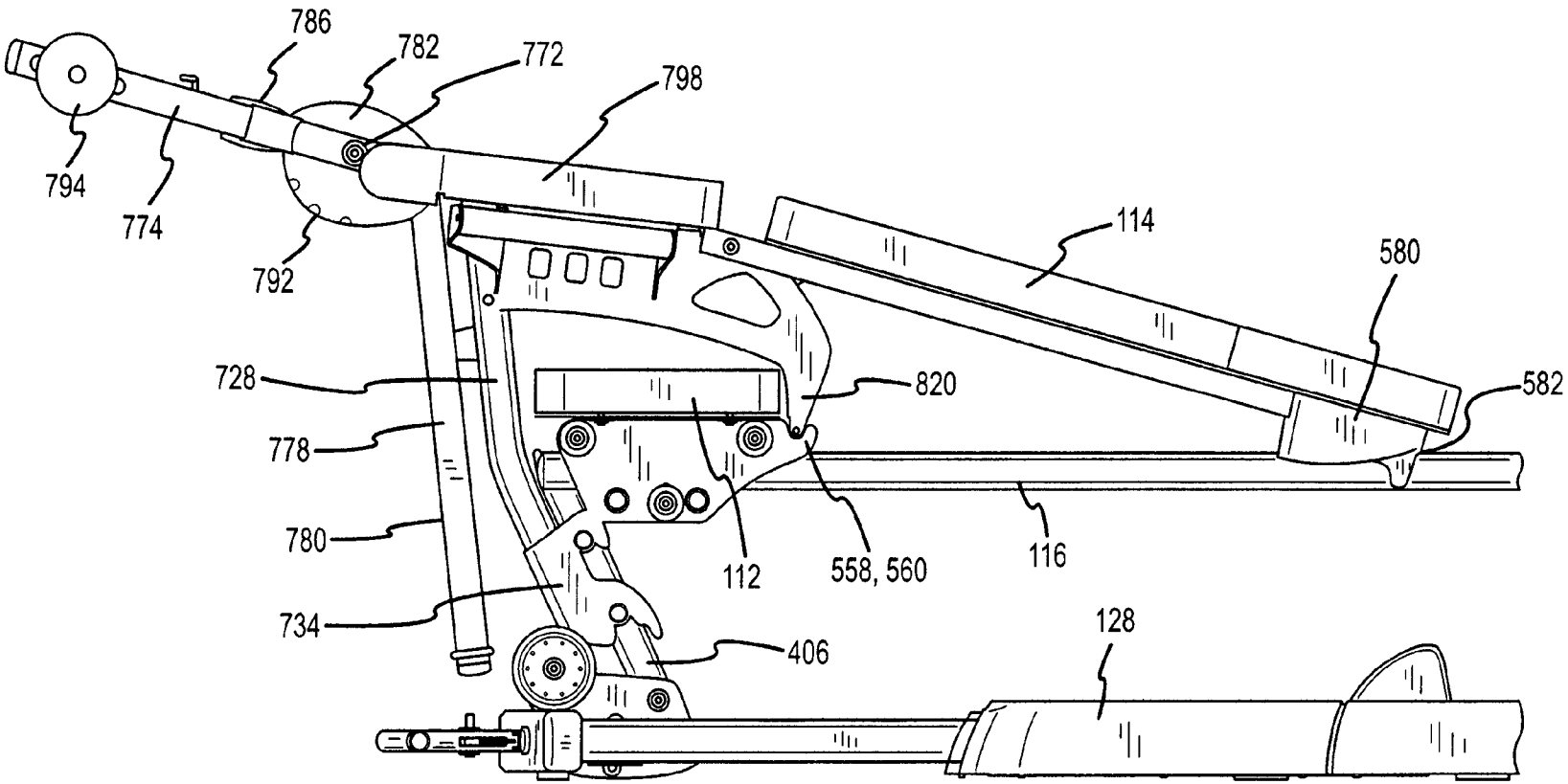
FIG. 24C is a right side view of the exercise device with the multi-purpose exercise accessory configured for leg curl exercises.
Figure 24D:
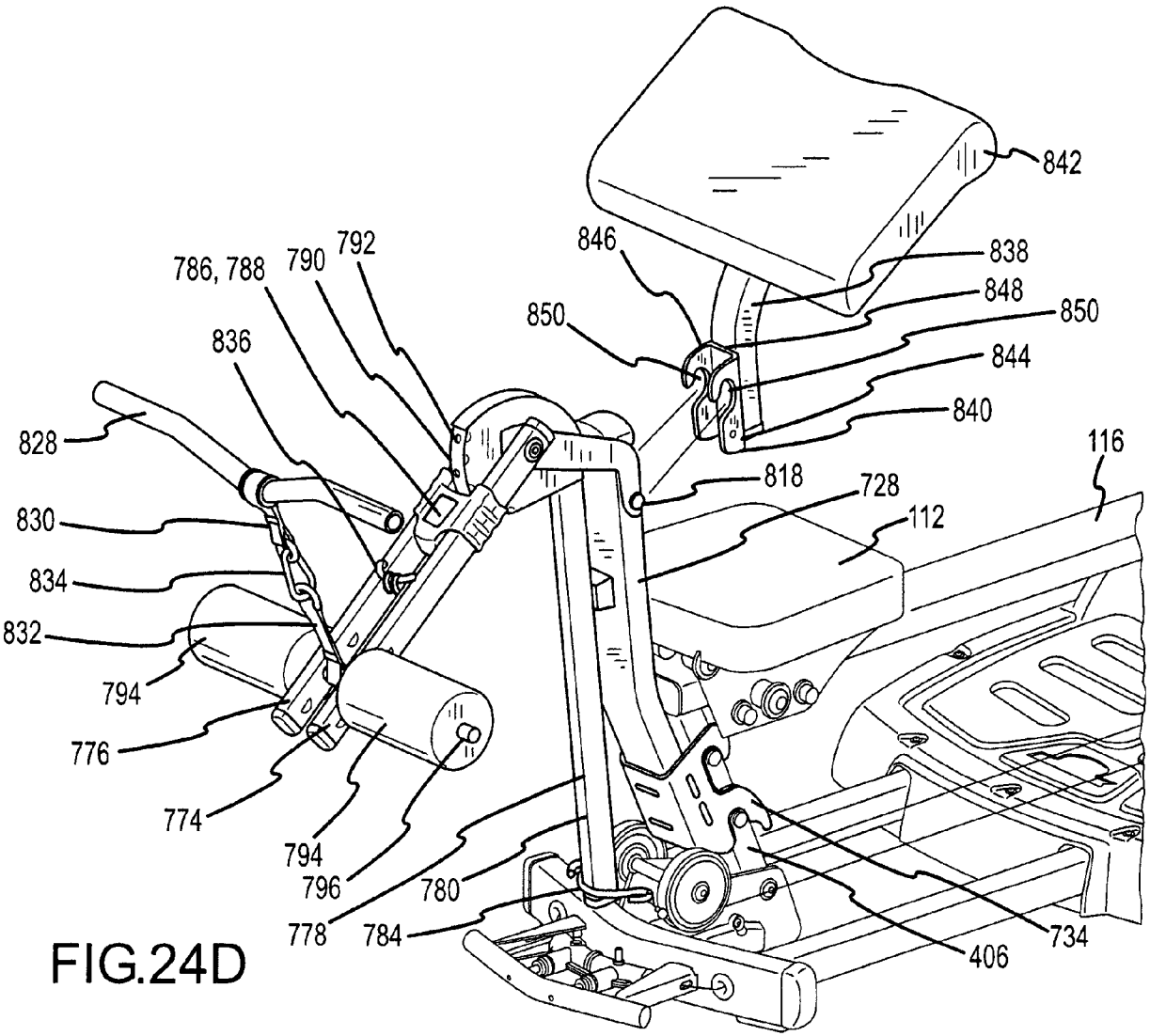
FIG. 24D is a view of an arm support assembly being connected with the multi-purpose exercise accessory.

As shown in FIGS. 24A, 24C, and 24D, the multi-purpose exercise assembly 120 includes a main support member 728 having an upper end portion 730 angularly offset from a lower end portion 732. An attachment hook member 734 is connected with the lower end portion 732 of the main support member 728. The attachment hook member has a U-shaped cross section defined by right and left sides 736, 738 connected with and separated by a base side 740. As shown in FIG. 24A, the base side 740 of the attachment hook member 734 is adjacent a front side 742 of the main support member 728, and the right and left sides 736, 738 of the attachment hook member extend rearwardly from the base side 740 adjacent to right and left sides 744, 746 of the main support member 728. The right and left sides 736, 738 of the attachment hook member each include upper and lower hooks 748, 750 adapted to connect with upper and lower protrusions or knobs 752, 754 extending from the right and left sides 756, 758 of the forward support member 406. The upper and lower hooks 748, 750 each define a downward facing opening 760 with an arcuate recessed portion adapted to receive the knobs 752, 754 on the forward support member 406. As shown in FIG. 24A, 24C, and 24D, the main support member 728 is connected with the forward support member 406 by lifting the main support member to place a rear side 764 of the lower end portion 732 adjacent to a front side 766 of the forward support member 406. The upper hooks 748 are aligned with the upper knobs 752 and the lower hooks 750 are aligned with the lower knobs 754. The main support member 728 is then moved downward along the forward support member 406 to place the upper and lower hooks into engagement with the upper and lower knobs, respectively. When the main support member 728 is connected with the forward support member 406, forces applied to the main support member in the forward and rearward directions are resisted through the engagement of the upper hooks 748 with the upper knobs 752 and the engagement of the lower hooks 750 with the lower knobs 754. To disconnect the main support member 728 from the forward support member 406, the main support member is lifted upward to disengage the upper and lower hooks from the upper and lower knobs and the main support member is lifted away from the forward support member.

Although the multi-purpose exercise accessory 120 described above is engaged with the forward support member 406 through four hooks connected with four knobs, it is to be appreciated that other embodiments can utilize more or less than four hooks and four knobs. It is to also be appreciated that the hook and knob configuration can be reversed from that which is described above. For example, in other embodiments, the main support member can include protrusions or knobs that are adapted to engage hooks on forward support member. In yet other embodiments, the hooks can define upwardly facing openings. Still other embodiments can include hooks with undersized recesses adapted to snap connect with the knobs.

The multi-purpose exercise accessory illustrated in FIGS. 24A, 24C, and 24D, includes right and left pivot plates 768, 770 extending forwardly from the right and left sides 744, 746 of the main support member 728. A pivot axle 772 connected between the right and left pivot plates pivotally supports right and left pivot members 774, 776 and a resistance arm 778. The resistance arm 778 includes a downwardly extending arm portion 780 and an axle engagement portion 782 with an axle aperture adapted to receive the pivot axle 772. A double cable hook 784 is connected with a lower end portion of the resistance arm 778 and provides a location to connect the first end portions 316 of the first resistance cables 312. In use, the first end portions 316 of the first resistance cables 312 are connected with the double cable hook 784 on the resistance arm, and a user applies forces to the right and left pivot members, causing the resistance arm and pivot members to pivot back and forth about the pivot axle.

As shown in FIGS. 24A, 24C, and 24D, the multi-purpose exercise accessory 120 also includes a pop-pin 786 that selectively connects the right and left pivot members 774, 776 with the resistance arm 778. As such, the pop-pin 786 allows the pivotal position of the right and left pivot members relative to the resistance arm to be adjusted to place the multi-purpose exercise accessory in different configurations to perform various exercises, such as leg curls, leg extensions, and arm curls. As shown in FIGS. 24A, 24C, and 24D, upper end portions of the pivot members 774, 776 extending along opposing sides of the axle engagement portion 782 of the resistance arm 778 are pivotally connected with opposing end portions of the pivot axle 772. As such, the pivot members can pivot about the pivot axle 772 relative to the resistance arm 778. The pop-pin 786 is supported between the pivot members 774, 776 and selectively connects the pivot members with the resistance arm 778.

As shown in FIGS. 24A, 24C, and 24D, the pop-pin 786 includes a grip housing 788 enclosing a spring operably connected with a pin. The spring in the pop-pin 786 acts to forced the pin against an arcuate edge 790 of the axle engagement portion 782 of the resistance arm 778. More particularly, the pop-pin 786 is adapted to engage a plurality of apertures 792 located in an arcuate edge of the axle engagement portion of the resistance arm to selectively lock the pivot members 774, 776 in a desired pivotal position relative to the resistance arm 778. The pop-pin 786 can be disengaged from the resistance arm 778 by sliding the grip housing 788 along the pivot members in a direction away from the pivot axle 772. Once the pop-pin 786 is disengaged from the resistance arm 778, the pivot members 774, 776 can pivot about the pivot axle 772 to a desired position relative to the resistance arm. Once the grip housing is released, the spring in the pop-pin will automatically reengage the pop-pin with one of the apertures 792 on the axle engagement member 782, locking the pivot members 774, 776 into the desired pivotal position relative to the resistance arm 778. When the pop-pin 786 is engaged with the one of the apertures 792 in the resistance arm 778, the pivot members and the resistance arm are connected together and can pivot together about the pivot axle 772.

As shown in FIG. 24A, 24C, and 24D, the multi-purpose exercise assembly 120 also includes a pair of roller pads 794 rotatably supported on opposing end portions of a roller pad support member 796 extending through the right and left pivot members 774, 776. The roller pads 794 are adapted to support a user's legs when performing leg extension and leg curl exercises.

As shown in FIG. 5, the multi-purpose exercise accessory 120 and exercise device 100 are configured for leg extension exercises. More particularly, the bench seat 112 is locked into a forward position on the seat rail 116 and the back support 114 is removed. As discussed in more detail below, a leg extension seat assembly 798 is connected with the main support member 728 and the bench seat 112. With the first end portions 316 of the first resistance cables 312 connected with the double cable hook 784 on the resistance arm 778, a user sits on the leg extension seat assembly 798 with his legs bent and the front sides of his ankles placed behind in the roller pads 794. The user then exercises by extending and bending his legs at his knees by pivoting his ankles upward and downward, respectively.

As shown in FIGS. 5, 24B, and 24C, the leg extension seat assembly 798 releasably connects with the main support member 728 of the multi-purpose exercise assembly 120 and the bench seat 112 to provide a place for a user to sit when performing leg extension exercises. As shown in FIG. 24B, the leg extension seat assembly 798 includes a seat cushion 800 supported by right and left support plates 802, 804. Forward and rear handle brackets 806, 808 are connected with and extend outward from the right and left support plates 802, 804. A right handle 810 is connected between the forward and rear handle brackets 806, 808 connected with the right support plate 802, and a left handle 812 is connected between the forward and rear handle brackets 806, 808 connected with the left support plate 804. Right and left hooks 814, 816 are defined in the front ends of the right and left support plates 802, 804, respectively. The hooks 814, 816 are adapted to connect with protrusions or knobs 818 extending from the right and left sides 744, 746 of the main support member 728. The rear ends of the right and left support plates 802, 804 each include downward extensions 820 adapted to be supported by the bench seat hooks 558 and cross bar support 560 extending rearwardly from the wheel car assembly 516 described above.

As shown in FIGS. 6 and 24C, the exercise device 100 and multi-purpose exercise accessory 120 are configured for leg curl exercises. The exercise device 100 is set up in essentially the same manner as when configured for leg extension exercises, with the bench seat 112 locked into a forward position on the seat rail 116 and the leg extension seat assembly 798 connected with the main support member 728 and the bench seat 112. However, when the exercise device 100 is configured for leg curl exercises, the back support 114 is connected with the exercise device and supported in a slightly inclined position between the leg extension seat assembly 798 and the seat rail 116. More particularly, the cross bar 578 on the back support 116 is supported by and received in right and left notches 822, 824 located in the upper edges of the rear end portions of the right and left support plates 802, 804 of the leg extension seat assembly 798. The U-shaped channel 582 on the back support engages the seat rail 116 to support the rear end portion of the back support. The previously described pop-pin 786 on the pivot members 774, 776 is disengaged from the resistance arm 778 and the pivot members are pivoted upward about the pivot axle 772 to about a 10 o'clock starting position (as viewed from the right side of the exercise device). The pop-pin 786 is then reengaged with the resistance arm 778, locking the pivot members 774, 776 into the desired starting position. To perform a leg curl exercise, a user lies face down on the leg extension seat assembly and back support with his legs straightened and the backs of his ankles placed under the roller pads. The user then exercises by bending and straightening his legs at his knees by pivoting his ankles upward and downward, respectively.

As shown in FIGS. 7 and 24D, the exercise device 100 is configured for arm curl exercises. The exercise device is set up in essentially the same manner as when configured for leg extension exercises, with the bench seat 112 locked into a forward position on the seat rail 116 and the multi-purpose exercise accessory 120 connected with the forward support member 406. However, when the exercise device is configured for arm curls, the leg extension seat assembly 798 is removed and an arm support assembly 826 is connected with the upper end portion of the main support member 728 of the multi-purpose exercise accessory 120. In addition, the right and left pivot members 774, 776 are pivoted to and locked in a starting position that is shown to be about 8 o'clock as viewed from the right side of the exercise device. Further, a handle bar 828 is connected with the roller pad support member 796 extending between the right and left pivot members 774, 776. To perform an arm curl exercise, a user places sits on the bench seat with the backs of his arms supported by the arm support assembly and grasps the handle bar. The user then exercises by bending and straightening his arms at his elbows by pivoting his forearms upward and downward, respectively.

As shown in FIG. 24D, a first strap 830 extending from the handle bar 828 is releasably connected with a second strap 832 extending upward from the roller pad support member 796. More particularly, a snap hook 834 releasably connects the first strap 830 with the second strap 832. As such, the handle bar 828 can be removed from the multi-purpose exercise accessory when not required. When the handle bar is removed, the second strap 832 can be stored by connecting the second strap with a storage hook 836 connected with the left pivot member 776. As shown in FIG. 24D, the arm support assembly 826 includes a curved support tube 838 extending upward from a hook member 840 to connect with a bottom side of an arm pad 842. The hook member 840 has a U-shaped cross section defined by right and left sides 844, 846 extending forward from a base side 848. Hooks 850 are defined in the forward edges of the right and left sides 844, 846. The hooks 850 are adapted to receive the knobs 818 extending from the right and left sides 744, 746 of the main support member 728 of the multi-purpose exercise accessory 120. As such, the arm support assembly 826 is releasably connected with the multi-purpose exercise assembly by engaging the hook member with the main support member to place the knobs in engagement with the hooks.

Although the arm support assembly is engaged with the main support member 728 through two hooks connected with two knobs, it is to be appreciated that other embodiments can utilize more or less than two hooks and two knobs. It is to also be appreciated that the hook and knob configuration can be reversed from that which is described above. For example, in other embodiments, the arm support assembly can include protrusions or knobs that are adapted to engage hooks on main support member. In yet other embodiments, the hooks can define upwardly facing openings. Still other embodiments can include hooks with undersized recesses adapted to snap connect with the knobs.

Figure 25A:
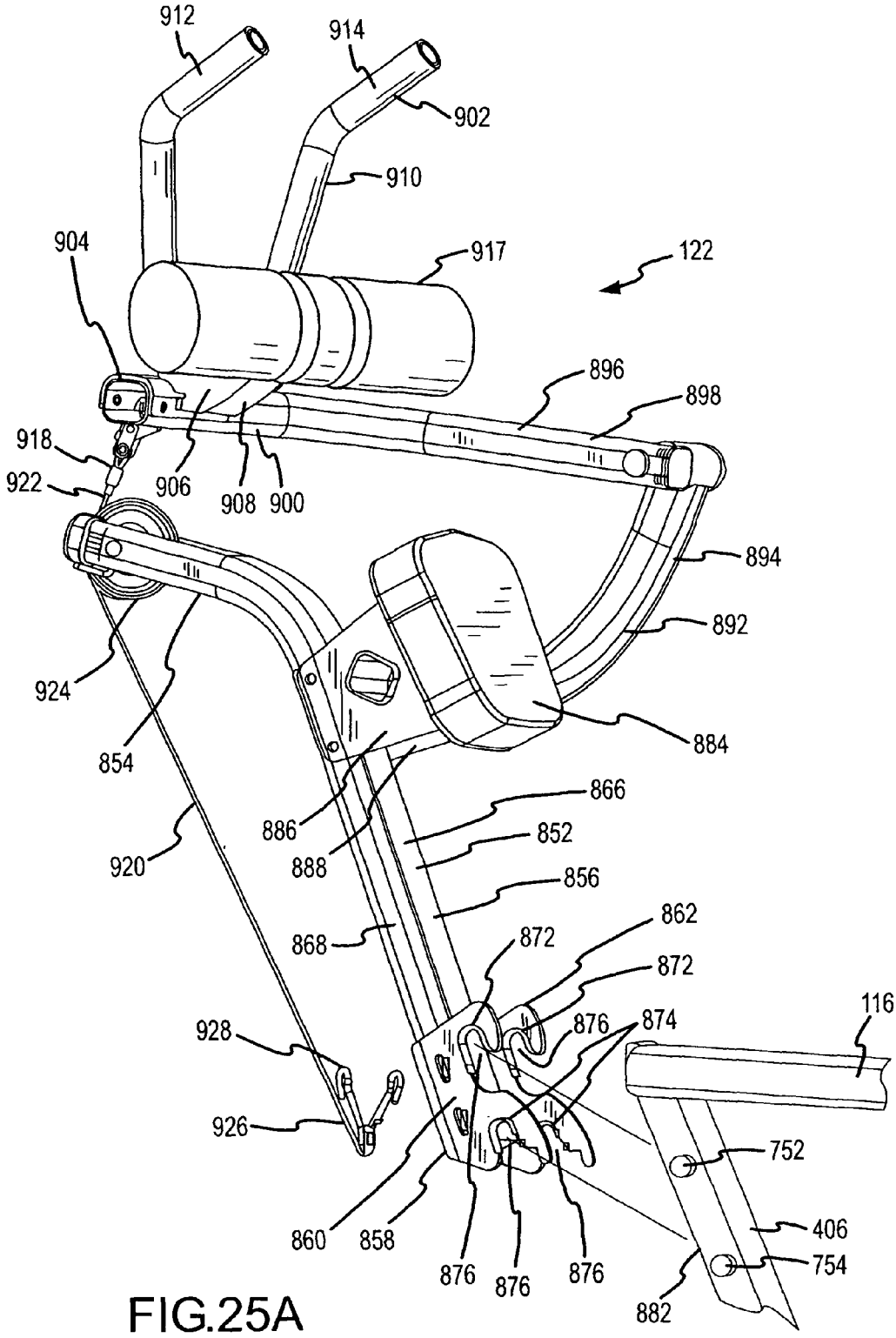
FIG. 25A is right side isometric view of the abdominal exercise accessory being connected with a front support member.
Figure 25B:
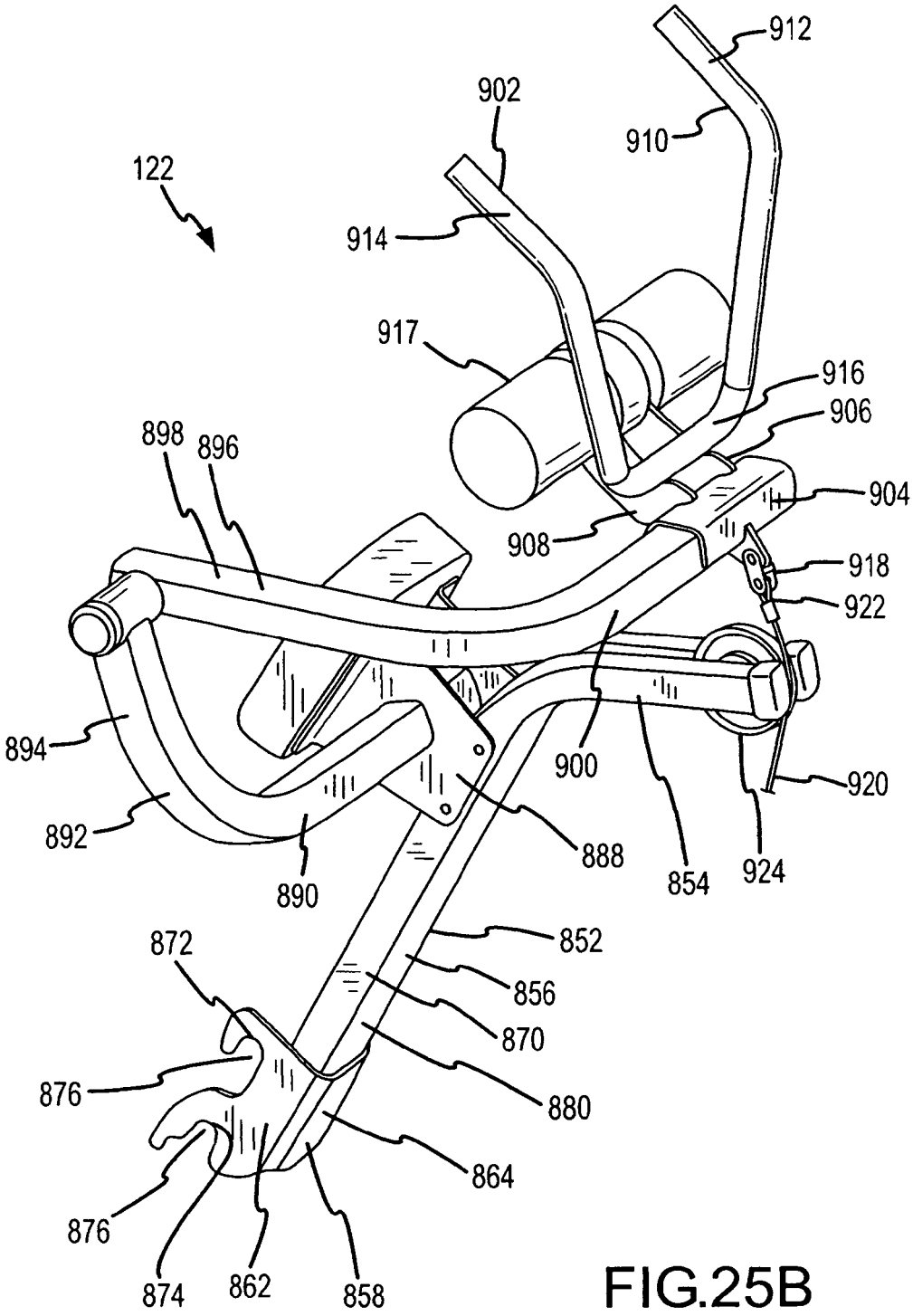
FIG. 25B is left side isometric view of the abdominal exercise accessory shown in FIG. 25A.

As previously mentioned, the exercise device 100 can also include the abdominal exercise accessory 122 shown in FIGS. 8, 25A, and 25B. The embodiment of the abdominal exercise accessory 122 shown in FIGS. 8, 25A, and 25B is releasably connectable with the forward support member 406 of the frame 102. The abdominal exercise assembly includes a main support member 852 having a forward extending upper end portion 854 angularly offset from an upwardly extending lower end portion 856. An attachment hook member 858, similar to the attachment hook used with the multi-purpose exercise assembly, is connected with the lower end portion 856 of the main support member 852. As such, the attachment hook member 858 has a U-shaped cross section defined by right and left sides 860, 862 connected with and separated by a base side 864. As shown in FIGS. 25A and 25B, the base side 864 of the attachment hook member 858 is adjacent a front side 866 of the main support member 852 and the right and left sides 860, 862 of the attachment hook member extend rearwardly from the base side 864 adjacent to right and left sides 868, 870 of the main support member. The right and left sides 860, 862 of the attachment hook member each include upper and lower hooks 872, 874 adapted to connect with the upper and lower protrusions or knobs 752, 754 extending from the right and left sides 756, 758 of the forward support member 406. The upper and lower hooks 872, 874 each define a downward facing opening 876 with an arcuate recessed portion adapted to receive the knobs 752, 754 on the forward support member 406.

As shown in FIG. 25A, the main support member 852 is connected with the forward support member 406 by lifting the main support member to place a rear side 880 of the lower end portion 856 adjacent to the front side 766 of the forward support member 406. The upper hooks 872 are aligned with the upper knobs 752 and the lower hooks 874 are aligned with the lower knobs 754. The main support member 852 is then moved downward along the forward support member 406 to place the upper and lower hooks into engagement with the upper and lower knobs, respectively. When the main support member 852 is connected with the forward support member 406, forces applied to the main support member in the forward and rearward directions are resisted through the engagement of the upper hooks 872 with the upper knobs 752 and the engagement of the lower hooks 874 with the lower knobs 754. To disconnect the main support member 852 from the forward support member 406, the main support member is lifted upward to disengage the upper and lower hooks 872, 874 from the upper and lower knobs 752, 754, and the main support member is lifted away from the forward support member.

Although the abdominal exercise accessory 122 is engaged with the forward support member 406 through four hooks connected with four knobs, it is to be appreciated that other embodiments can utilize more or less than four hooks and four knobs. It is to also be appreciated that the hook and knob configuration can be reversed from that which is described above. For example, in other embodiments, the main support member can include protrusions or knobs that are adapted to engage hooks on forward support member. In yet other embodiments, the hooks can define upwardly facing openings. Still other embodiments can include hooks with undersized recesses adapted to snap connect with the knobs.

As shown in FIGS. 25A and 25B, the abdominal exercise assembly 122 includes a back cushion 884 supported by right and left back cushion brackets 886, 888 extending rearward from the main support member 852. A lower end portion 890 of a pivot support member 892 is connected with and extends leftward from the right back cushion bracket 886 and through the left back cushion bracket 888. The pivot support member 892 curves upward from the left back cushion bracket 888 to define an upwardly extending upper end portion 894. A pivot member 896 is pivotally connected with the upper end portion 894 of the pivot support member 896. The pivot member includes a rear portion 898 angularly offset from a forward portion 900. More particularly, the rear portion 898 of the pivot member 896 extends forward from the pivotal connection with the pivot support member 892 and transitions to the rightward extending forward portion 900.

As shown in FIGS. 25A and 25B, a handle bar assembly 902 is connected with the forward portion 900 of the pivot member 896. The handle bar assembly 900 includes a U-bracket 904 connected with the forward portion 900 of the pivot member 896. Right and left handle brackets 906, 908 extending rearward from the U-bracket 904 support a U-shaped handle bar 910 defined by first and second grip portions 912, 914 connected with and separated by a base portion 916. A roller pad 917 can also be supported by the right and left handle brackets 906, 908.

As shown in FIGS. 25A and 25B, a first cable hook 918 extends downward from the forward portion 900 of the pivot member 896 and provides a connection for an ab cable 920. When the abdominal exercise accessory 122 is connected with the exercise device 100, the ab cable 920 extends downward from a first end portion 922 connected with the first cable hook 918 and over an ab pulley 924 rotatably supported by the upper end portion 854 of the main support member 852. From the ab pulley 924, the ab cable 920 extends downward to a second end portion 926 connected with a second cable hook 928. The second cable hook 928 provides connection points for the first end portions 316 of the first resistance cables 312.

As shown in FIG. 8, the exercise device 100 is configured to perform abdominal exercises using the abdominal exercise assembly. The bench seat 112 is locked into a forward position on the seat rail 116. Although the back support 114 is shown as installed on the seat rail 116, it need not be. The first end portions 316 of the first resistance cables 312 are connected with the second cable hook connected with the second end portion of the ab cable. A user sits on the bench seat 112 and engages the abdominal exercise assembly 122 with his back adjacent the back pad 884 and grasps the handle bar 910 with his right hand on the first grip portion 912 and with his left hand on the second grip portion 914. The user can then exercise his abdominal muscles by bending his body by pivoting his torso downward toward and upward from his thighs.

As shown in FIG. 2 and other figures, the exercise device 100 can also include a DVD player 930 supported between the right and left upright members 274, 276 of the frame 102. As such, a user can watch movies and/or listen to music while exercising. In one embodiment, the exercise device includes an instructional video demonstrating proper use of the exercise device that can be watched by the user while operating the exercise device.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. An exercise device comprising:

a frame;

a resistance system operably coupled with the frame;

a rail arranged in a substantially vertical orientation;

an actuation assembly including:

a wheel car assembly movably supported on the rail to move along the rail during exercise use of the exercise device;

a seat connected to the wheel car assembly; and an exercise accessory releasably connected to the wheel car assembly, the exercise accessory including a base plate and at least two shoulder bar members joined to the base plate with each of the at least two shoulder bar members including a hand grip portion;

at least one cable operably coupled between the actuation assembly and the resistance system; and the wheel car assembly, the seat, and the exercise accessory move in conjunction along the rail during exercise use of the exercise device when the exercise accessory is connected to the wheel car assembly.

2. The exercise device of claim 1, wherein the substantially vertical orientation of the rail defines a 15° angle from vertical.

3. The exercise device of claim 2, wherein the 15° angle is toward a user engaged with the actuation assembly while performing squat exercises.

4. The exercise device of claim 1, wherein the substantially vertical orientation of the rail is sufficient for performing squat exercises.

5. The exercise device of claim 1, wherein the resistance system comprises a plurality of resiliently flexible rods.

6. The exercise device of claim 1, wherein the exercise accessory includes a grip housing operably connected with a pin to selectively engage apertures in the rail.

7. The exercise device of claim 6, further comprising a first spring operably connected with the pin and arranged to exert a first force on the pin to engage the rail.

8. The exercise device of claim 7, further comprising a second spring operably connected between the grip housing and the pin, wherein movement of the grip housing in a first direction causes the second spring to exert a second force on the pin to disengage the rail.

9. The exercise device of claim 8, wherein movement of the grip housing in the first direction does not disengage the pin from the rail until a third force is applied to the actuation device to move the actuation assembly along the rail.

10. The exercise device of claim 1, further comprising a lock pawl assembly releasably connecting the exercise accessory with the wheel car assembly.

11. The exercise device of claim 1, wherein the rail includes a plurality of apertures and wherein the actuation assembly includes a pin adapted to selectively engage the plurality of apertures to lock the actuation assembly at a plurality of positions along the rail.

12. The exercise device of claim 11, further comprising a release mechanism operably connected with the pin to selectively engage and disengage the pin with the rail.

13. The exercise device of claim 12, wherein the exercise accessory includes a grip housing and wherein the release mechanism is operably connected with the grip housing.

14. The exercise device of claim 1, wherein the rail is pivotally connected with the frame to pivot relative to the frame.

15. The exercise device of claim 14, further comprising:

a locking mechanism connected with the frame; and wherein the rail defines a first end portion and a second end portion, the first end portion pivotally connected with the frame; and wherein the locking mechanism is adapted to selectively connect with the rail between the first end portion and the second end portion to hold the rail in the substantially vertical orientation.

16. The exercise device of claim 15, wherein the locking mechanism comprises a handle operably connected with at least one pawl adapted to selectively engage an aperture in the rail.

17. The exercise device comprising:

a frame including a first upright member, a second upright member spaced apart from the first upright member, and an axle connected to, and positioned between, the first and second upright members;

a resistance system supported on the frame;

a rail extending from the frame and connected to the frame to pivot between at least a substantially horizontal position and an upright position;

a first member supporting the rail;

an actuation device configured to actuate the resistance mechanism and removably coupled with the first member by way of at least one hook adapted to engage at least one protrusion;

a locking mechanism pivotally connected to the axle; and the locking mechanism configured to selectively connect with the rail between a first end portion and a second end portion of the rail in the upright position.

18. The exercise device of claim 17, wherein the at least one protrusion is connected with the first member.

19. The exercise device of claim 17, wherein the at least one hook is connected with the first member.

20. The exercise device of claim 17, wherein the first member is pivotally connected with the frame.

21. The exercise device of claim 17, wherein the resistance system comprises a plurality of resiliently flexible rods.

22. The exercise device of claim 17, further comprising a seat movingly supported on the rail to move along the rail.

23. The exercise device of claim 22, wherein the seat is rollingly supported on the rail.

24. The exercise device of claim 17, wherein the at least one hook comprises four hooks and the at least one protrusion comprises four protrusions.

25. The exercise device comprising:

a frame;

a resistance system supported on the frame;

a rail extending from the frame;

a first member supporting the rail; and an actuation device removably coupled with the first member by of at least one hook adapted to engage at least one protrusion, wherein the actuation device comprises;

a support member adapted to releasably connect with the first member;

a resistance arm adapted to operably connect with the resistance system;

at least one pivot member connected with the resistance arm; and wherein the resistance arm and the at least one pivot member are pivotally connected with the support member.

26. The exercise device of claim 25, wherein the support member includes the at least one hook and the first member includes the at least one protrusion.

27. The exercise device of claim 25, further comprising:

a pop-pin supported by the at least one pivot member and adapted to selectively connect the at least one pivot member with the resistance arm at a plurality of pivotal positions relative to the resistance arm.

28. The exercise device of claim 25, further comprising:

an arm support assembly releasably connected with the support member.

29. The exercise device of claim 28, wherein the arm support assembly comprises a second support member having at least one hook adapted to releasably connect with at least one protrusion on the support member.

30. The exercise device of claim 25, further comprising a handle connected with the at least one pivot member.

31. The exercise device of claim 30, further comprising:

a first strap connected with the at least one pivot member;

a second strap connected with the handle;

a connector member releasably connecting the second strap with the first strap; and a storage hook connected with the at least one pivot member adapted to support the first strap.

32. An exercise device comprising:

a frame;

a resistance system supported on the frame;

a rail extending from the frame;

a first member supporting the rail; and an actuation device removably coupled with the first member by of at least one hook adopted to engage at least one protrusion, wherein the actuation device comprises;

a support member adapted to releasably connect with the first member; and a handle member pivotally connected with the support member and adapted to operably connect with the resistance system.

33. The exercise device of claim 32, wherein the support member includes the at least one hook and the first member includes the at least one protrusion.

34. The exercise device of claim 17, wherein the actuation device includes a means for actuating the resistance system when performing leg extension exercises using the actuation device.

35. The exercise device of claim 17, wherein the actuation device includes a means for actuating the resistance system when performing leg curl exercises using the actuation device.

36. The exercise device of claim 17, wherein the actuation device includes a means for actuating the resistance system when performing arm curl exercises using the actuation device.

37. The exercise device of claim 17, wherein the actuation device includes a means for actuating the resistance system when performing abdominal exercises using the actuation device.

38. An exercise device comprising:

a frame including a first base frame pivotally coupled with a second base frame, the first base frame including a first end portion and a second end portion distal the first end portion;

a resistance system supported on the first base frame;

a bench frame assembly supported on the second base frame and pivotally coupled with the frame;

the second base frame is configured to pivot between at least a substantially horizontal position and an upright storage position;

at least one first wheel connected to the first base frame at the first end portion of the first base frame;

at least one second wheel connected to the first base frame at the second end portion of the first base frame;

when the second base frame is positioned in the upright storage position, the at least one first wheel and the at least one second wheel rollingly engage a support surface; and when the second base frame is positioned in the substantially horizontal position, the at least one first wheel and the at least one second wheel are not engaged with the support surface.

39. The exercise device of claim 38, further comprising:

at least one hinge member including a first end portion and a second end portion, the at least one hinge member pivotally connected with the first base frame between the first end portion of the at least one hinge member and the second end portion of the at least one hinge member and wherein the first end portion of the at least one hinge member is connected with the second base frame.

40. The exercise device of claim 38, wherein the at least one first wheel comprises two wheels.

41. The exercise device of claim 38, wherein the at least one second wheel comprises two caster wheels.

42. The exercise device of claim 38, wherein the bench frame assembly includes a seat connected with a rail.

43. The exercise device of claim 38, wherein the resistance system comprises a plurality of resiliently flexible rods.

44. The exercise device of claim 38, further comprising a securing mechanism operably connected with the first base frame and the second base frame, the securing mechanism selectively locking the second base frame in at least one pivotal position relative to the first base frame.

45. The exercise device of claim 44, wherein the securing mechanism comprises at least one pop-pin.

46. The exercise device of claim 14, wherein the rail is pivotally connected with the frame to pivot between the substantially vertical orientation and a substantially horizontal orientation.

* * * * *